US012303040B2

(12) United States Patent
Mountz et al.

(10) Patent No.: US 12,303,040 B2
(45) Date of Patent: May 20, 2025

(54) ROTATABLE TOY BAR AND VIBRATION DEVICE FOR CHILD SWING

(71) Applicant: Wonderland Switzerland AG, Steinhausen (CH)

(72) Inventors: Jonathan K. Mountz, Birdsboro, PA (US); Ethan M. Snyder, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 227 days.

(21) Appl. No.: 18/045,645

(22) Filed: Oct. 11, 2022

(65) Prior Publication Data

US 2023/0117090 A1 Apr. 20, 2023

Related U.S. Application Data

(60) Provisional application No. 63/351,895, filed on Jun. 14, 2022, provisional application No. 63/262,521, filed on Oct. 14, 2021.

(51) Int. Cl.
*A47D 13/10* (2006.01)
*A47D 15/00* (2006.01)

(52) U.S. Cl.
CPC ..... *A47D 13/107* (2013.01); *A47D 15/00* (2013.01)

(58) Field of Classification Search
CPC ..... A47D 13/107; A47D 15/00; A47C 7/62; A47C 7/72
See application file for complete search history.

(56) References Cited

U.S. PATENT DOCUMENTS 8,322,789 B2 * 12/2012 Mendes ..... A47D 15/00 297/274
2006/0186298 A1 8/2006 Thomason et al.
2007/0007804 A1 1/2007 Pemberton et al.
2007/0262627 A1 11/2007 Clapper et al.
2011/0037298 A1 2/2011 Mendes et al.
(Continued)

FOREIGN PATENT DOCUMENTS

CN 206896164 U * 1/2018
CN 108158284 A * 6/2018 ..... A47D 1/08
EP 4346508 A1 4/2024
(Continued)

*Primary Examiner* — Milton Nelson, Jr.
(74) *Attorney, Agent, or Firm* — Fay Kaplun & Marcin, LLP

(57) ABSTRACT

A device includes a base including a base locking structure configured to couple to a child holding apparatus and a toy bar including a bar locking structure adjacent the base locking structure. The base locking structure or the bar locking structure includes an extension from a hub with a protrusion extending therefrom, the extension being deflectable relative to the hub and while the other of the base and bar locking structures includes a recess positioned to receive the protrusion when the toy bar is in a first orientation relative to the base. The recess is configured to engage the protrusion when the toy bar is rotated so that the extension deflects away from the locking receptacle as the protrusion is moved out of the recess and, when rotated so that the protrusion is out of contact with the locking receptacle or the protrusion is received in the recess, the extension reverts to a relaxed state.

14 Claims, 60 Drawing Sheets

(56) References Cited

U.S. PATENT DOCUMENTS

| | | | | |
|---|---|---|---|---|
| 2014/0287846 | A1 | 9/2014 | Mountz et al. | |
| 2019/0017654 | A1 * | 1/2019 | Bearsch | F16M 13/022 |

FOREIGN PATENT DOCUMENTS

| | | | | |
|---|---|---|---|---|
| GB | 2568212 | A | 5/2019 | |
| WO | WO-2016035062 | A1 * | 3/2016 | A47D 15/00 |
| WO | 2022/256319 | A1 | 12/2022 | |

* cited by examiner

ROTATABLE TOY BAR AND VIBRATION DEVICE FOR CHILD SWING

PRIORITY CLAIM

This application claims priority to U.S. Provisional Patent Application Ser. No. 63/262,521 filed Oct. 14, 2021 and U.S. Provisional Patent Application Ser. No. 63/351,895 filed Jun. 14, 2022. The entire contents of each of these applications are incorporated herein by reference.

TECHNICAL FIELD

The present disclosure relates generally to child motion apparatuses and, in particular, to child swing apparatuses.

BACKGROUND

Infant swing apparatuses have become common household items. An infant swing has the primary function of applying a gentle motion, such as a swinging, rocking, or gliding motion, to soothe a child, while providing a safe and comfortable seating area. Infant swings are sold in various shapes, sizes, and configurations. A common style of infant swing includes a frame, a swing arm that hangs down from the frame, and an infant seat attached to the swing arm. The swing arm moves to impart the motion to the infant seat.

A conventional child swing, child carrier or other child holding device (e.g., stroller, child seat, etc.) may often include a toy bar that hangs a toy over a child to provide entertainment to the child. At times, it may be desirable to move or reposition the toy bar so that the toy and the toy bar are not directly over the child. For example, a caregiver who wishes to insert or remove the child from the device or who wants to interact with (e.g., feed the child) or simply look down at the child may desire to reposition the toy bar away from a position directly overhanging the child.

SUMMARY

The present disclosure relates to a device for permitting rotation of a toy bar relative to a child holding apparatus. The device includes a base configured to be coupled to a child holding apparatus, the base including a base locking structure, the base including a first end configured to be to coupled the child holding apparatus and a second end. In addition, the device a toy bar extending between a first end rotatably coupled to the base and a second end, the toy bar including a bar locking structure adjacent to the base locking structure. A first one of the base locking structure and the bar locking structure includes a first extension extending laterally from a hub with a first protrusion extending from the first extension. The first extension is deflectable relative to the hub. A second one of the base locking structure and the bar locking structure includes a first recess positioned to receive the first protrusion when the toy bar is in a first rotational orientation relative to the base, the first recess being configured to engage the first protrusion when the toy bar is rotated relative to the base so that the first extension is deflected away from the second one of the base locking structure and the bar locking structure as the first protrusion is moved out of the first recess and, when the toy bar is rotated so that the first protrusion is brought out of contact with the second one of the base locking structure and the bar locking structure or so that the first protrusion is again received in the first recess, the first extension reverts back to a relaxed state.

In an embodiment, the base is permanently coupled to the child holding apparatus.

In an embodiment, the base is selectively coupleable and removable from the child holding apparatus.

In an embodiment, the base is configured to engage a feature on the child holding apparatus to ensure that the base is coupled to the child holding apparatus in a desired position.

In an embodiment, the base is configured to be selectively coupled to a child holding apparatus that is one of a child seat and a child swing and wherein the feature is an actuator for manipulating a position of the one of a child seat and a child swing.

In an embodiment, the base locking structure is a locking plate including the first protrusion and wherein the first extension is cantilevered from the hub over a deflection recess within the base on a side of the locking plate opposite a side of the locking plate that faces the bar locking structure.

In an embodiment, the bar locking structure is a locking receptacle including the first recess and wherein the bar locking structure is non-rotatably coupled to the toy bar.

In an embodiment, the locking plate is non-rotatably coupled to the base.

In an embodiment, the bar locking structure is a locking plate including the first protrusion and wherein the first extension is cantilevered from the hub over a deflection recess within the toy bar on a side of the locking plate opposite a side of the locking plate that faces the base locking structure.

In an embodiment, the base locking structure is a locking receptacle including the first recess and wherein the base locking structure is non-rotatably coupled to the base.

In an embodiment, the bar locking structure, the base locking structure and the base are rotatably coupled to one another so that the bar locking structure and the base locking structure are pressed against one another and may rotate relative to one another only when the first extension deflects into the deflection recess.

In addition, the present disclosure relates to a toy bar device which may include a toy bar extending from a first end to a second end; and a coupling configured to rotatably couple the toy bar to a child holding apparatus. The coupling includes a locking receptacle including a first surface having a recess extending thereinto and a locking plate including an extension extending laterally from a hub. The extension is deflectable relative to the hub and having a protrusion extending therefrom. The protrusion is sized and shaped to be received in the recess in the first surface of the locking receptacle. A first one of the locking receptacle and the locking plate are non-rotatably coupled to the toy bar and a second one of the locking plate and the locking receptacle being configured to be non-rotatably coupled to a child holding apparatus. The locking receptacle and the locking plate are coupled to one another to rotatably couple the toy bar to the child holding apparatus. When the protrusion is aligned with and received in the recess of the locking receptacle, the locking plate is in a relaxed state in which the extension is not deflected and the toy bar is in a first position, and when the locking receptacle is rotated about a rotation axis, the protrusions are brought into contact with the bottom surface of the locking receptacle and a force is applied to the protrusions at a point of the contact, the force causing the extensions to deflect and allowing the locking receptacle and the attached toy bar to continue rotating into a second position.

In addition, the present disclosure relates to a device for permitting rotation of a toy bar relative to a child holding apparatus. The device includes a base configured to be coupled to a child holding apparatus, the base including a base locking structure, the base including a first end configured to be to coupled the child holding apparatus and a second end; and a toy bar extending between a first end rotatably coupled to the base and a second end, the toy bar including a bar locking structure adjacent to the base locking structure. A first one of the base locking structure and the bar locking structure includes a first extension extending laterally from a hub with a first recess extending into the first extension. The first extension is deflectable relative to the hub. A second one of the base locking structure and the bar locking structure includes a first protrusion positioned to be received in the first recess when the toy bar is in a first rotational orientation relative to the base. The first recess is configured to engage the first protrusion when the toy bar is rotated relative to the base so that the first extension is deflected away from the second one of the base locking structure and the bar locking structure as the first protrusion is moved out of the first recess and, when the toy bar is rotated so that the first protrusion is brought out of contact with the second one of the base locking structure and the bar locking structure or so that the first protrusion is again received in the first recess, the first extension reverts back to a relaxed state.

In an embodiment, the base locking structure is a locking receptacle including the first recess and wherein the first extension is cantilevered from the hub over a deflection recess within the base on a side of the locking receptacle opposite a side of the locking receptacle that faces the bar locking structure.

In an embodiment, the bar locking structure is a locking plate including the first projection and wherein the bar locking structure is non-rotatably coupled to the toy bar.

In an embodiment, the bar locking structure, the base locking structure and the base are rotatably coupled to one another so that the bar locking structure and the base locking structure are pressed against one another and may rotate relative to one another only when the first extension deflects into the deflection recess.

In an example, a child swing comprises a base, a column, and a seat. The base is configured to support the child swing on a floor. The column extends upwards from the base and defines an axis of rotation. The seat is supported by the column above the base. The column is configured to transition the seat between a lowered position in which the seat is positioned at a first height above the floor, and a raised position in which the seat is positioned at a second height above the floor, greater than the first height. The seat is configured to rotate about the axis of rotation relative to the base in both the lowered position and the raised position.

In another example, a child swing, comprises a base, a column, a seat, and a recline mechanism. The base is configured to support the child swing on a floor. The column extends upwards from the base and defines an axis of rotation. The seat is supported by the column above the base. The recline mechanism couples the seat to the column and is configured to selectively transition the seat between a plurality of recline positions. The recline mechanism has a first seat mount and a second seat mount. The first seat mount is attached to the seat. The second seat mount is attached to the column. The first seat mount and the second seat mount are pivotably coupled to one another at a recline pivot axis such that the seat is configured to rotate relative to the column about the recline pivot axis between the plurality of recline positions.

In yet another example, a child swing comprises a base, a column, a seat, and a magnetic drive. The base is configured to support the child swing on a floor. The column extends upwards from the base, and at least a portion of the column is rotatable relative to the base about an axis of rotation. The seat is supported by the column above the base such that the seat is configured to rotate with the at least a portion of the column about the axis of rotation. The magnetic drive comprises at least one magnet and at least one other magnet. The at least one other magnet defines a first end having a first polarity, and a second end having a second polarity, different from the first polarity. The first and second ends are spaced from one another along a direction of rotation. The at least one magnet and the at least one other magnet are configured to apply magnetic forces to one another so as to cause relative rotation between the at least one magnet and the at least one other magnet that drives the at least a portion of the column to rotate about the axis of rotation relative to the base.

In yet still another example, a child swing comprises a base, a seat, at least one magnet, and a hall effect sensor. The base is configured to support the child swing on a floor. The seat is supported above the base such that the seat is configured to rotate relative to the base. The at least one magnet has a north pole and a south pole spaced from one another along a direction of rotation. One of i) the at least one magnet or ii) the hall effect sensor is positionally fixed relative to the seat such that the one of i) at least one least one magnet or ii) the hall effect sensor is configured to rotate relative to the base with rotation of the seat. The at least one magnet and the hall effect sensor are rotatable relative to one another such that the hall effect sensor is configured to sense a strength of each magnetic field generated by the north and south poles and generate a signal that is indicative of a rotational movement of the seat.

In even yet still another example, a child swing, comprises a base, a column, a seat, and a housing. The base is configured to support the child swing on a floor. The column extends upwards from the base, and at least a portion of the column is rotatable relative to the base about an axis of rotation. The seat is supported by the column above the base such that the seat is configured to rotate with the at least a portion of the column about the axis of rotation. The housing has an inner side that faces the column, and an outer side opposite the inner side. The outer side supports a control panel that is configured to be engaged by a user to operate the child swing. The control panel is supported above the base at a height that is next to the column along a horizontal direction. The housing is positionally fixed relative to the base such that the at least a portion of the column rotates relative to the inner side of the housing.

In a further example, a child swing comprises a base, a column, a seat, a plurality of optical sensors, and an optical encoder. The base is configured to support the child swing on a floor. The column extends upwards from the base, and at least a portion of the column is rotatable relative to the base about an axis of rotation. The seat is supported by the column above the base such that the seat is configured to rotate with the at least a portion of the column about the axis of rotation. The plurality of optical sensors comprise 1) a first light source to emit a first light beam propagating along a first optical path, 2) a first detector, spaced from the first light source and disposed in the first optical path to detect the first light beam, 3) a second light source to emit a second light beam along a second optical path, different from the first optical path, and 4) a second detector, spaced from the second light source and disposed in the second optical path to detect the second light beam. The optical encoder is disposed in the first optical path and the second optical path. One of i) the plurality of optical sensors or ii) the optical encoder is positionally fixed relative to the column such that the one of i) the plurality of optical sensors or ii) the optical encoder is configured to relate relative to the base with rotation of the seat. The plurality of optical sensors and the optical encoder are rotatable relative to one another such that the plurality of optical sensors are each configured generate a signal that is indicative of a rotational movement of the seat.

In an example, a child swing comprises a base, a column, and a seat. The base is configured to support the child swing on a floor. The column extends upwards from the base, and at least a portion of the column is rotatable relative to the base about an axis of rotation. The seat that is configured to removably couple to the at least a portion of the column such that rotation of the at least a portion of column causes a corresponding rotation of the seat.

In another example, a juvenile product is configured to support a child above a floor. The juvenile product comprises a component, and at least a portion of a leg configured to removably couple to the component. One of the component and the at least the portion of the leg defines a plate and the other of the component and the at least the portion of the leg defines a socket configured to receive an end of the plate therein. The product comprises a latch configured to releasably secure the end of the plate within the socket to secure the at least the portion of the leg to the component.

In yet another example, a method of assembling a juvenile product comprises a step of aligning a leg of the juvenile product with a component of the juvenile product, wherein one of the leg and the component comprises a plate and the other of the leg and the component defines a socket. The method comprises a step of inserting an end of the plate into the socket so as to couple the leg to the component, and a step of causing a latch to releasably secure the end of the plate within the socket to secure the at least the portion of the leg to the component.

In yet still another example, a packaged child swing comprises a package and a child swing. The child swing comprises a seat and at least one leg. The seat is configured to support a child. The at least one leg is configured to removably couple to the child swing, and the child swing is stowed in the package such that the at least one leg is removed from the child swing and stowed in the seat.

In even yet still another example, a method of packaging a child swing comprises a step of stowing the child swing in the package such that at least one leg of the child swing is detached from the child swing and stowed in a seat of the child swing.

BRIEF DESCRIPTION OF THE DRAWINGS

The following description of the illustrative embodiments may be better understood when read in conjunction with the appended drawings. It is understood that potential examples of the disclosed systems and methods are not limited to those depicted.

DETAILED DESCRIPTION

Figure 2:
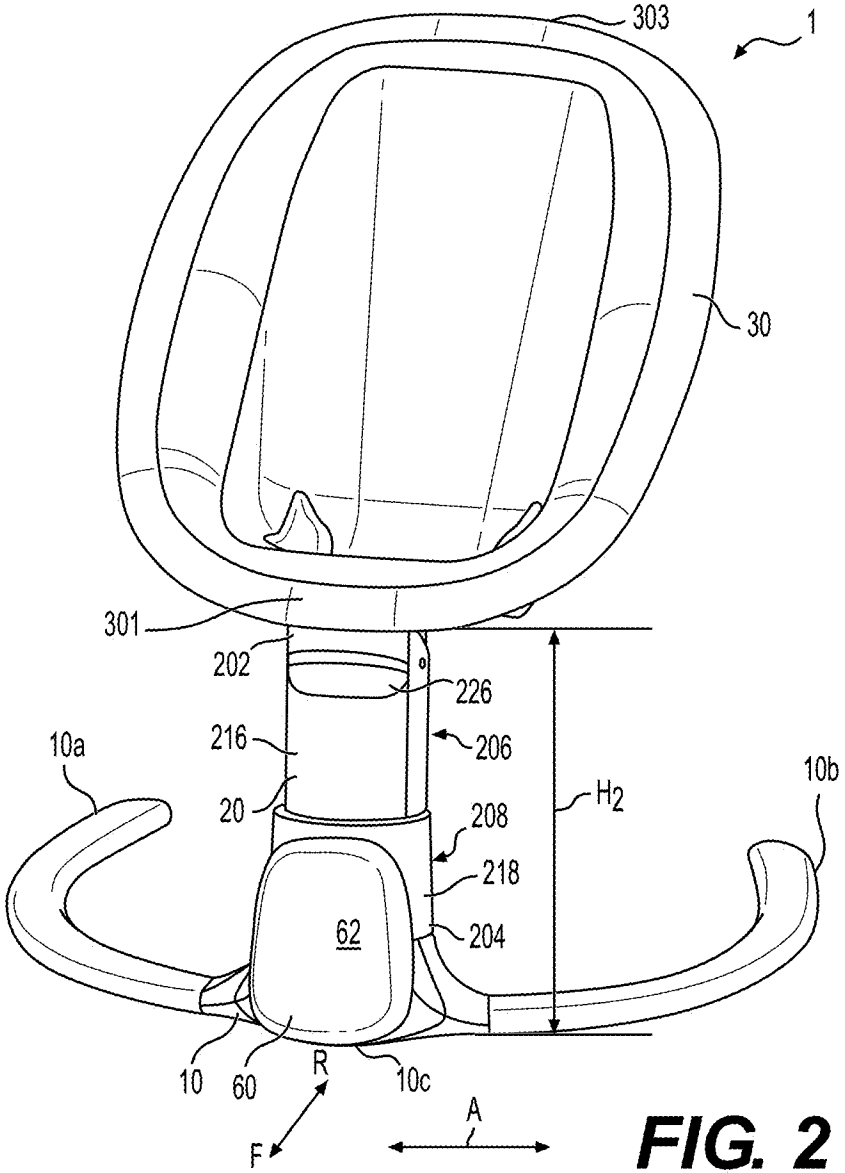
FIG. 2 shows a front perspective view of the child swing of FIG. 1 in a raised position.

Referring generally to the figures, examples of this disclosure relate to a child swing 1 comprising a base 10 and a seat 30 supported by the base 10 above a support surface such as a floor, where the seat 30 is configured to move by, for example, swinging, rocking, or gliding relative to the base 10. The child swing 1 can comprise an extendable column 20, a recline mechanism 40, 40', a magnetic drive 50, a seat motion sensor 70, and removable legs 102, 104 among other features. However, it will be understood that alternative child swings of this disclosure need not be implemented with all of the extendable column 20, the recline mechanism 40, 40', the magnetic drive 50, the seat motion sensor 70, and the removable legs 102, 104. Rather, alternative child swings of this disclosure can be implemented fewer than all of the extendable column 20, the recline mechanism 40, 40', the magnetic drive 50, the seat motion sensor 70, and the removable legs 102, 104. For example, alternative child swings of this disclosure can include one or more, or any combination of two or more, of the extendable column 20, the recline mechanism 40, 40', the magnetic drive 50, the seat motion sensor 70, or the removable legs 102, 104.

Extendable Height Seat

Conventionally, child swings that are smaller in overall size are referred to as compact swings, while swings that are larger in overall size are referred to as full-sized swings. Compact child swings commonly have seats that are closer to the ground than full-sized swings. Further, compact child swings are often more portable and have a smaller footprint to occupy less space in a caregiver's home than full-sized swings. However, there may be times when a caregiver wishes to have the seat at a greater height (e.g., closer to the height of a full-sized swing) so that the child is more easily accessible to the caregiver. Therefore, it would be beneficial for a child swing to provide the portability and compactness of a compact swing, while also allowing the caregiver to raise the seat for ease of access to the child.

Figure 1:
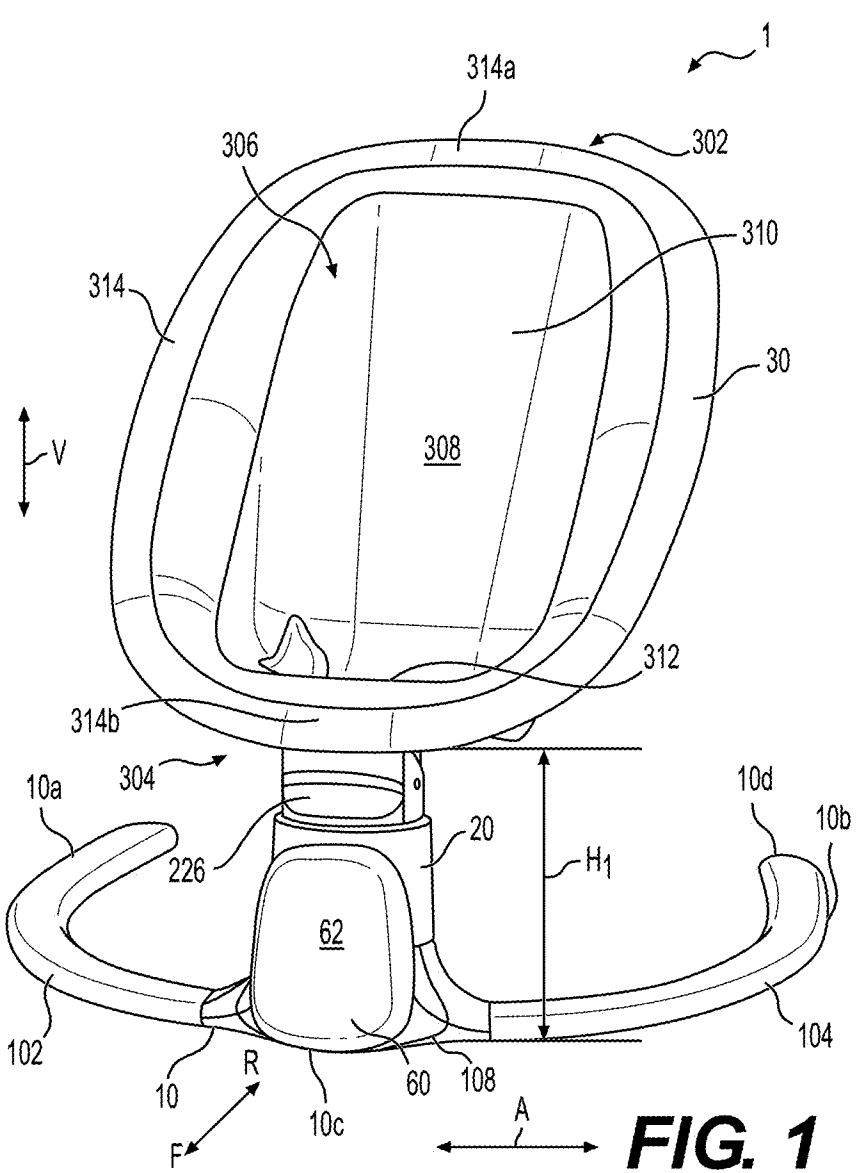
FIG. 1 shows a front perspective view of a child swing in a lowered position according to one example, the child swing including a base, a column that extends up from the base, and a seat supported by the column.
Figure 3:
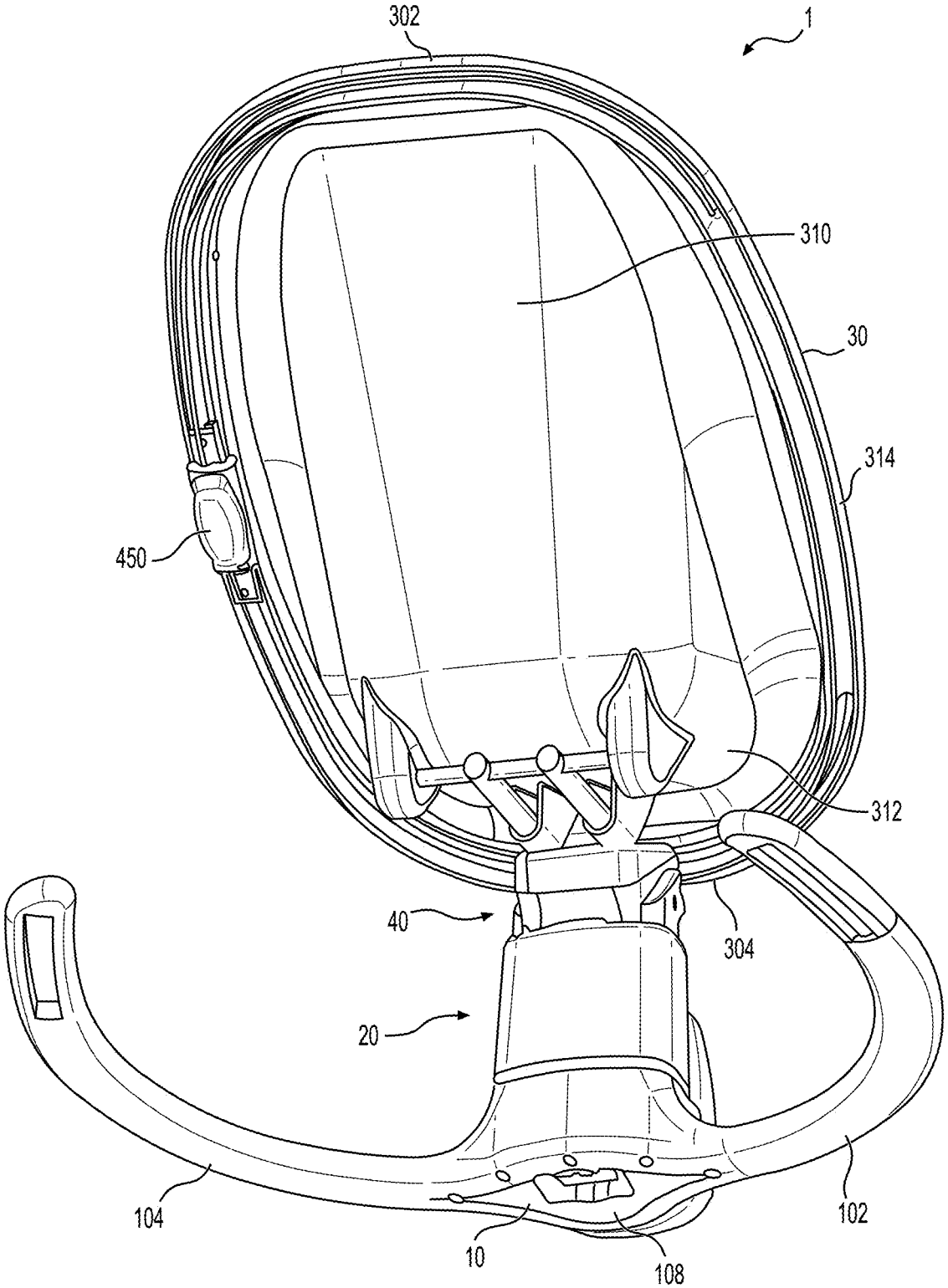
FIG. 3 shows a rear perspective view of the child swing of FIG. 1 in the lowered position.

Turning to FIGS. 1 to 3, a child swing 1 according to some examples of the present disclosure can comprise a base 10, a column 20, and a seat 30. The base 10 is configured to support the child swing 1 on a floor or other surface. The column 20 extends upwards from the base 10 and defines an axis of rotation $A_R$ (labeled in FIGS. 4 and 5). The seat 30 is supported by the column 20 above the base 10. For example, the column 20 can be attached to the seat 30 such that the seat 30 is disposed on top of the column 20. The column 20 is configured to transition the seat 30 between a plurality of height positions. For example, the column 20 is configured to transition the seat 30 between a lowered position (FIG. 1) in which the seat 30 is positioned at a first height $H_1$ above the floor, and a raised position (FIG. 2) in which the seat 30 is positioned at a second height $H_2$ above the floor, greater than the first height $H_1$. The difference between the lowered (or lowest position) and the raised (or highest position) can be two inches or more, such as three inches or more, such as four inches or more, such as five inches or more, such as six inches or more, such as seven inches or more, or such as eight inches or more. The column 20 can be configured to transition an entirety of the seat 30 between the different height positions. In some examples, the plurality of height positions can include one or more intermediate positions between the lowered and raised positions, and the column 20 can be configured to transition the seat 30 to the one or more intermediate positions. The child swing 1 can be configured to selectively lock the seat 30 in each of the plurality of height positions. In some examples, the child swing 1 can be transitioned between the lowered and raised positions manually by a caregiver raising or lowering the seat 30. In other examples, the child swing 1 can include a driver, such as a motor or actuator, that raises and lowers the seat 30.

The seat 30 is configured to rotate about the axis of rotation $A_R$ relative to the base in two or more, such as all, of the plurality of height positions. For example, the seat 30 can be configured to rotate about the axis of rotation $A_R$ when the seat 16 is in each of the lowered position, the raised position, and optionally the one or more intermediate positions if included. The child swing 1 can be configured such that, when the seat 30 is in each of the height positions, the seat 30 rotates without the column 20 changing the height position. In other words, the height position can be fixed as the seat 30 rotates. Thus, the child swing 1 can be configured to rotate the seat 30 in each height position while the seat 30 is locked in the height position. The seat 30 can rotate about the axis of rotation by less than 360 degrees. For example, the seat 30 can rotate in a range of up to +30 degrees and −30 degrees from a neutral position. The neutral position can be a position in which the seat 30 faces straight forward. The neutral position can be a position in which the seat 30 naturally rests when the swing is not activated (e.g., swing angle $\alpha$=0 degrees). The child swing 1 can comprise a control panel 62 that is configured to be engaged by a caregiver to control various functions of the child swing 1, such as to turn on the swing 1, control a speed of the swing 1, and adjust music or other sounds emitted from the swing 1.

With continued reference to FIGS. 1 to 3, various aspects of child swings according to the disclosure will be discussed in further detail. The base 10 of the child swing 1 can be configured in any suitable manner to limit, or prevent, tip over of the child swing 1 when a child is positioned with the seat 30. The base 10 can define a footprint that limits or prevents tip over of the child swing 1. In some examples, the footprint can be at least as wide as the seat 30. For instance, the base 10 can have a first side 10*a* and a second side 10*b* that are offset from one another along a lateral direction A. The base 10 can have a width from the first side 10*a* to the second side 10*b* that is greater than a width of the seat 30 along the lateral direction A when the seat 30 is in the neutral position. The base 10 can comprise at least one leg that extends out on opposing sides of the column 20. For instance, the base 10 can comprise a main body 108, and at least one leg, such as a first leg 102 and a second leg 104, that extend out on opposing sides of the main body 108. The first and second legs 102 and 104 can extend out from main body 108 with respect to the lateral direction A. Each leg 102, 104 can have a tubular shape.

The base 10 can also have a front end 10*c* and a rear end 10*d*. The front end 10*c* can be spaced from the rear end 10*d* along a forward direction F, and the rear end 10*d* can be spaced from the front end 10*c* along a rearward direction R. The forward and rearward directions can be perpendicular to the lateral direction A. Each of the legs 102 and 104 can extend along the rearward direction as it extends away from the column 20 along the lateral direction A. Each leg can be formed from tubing or other suitable structure. Each leg can extend generally in a horizontal plane along the floor as it extends away from the column 20. It will be understood that the base 10 can be formed in any other suitable manner and can have any other suitable shape. For example, the base 10 can comprise a tubing (not shown) that extends out from opposing sides of the column and defines closed shape behind, in front, or around the column 20. As another example, the base 10 can have a box-like or plate-like shape, instead of separate tubular legs 102 and 104. As yet another example, the base 10 can additionally or alternatively comprise at least one leg, such as a pair of legs, that extends along the forward direction as it extends from the column 20 along the lateral direction A.

The seat 30 has an upper end 302 and a lower end 304 that are opposite from one another along a vertical direction V. The vertical direction V can be perpendicular to the forward direction F, the rearward direction R, and the lateral direction A. The seat 30 has a front end 301 and a rear end 303 that are opposite one another along a first direction. The first direction can be aligned with the forward direction F and rearward direction R when seat 30 is in the neutral position. The seat 30 comprises a seating surface 308 that is configured to support a child thereon. The seating surface 308 can comprise a seatback 310 and a seat pan 312. The seat 30 defines a recess 306 that extends therein to the seating surface 308. The recess 306 can extend into the upper end 302 towards the lower end 304 and terminate at the seat pan 312. The recess 306 can also extend into the front end 301 towards the rear end 303 and terminate at the seatback 310.

The seat 30 can comprise a seat rim 314. The seat rim 314 can have a ring shape or another suitable shape. In some exemplary embodiments, the seat rim 314 can be defined by a tubular ring or other suitable structure. The tubular ring can be made of metal or other suitably rigid material. In other examples, the seat rim 314 can be the rim of a molded seat. The seat rim 314 can lie in a seat rim plane that is angularly offset from the axis of rotation $A_R$. The axis of rotation $A_R$ can extend through the seat rim plane. The recess 306 can extend into the seat rim 314 such that the seat rim 314 is disposed around the seating surface 308. The seat rim 314 can have first end 314*a* and a second end 314*b*. The first and second ends 314*a* and 314*b* can be offset from one another along the seat rim plane. The first end 314*a* of the seat rim 314 can be disposed at the upper end 302 of the seat 30 at the rear end 303. Thus, the first end 314*a* can be referred to as an upper, rear end. The first end 314*a* of the seat rim 314 can be offset from the second end 314*b* of the seat rim 314 along the vertical direction V and the rearward direction R. The second end 314*b* of the seat rim 314 can be disposed at the lower end 304 of the seat 30 at the front end 301. Thus, the second end 314*b* can be referred to as a lower, front end. The second end 314*b* of the seat rim 314 can be offset from the first end 314*a* of the seat rim 314 along the vertical direction V and the forward direction F. In some examples, the seat 30 can be attached to the column 20 at the lower end 304. Additionally, or alternatively, the seat 30 can be attached to the column 20 at the front end 301.

Figure 34C:
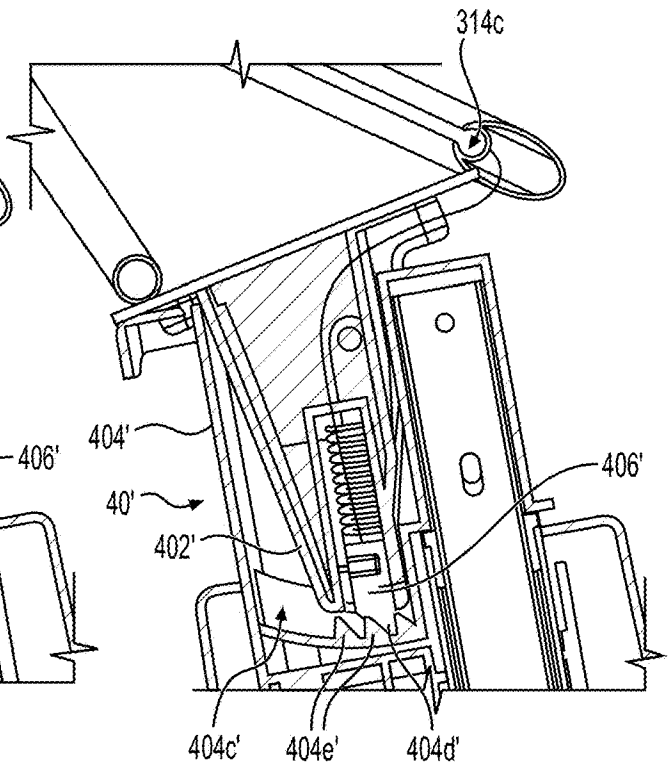
FIG. 34A to 34C show three cross-sectional views of a portion of the child swing, each including a recline mechanism and showing the seat being reclined in a different recline position.
Figure 34B:
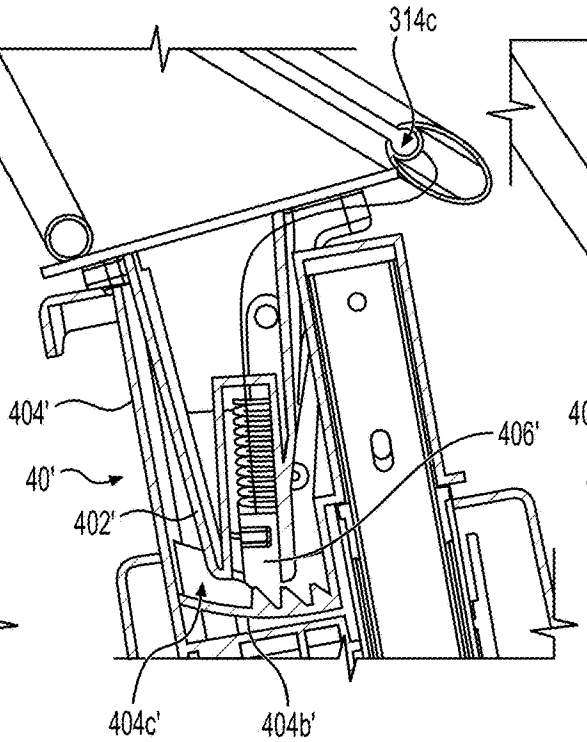
Figure 34A:
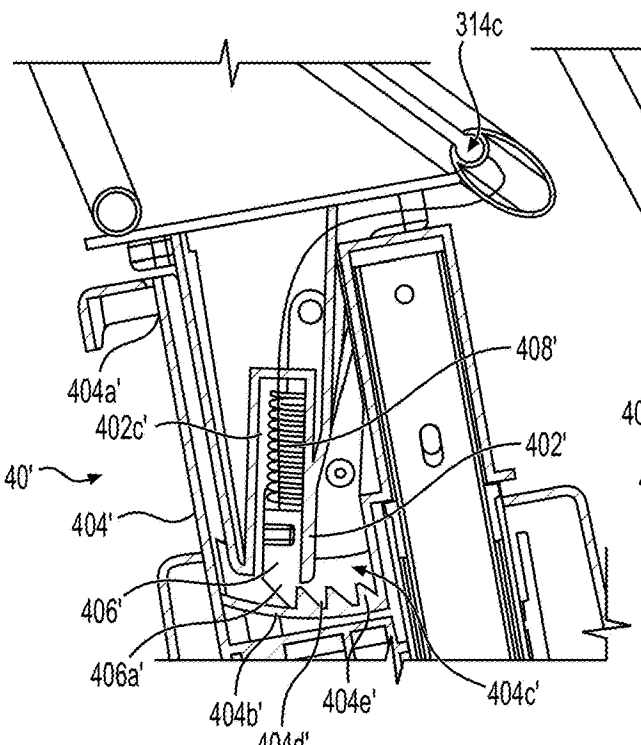
Figure 35:
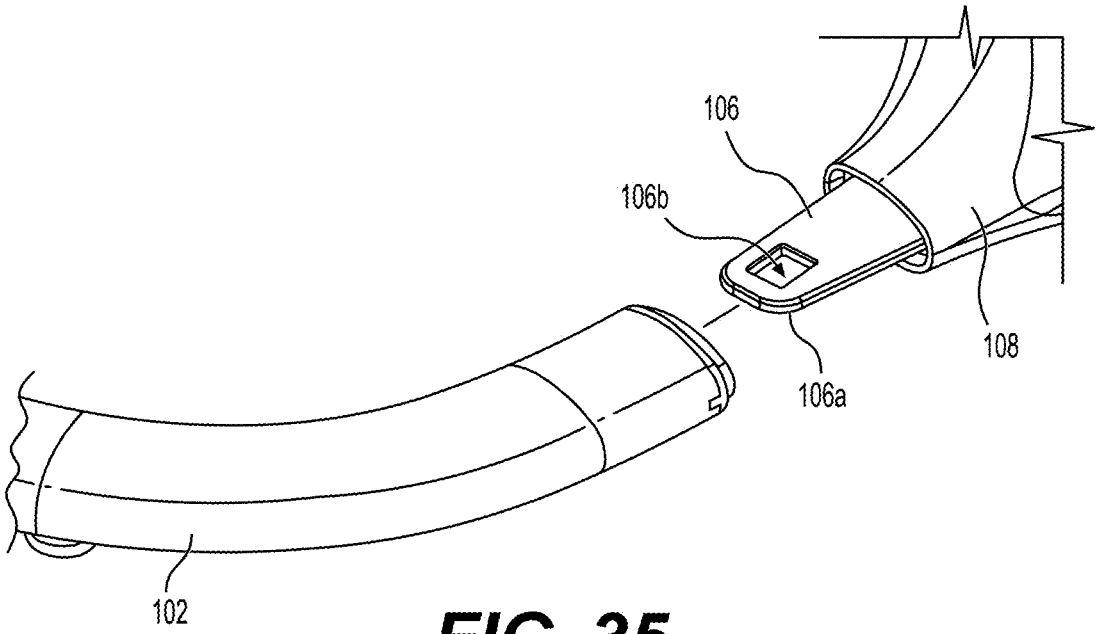
FIG. 35 shows an exploded top perspective view of a coupling according to one example for coupling a leg of the child swing to a base of the child swing.
Figure 36:
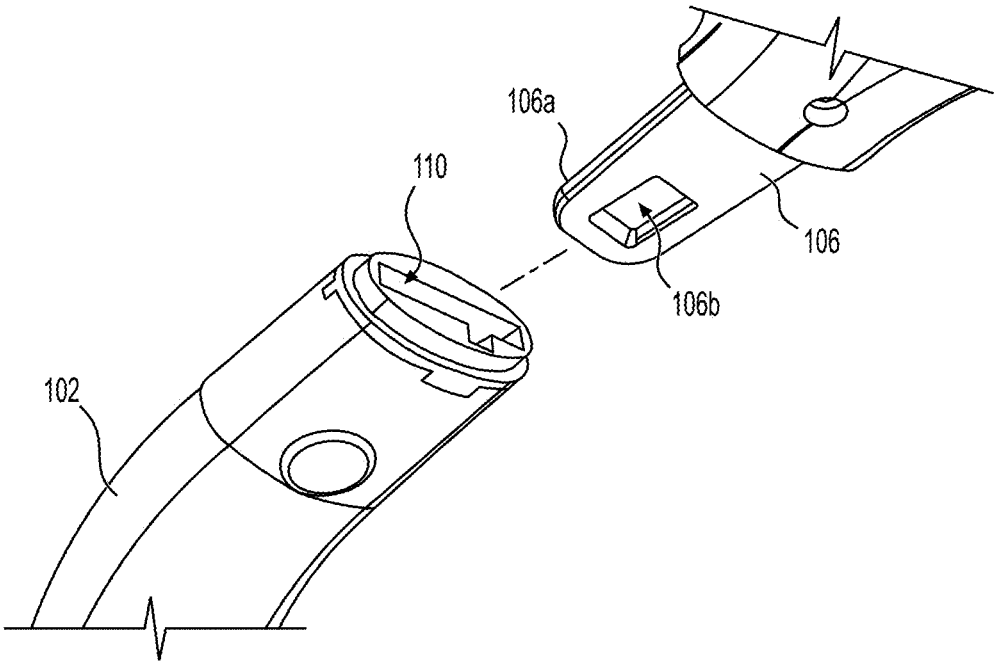
FIG. 36 shows an exploded bottom perspective view of the coupling of FIG. 35.

The seating surface 308 can be a soft seating surface formed from soft goods that are suspended from the seat rim 314. In some examples, the seat rim 314 can define a channel 314*c* (labeled in FIGS. 34A to 34C) that extends around an inner perimeter of the seat rim 314. The channel 314*c* can be configured to receive an outer edge of the soft goods seat such that the seat rim 314 remains exposed (i.e., not covered by the soft goods) when the soft goods seat is attached to the seat rim 314. Alternatively, the seating surface 308 can be a rigid seating surface formed from a rigid material, such as a polymer, that defines the seat rim 314. The rigid seating surface can be covered in soft goods to provide cushioning for the child.

The column 20 can comprise an upper column end 202, and a lower column end 204 disposed below the upper end 202 along the axis of rotation $A_R$. In some examples, the column 20 can be linear from the upper column end 202 to the lower column end 204. The column 20 can be elongate from the upper column end 202 to the lower column end 204. The upper column end 202 can be attached to the seat 30, and the lower column end 204 can be attached to the base 10. The column 20 can comprise a first column portion 206 that extends from the upper column end 202 towards the lower column end 204, and a second column portion 208 that extends from the lower column end 204 towards the upper column end 202. The first and second column portions 206 and 208 can be configured to extend and retract relative to one another to transition the seat 30 between the plurality of height positions. In some examples, the first and second column portions 206 and 208 can extend and retract by telescoping relative to one another. The first column portion 206 is configured to extend up from the second column portion 208 as the seat 30 is transitioned to the raised position. FIGS. 1 to 3 show an example where the second column portion 208 is an outer column portion, and the first column portion 206 is an inner column portion that telescopes into the second column portion 208. However, it will be understood that, in alternative examples, the first column portion 206 could be an outer column portion, and the second column portion 208 could be an inner column portion that telescopes into the first column portion 206.

At least a portion, such as an entirety, of the column 20 can be configured to rotate about the axis of rotation $A_R$ relative to the base 10. The seat 30 can be rotationally fixed to the upper end 202 such that rotation of the first column portion 206 of the column 20 about the axis of rotation $A_R$ causes a corresponding rotation of the seat 30. The seat 30 can be translationally fixed to the upper end 202 such that translation of the first column portion 206 of the column 20 relative to the second column portion 208 of the column 20 causes a corresponding translation of the seat 30.

Figure 4:
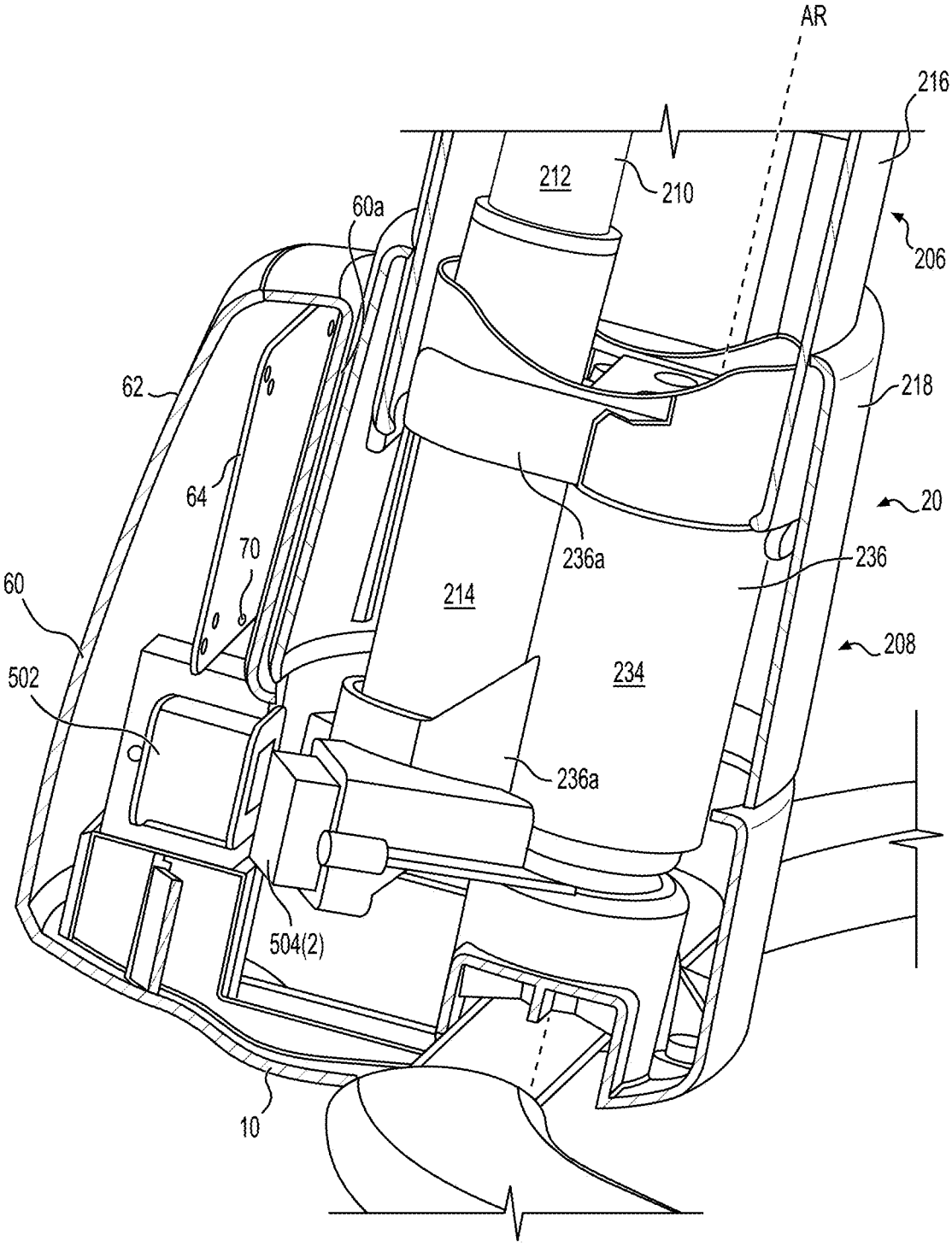
FIG. 4 shows a cross-sectional perspective view of a portion of the child swing of FIG. 1 that includes a lower portion of the column.
Figure 5:
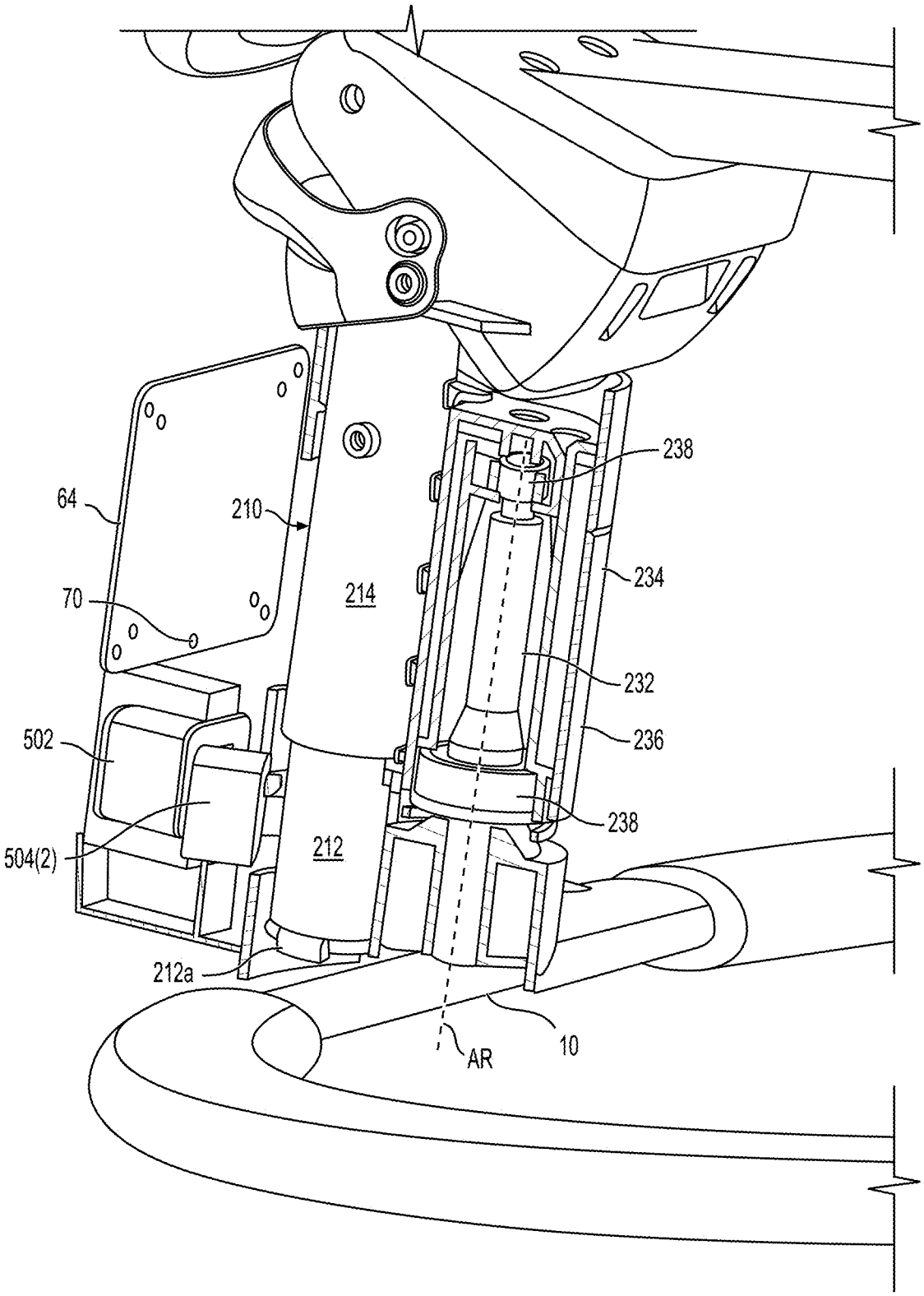
FIG. 5 shows a cross-sectional perspective view of a portion of the child swing of FIG. 1 with outer housings of the cover and base removed.

Turning to FIGS. 4 and 5, the column 20 can comprise a shaft 210 (which may be referred to herein as an extendable shaft or telescoping shaft) having a first shaft portion 212, and a second shaft portion 214 that are configured to extend and retract (e.g., telescope) relative to one another to transition the seat 30 between the plurality of height positions. The first shaft portion 212 can extend upward from the second shaft portion 214 when the seat 30 is in the raised position. FIGS. 4 and 5 show an example where the second shaft portion 214 is an outer shaft portion, and the first shaft portion 212 is an inner shaft portion that telescopes into the second shaft portion 214. However, it will be understood that, in alternative examples, the first shaft portion 212 could be an outer shaft portion, and the second shaft portion 214 could be an inner shaft portion that telescopes into the first shaft portion 212.

The first shaft portion 212 can have an upper end that is rotationally fixed to the seat 30, such as to the lower end 304 of the seat 30, such that rotation of the first shaft portion 212 relative to the base 10 about the axis of rotation $A_R$ causes a corresponding rotation of the seat 30. The upper end of the first shaft portion 212 can also be translationally fixed to the seat 30 such that that translation of the first shaft portion 212 relative to the second shaft portion 214 causes a corresponding translation of the seat 30. The second shaft portion 214 can be rotatably attached to the first shaft portion 212 such that rotation of the first shaft portion 212 about the axis of rotation $A_R$ causes a corresponding rotation of the second shaft portion 214. The second shaft portion 214 can be translationally fixed relative to the base 10 with respect to the vertical direction V.

In some examples, as illustrated in FIG. 5, the shaft 210 can be offset from the base 10 with respect to a horizontal direction. In such examples, a lower end 212*a* of the first shaft portion 212 can be configured to retract to a position that is aligned (or next to) the base 10 along the horizontal direction when the seat 30 is in the lowest height position. In other words, when the seat 30 is in the lowest height position, the lower end 212*a* of the first shaft portion 212 can be positioned lower than an upper end of the base 10 with respect to the vertical direction V. The lower end 212*a* of the first shaft portion 212 can extend in front of the base 10 as shown or behind the base 10 (not shown). Thus, the base 10 does not interfere with the lower end 212*a* of the first shaft portion 212 when the first shaft portion 212 is moved to the lowest height position. This can enable the lowest height position to be lower than if the base 10 were disposed directly below, and hence in interference with, the lower end 212*a* of the first shaft portion 212. However, it will be understood that, in other examples, the shaft 210 can be aligned with base 10 such that the central axis of the shaft 210 intersects the base 10, and the base 10 interferes with the downward travel of the lower end of the first shaft portion 212.

The first portion 206 of the column 20 can comprise the first shaft portion 212 and a first housing portion 216, where the first shaft portion 212 is at least partially disposed in the first housing portion 216. Similarly, the second portion 208 of the column 20 can comprise the second shaft portion 214 and a second housing portion 218, where the second shaft portion 214 is at least partially disposed in the second housing portion 218. However, it will be understood that, in alternative examples, the column 20 need not include the first and second housing portions 216 and 218. The first housing portion 216 and the second housing portion 218 can extend and retract relative to one another. In some examples, the first and second housing portions 216 and 218 can extend and retract by telescoping relative to one another. The first housing portion 216 can extend upwards from the second housing portion 218 when the seat 30 is in the raised position. FIGS. 1 to 4 show an example where the second housing portion 218 is an outer housing portion, and the first housing portion 216 is an inner housing portion that telescopes into the second housing portion 218. However, it will be understood that, in alternative examples, the first housing portion 216 could be an outer housing portion, and the second housing portion 218 could be an inner housing portion that telescopes into the first housing portion 216.

In some examples, the first housing portion 216 and the first shaft portion 212 can be rotationally fixed relative to one another such that rotation of the first shaft portion 212 relative to the base 10 causes a corresponding rotation of the first housing portion 216. The first housing portion 216 and the first shaft portion 212 can be translationally fixed relative to one another with respect to the vertical direction V such that translation of the first shaft portion 212 relative to the second shaft portion 214 and the second housing portion 218 causes a corresponding translation of the first housing portion 216 relative to the second shaft portion 214 and the second housing portion 218. In some examples, the second housing portion 218 and the second shaft portion 214 can be rotationally fixed relative to one another such that rotation of the second shaft portion 214 relative to the base 10 causes a corresponding rotation of the second housing portion 218. The second housing portion 218 and the first shaft portion 212 can be translationally fixed relative to one another and the base 10 with respect to the vertical direction V.

Figure 6:
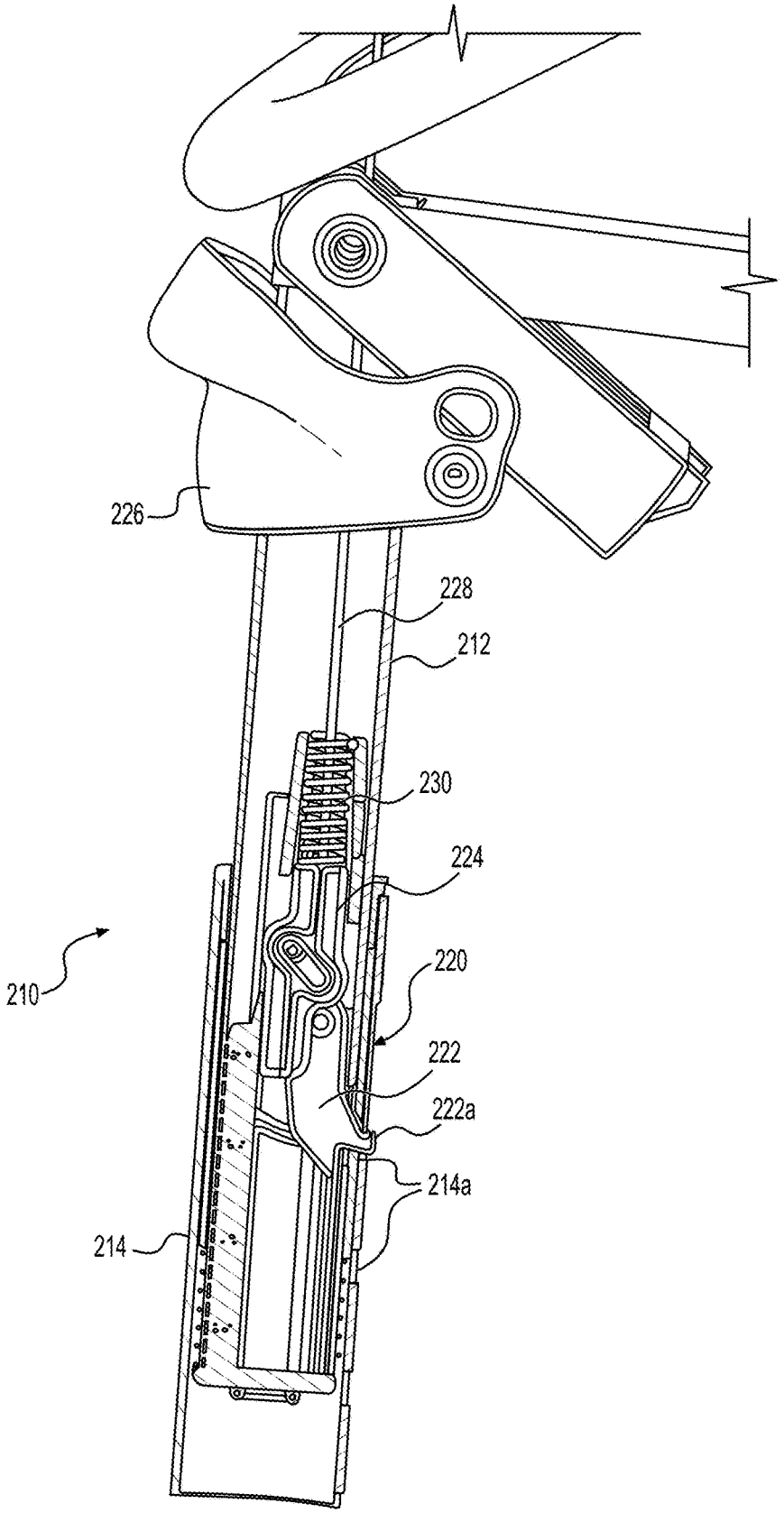
FIG. 6 shows a cross-sectional perspective view of an extendable shaft of the child swing of FIG. 1, the extendable shaft including a latch that is configured to selectively lock the child swing in a plurality of different height positions.
Figure 7:
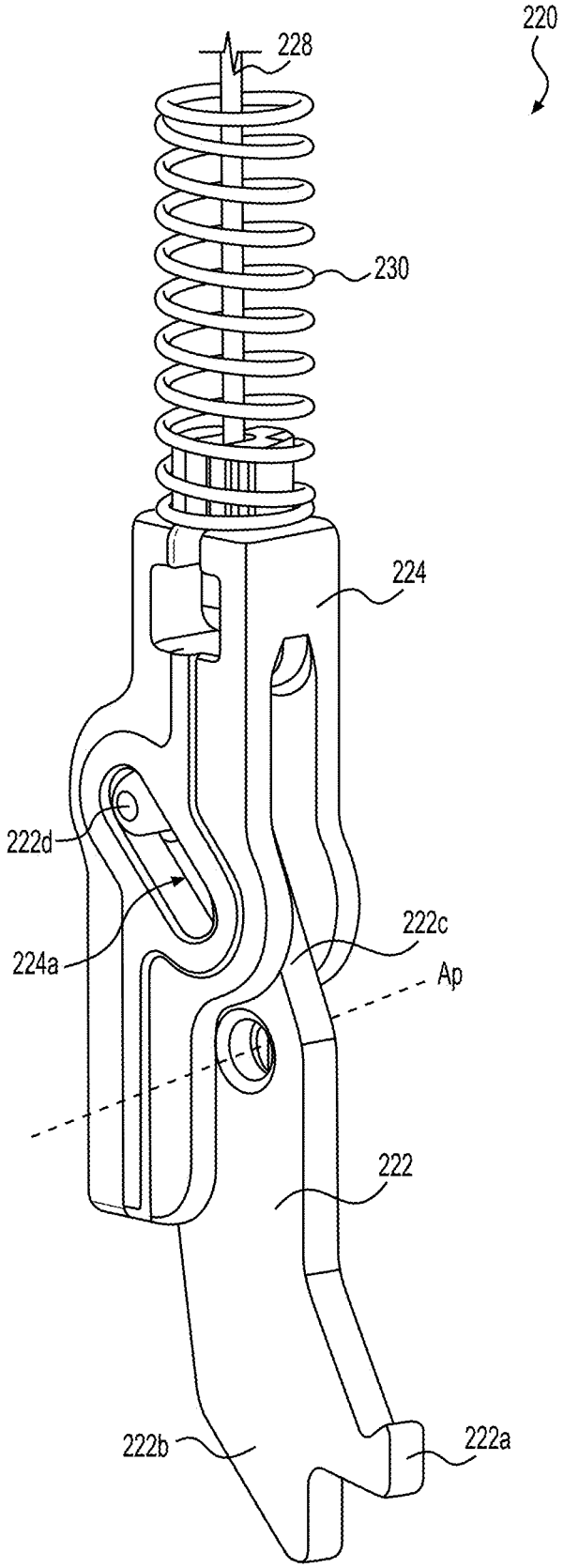
FIG. 7 shows a perspective view of the latch of FIG. 6.
Figure 8:
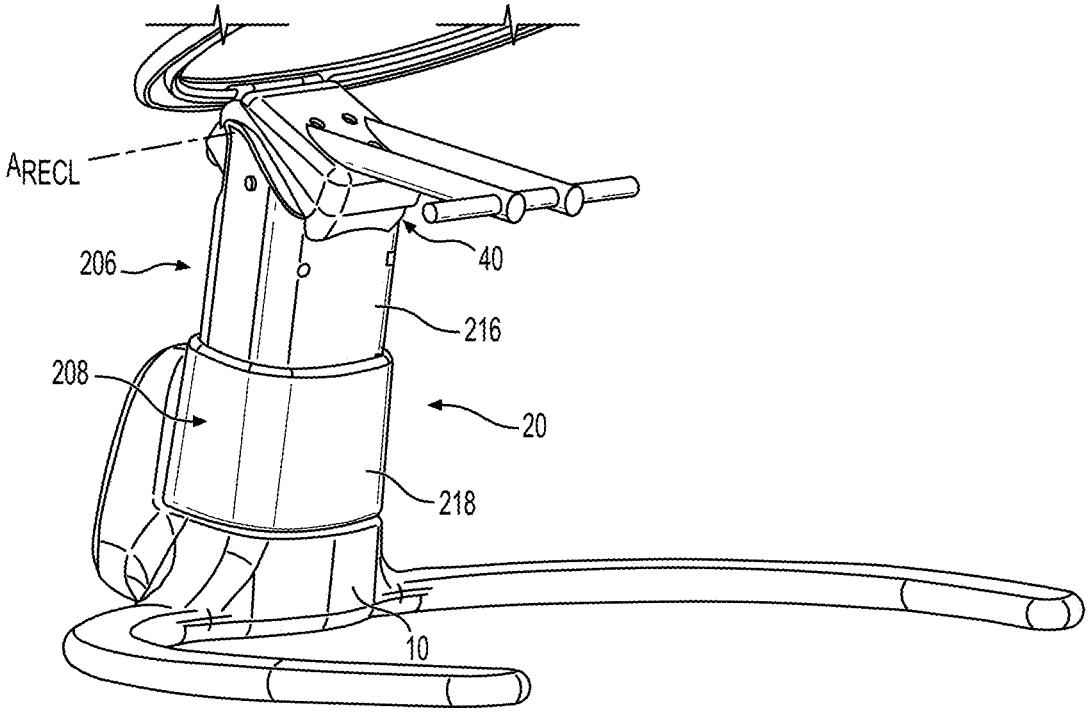
FIG. 8 shows a rear perspective view of a portion of the child swing of FIG. 1, with a seating surface of the seat removed.
Figure 9:
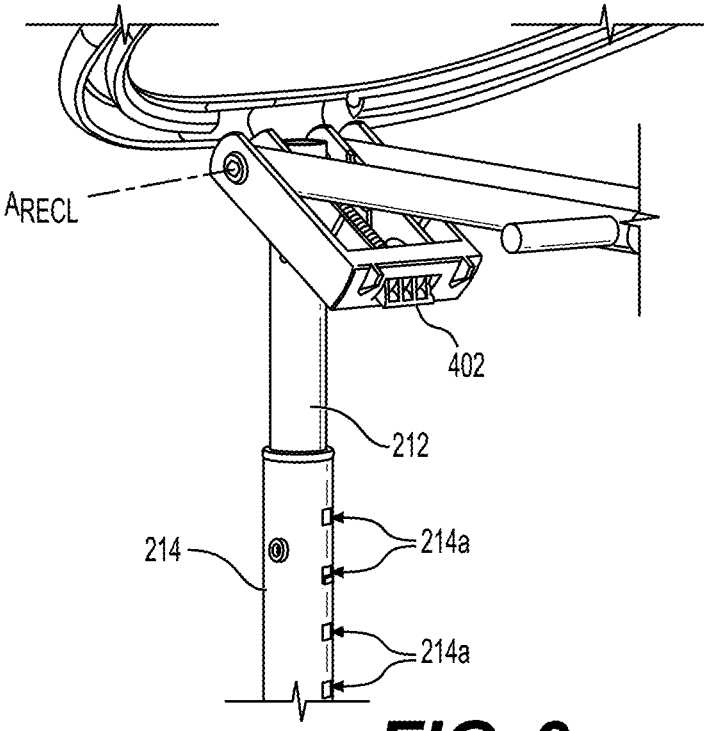
FIG. 9 shows a rear perspective view the extendable shaft of the child swing of FIG. 1, with the extendable shaft attached to the seat.
Figure 11:
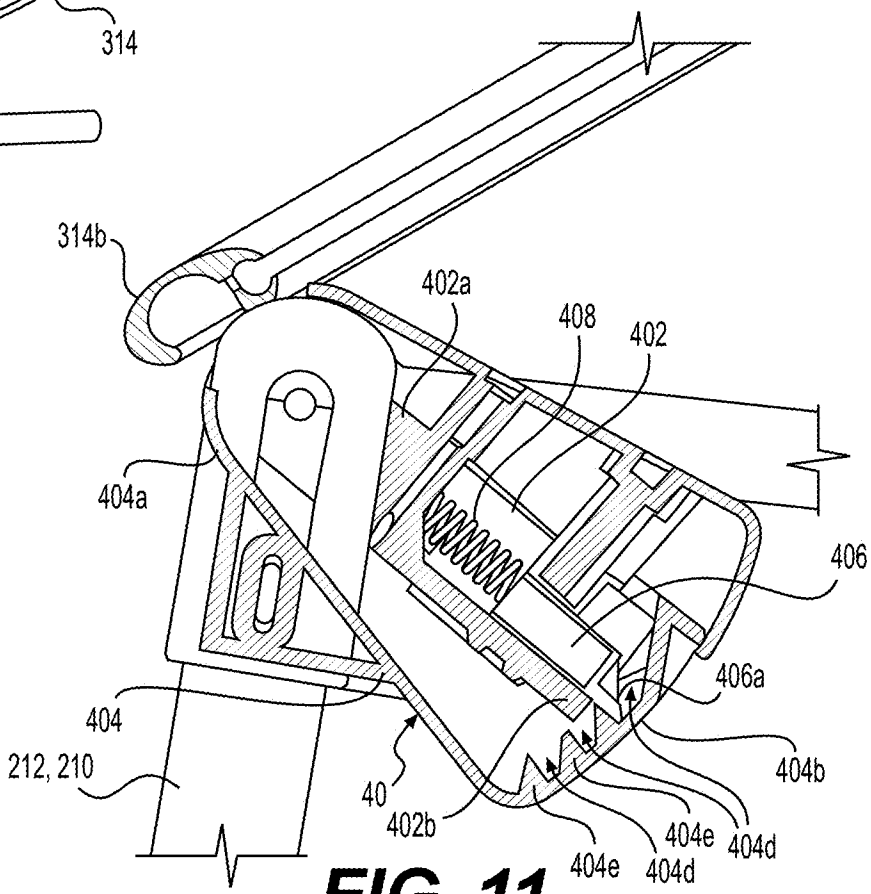
FIG. 11 shows a cross-sectional side view of the recline mechanism of FIG. 10.
Figure 10:
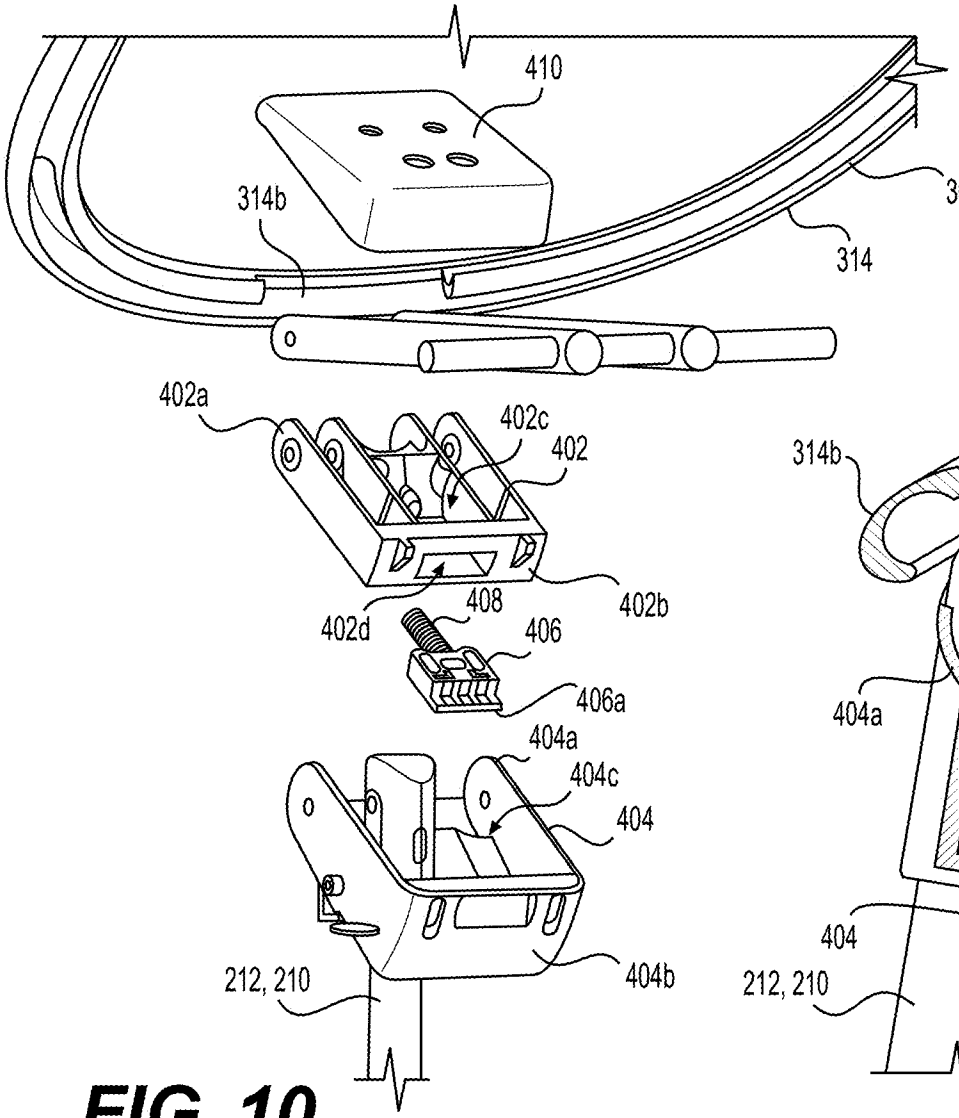
FIG. 10 shows an exploded perspective view of a recline mechanism of the child swing of FIG. 1.

Referring to FIGS. 6 to 8, the child swing 1 can be configured to selectively lock the column 20 in each of the plurality of height positions. In some examples, the child swing 1 can comprise a latch 220 that is configured to selectively lock the column 20 in each of the plurality of height positions, although in other examples, the child swing 1 can comprise a locking pin or other locking structure. The latch 220 is configured to transition between a locked position in which the latch 220 locks the column 20 in one of the plurality of height positions, and an unlocked position in which the column 20 is free to transition between the plurality of height positions. The latch 220 can be any suitable latch that can selectively lock the first column portion 206 relative to the second column portion 208 with respect to translation along the axis of rotation $A_R$. In some examples, the latch 220 can be configured to selectively lock the first shaft portion 212 and the second shaft portion 214 to one another. One of the first and second column portions 206 and 208, such as one of the first and second shaft portions 212 and 214 of the first and second column portions 206 and 208, can define a plurality of openings 214*a* (labeled in FIGS. 6 and 9) therein that are spaced from one another along the vertical direction V. Each opening 214*a* can correspond to a different one of the plurality of height positions. The latch 220 can be attached to the other of the first and second shaft portions 212 and 214, and the latch 220 can include a protrusion 222*a* that is configured to selectively extend into each of the openings 214*a* so as to lock the first and second shaft portions 212 and 214 to one another. In some examples, the latch 220 can be disposed inside of the other of the first and second shaft portions 212 and 214. However, it will be understood that, in alternative examples, the latch 220 could be outside of one or both of the first and second shaft portions 212 and 214.

In the specific example of FIGS. 6 to 8, the second shaft portion 214 comprises the plurality of openings 214*a*, and the latch 220 is disposed in the first shaft portion 212. The latch 220 comprises a first body 222 that has the protrusion 222*a*. The first body 222 is configured to translate the protrusion 222*a* into and out of the openings 214*a*. For example, the first body 222 can transition between the locked position, wherein the protrusion 222*a* extends into one of the openings 214*a*, and an unlocked position, wherein the protrusion 222*a* is removed from the openings 214*a*. In some examples, the first body 222 can rotate about a pivot axis P to transition between the locked and unlocked positions. In other examples, the first body 222 can translate along a direction that extends towards and away from the openings 214*a* (e.g., a direction that is perpendicular to the central axis of the shaft 210. The protrusion 222*a* can be disposed at a first end 222*b* of the first body 222. The first body 222 can be translationally fixed to the first shaft portion 212 such that the first body 222 translates with the first shaft portion 212 relative to the second shaft portion 214 along the central axis of the shaft 210.

The latch 220 can comprise a second body 224 that is configured to engage the first body 222 to cause the first body 222 to transition between the locked and unlocked positions. For instance, the second body 224 can be configured to translate in a first direction along the central axis of the shaft 210 relative to the first shaft portion 212 so as to cause the second body 222 to transition to the locked position, and in a second direction, opposite the first direction, to cause the second body to move to the unlocked position. One of the first body 222 and the second body 224 can comprise a ramped surface, and the other of the first body 222 and the second body 224 can define an engagement surface that rides along the ramped surface to cause the first body 222 to transition (e.g., translate and/or rotate) between the locked and unlocked positions. The ramped surface can be ramped relative to the central axis of the shaft 210. In some examples, one of the first body 222 and the second body 224 can comprise a pin 222*d* that defines the engagement surface, and the other of the first body 222 and the second body 224 can define a slot 224*a* that defines the ramped surface and receives the pin 222*d*. The pin 222*d* or slot 224*a* can be disposed adjacent a second end 222*c* of the first body 222. The pivot axis $A_P$ can be between the first and second ends 222*b* and 222*c*. The slot 224*a* can be angled relative to the central axis of the shaft 210 such that, when the second body 224 translates along the central axis of the shaft 210, the pin 222*e* rides within the slot 224*a* to drive the second end 222*b* of the first body 222 to translate along a direction that is angularly offset from (e.g., perpendicular to) the central axis of the shaft 210. This in turn causes the first end 222*b* of the first body 222 to pivot about the pivot axis $A_P$. The latch 220 can include a biasing member 230 such as a spring or resilient material that biases the translating body 224 towards the locked position.

The child swing 1 can comprise an actuator 226 that is configured to be engaged by a caregiver to selectively transition the latch 220 between the locked and unlocked positions. The actuator 226 can be, for example (without limitation), a handle, a pushbutton, a lever, a trigger, or a switch that is engaged by the caregiver. The child swing 1 can comprise a link 228, such as a cable, that extends from the actuator 226 to the latch 220 such that actuation of the actuator 226 by the caregiver causes the latch 220 to transition between the locked and unlocked positions, such as from the locked position to the unlocked position. The actuator 226 can be disposed on the column 20. For example, the actuator 226 can be disposed on the first column portion 206 such that the caregiver can move the first column portion 206 and the seat 30 relative to the second column portion 208, while engaging the actuator 226. Thus, in some examples, transitioning the seat 30 between the plurality of height positions can be a single-handed operation. In other examples, the actuator 226 can be disposed on another portion of the child swing 1, such as on the seat 30 or the base 10.

Referring back to FIGS. 4 and 5, the child swing 1 can comprise a shaft 232 (which can be referred to as a pivot shaft) that defines the axis of rotation $A_R$. The axis of rotation $A_R$ can define an angle with the floor. The angle can be 90 degrees. However, preferably, the angle is less than 90 degrees. For example, the angle can be within a range from 5 degrees to 30 degrees. Thus, the axis of rotation $A_R$ can extend rearward as it extends upward away from the floor. Angling the axis of rotation $A_R$ in such a manner can cause the seat 30 to sway in a manner that mimics a natural pendulum. The pivot shaft 232 can be separate from the extendable shaft 210 as shown. However, in alternative examples, the child swing 1 can include a single shaft that both (1) defines the axis of rotation $A_R$ in a manner similar to the pivot shaft 232 and (2) extends and retracts (e.g., telescopes) in a manner similar to the extendable shaft 210.

The pivot shaft 232 can be rotationally fixed to the base 10, and the seat 30 can be configured to rotate about the axis of rotation $A_R$ of the pivot shaft 232. For example, the child swing 1 can comprise a spindle 236 that comprises the pivot shaft 232. The pivot shaft 232 can be a stator and the spindle 236 can comprise a rotor 234. The rotor 234 can be configured to rotate about the pivot shaft 232. The seat 30 can be coupled, directly or indirectly, to the rotor 234 such that rotation of the rotor 234 about the axis of rotation $A_R$ causes the seat 30 to correspondingly rotate. In the example shown, the rotor 234 is coupled to the extendable shaft 210 such that rotation of the rotor 234 causes a corresponding rotation of the extendable shaft 210, and consequently, the seat 30 attached to the extendable shaft 210. The spindle 236 can comprise at least one coupler 236*a*, such as a pair of couplers 236*a*, that couple the spindle 236 to the extendable shaft 210. The spindle 236 can comprise at least one bearing 238, such as (without limitation) a ball bearing or roller bearing, between the shaft 232 and the rotor 234. For example, the spindle 236 can comprise a pair of bearings 238 that are spaced from one another along the axis of rotation $A_R$. Each bearing 238 can be configured to reduce friction between the pivot shaft 232 and the rotor 234. It will be understood that, in other examples (not shown), the pivot shaft 232 could alternatively be configured as a rotor that rotates relative to the base 10, and the seat 30 could be coupled, directly or indirectly, to the shaft 232 such that rotation of the shaft 232 causes a corresponding rotation of the seat 30.

Seat Recline Mechanism

When tending to a child or soothing a child in the swing, it may be desirable to orient the child at different angles. For instance, it may be desirable to raise a child to be in a more seated position in some instances and to recline the child to be in a more reclined position in other instances. Therefore, it would be beneficial for a child swing to provide the ability to raise or lower the seat between different recline positions.

Figure 12A:
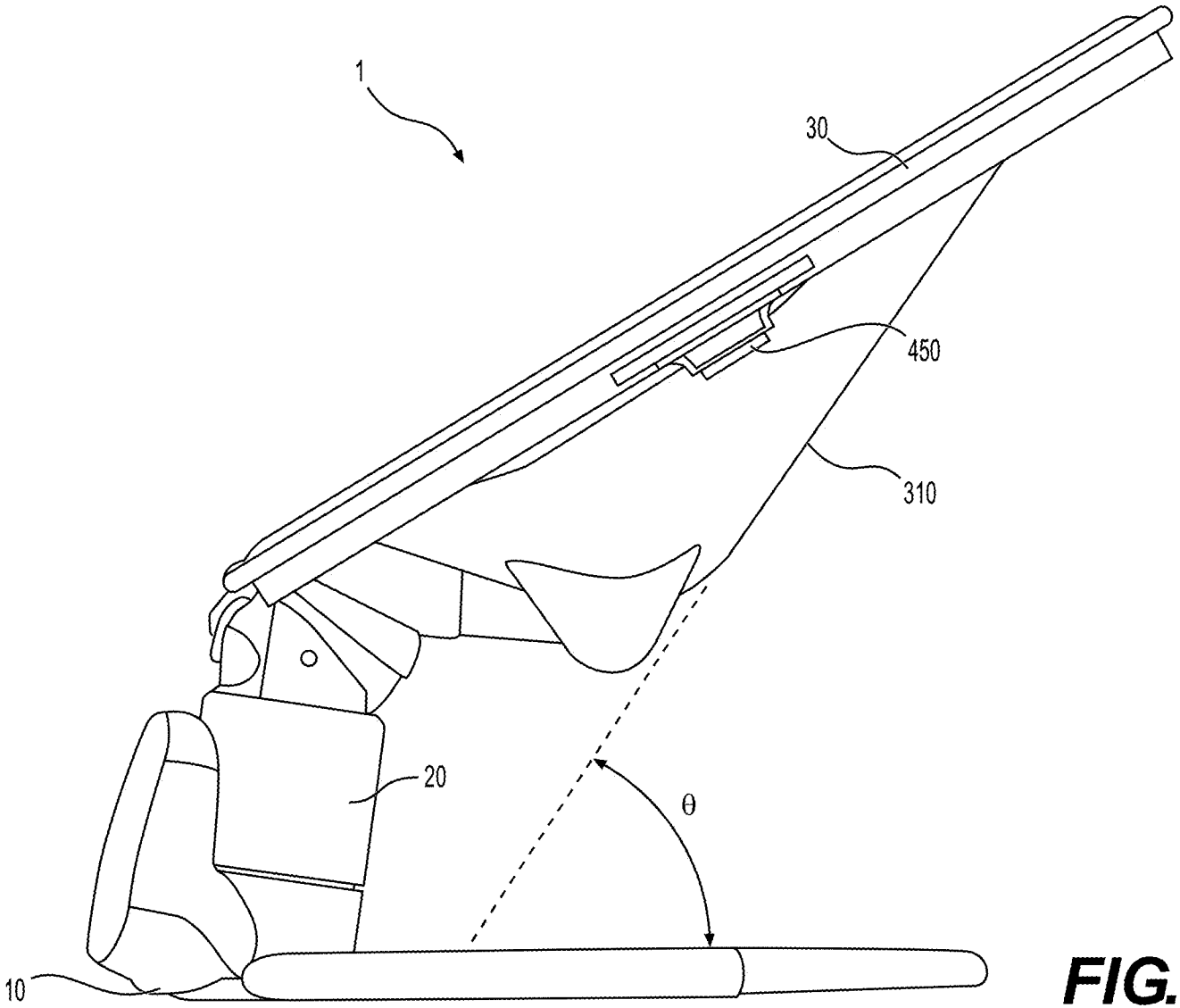
FIG. 12A shows a side view of the child swing of FIG. 1, with the seat in an upright-most recline position.
Figure 12B:
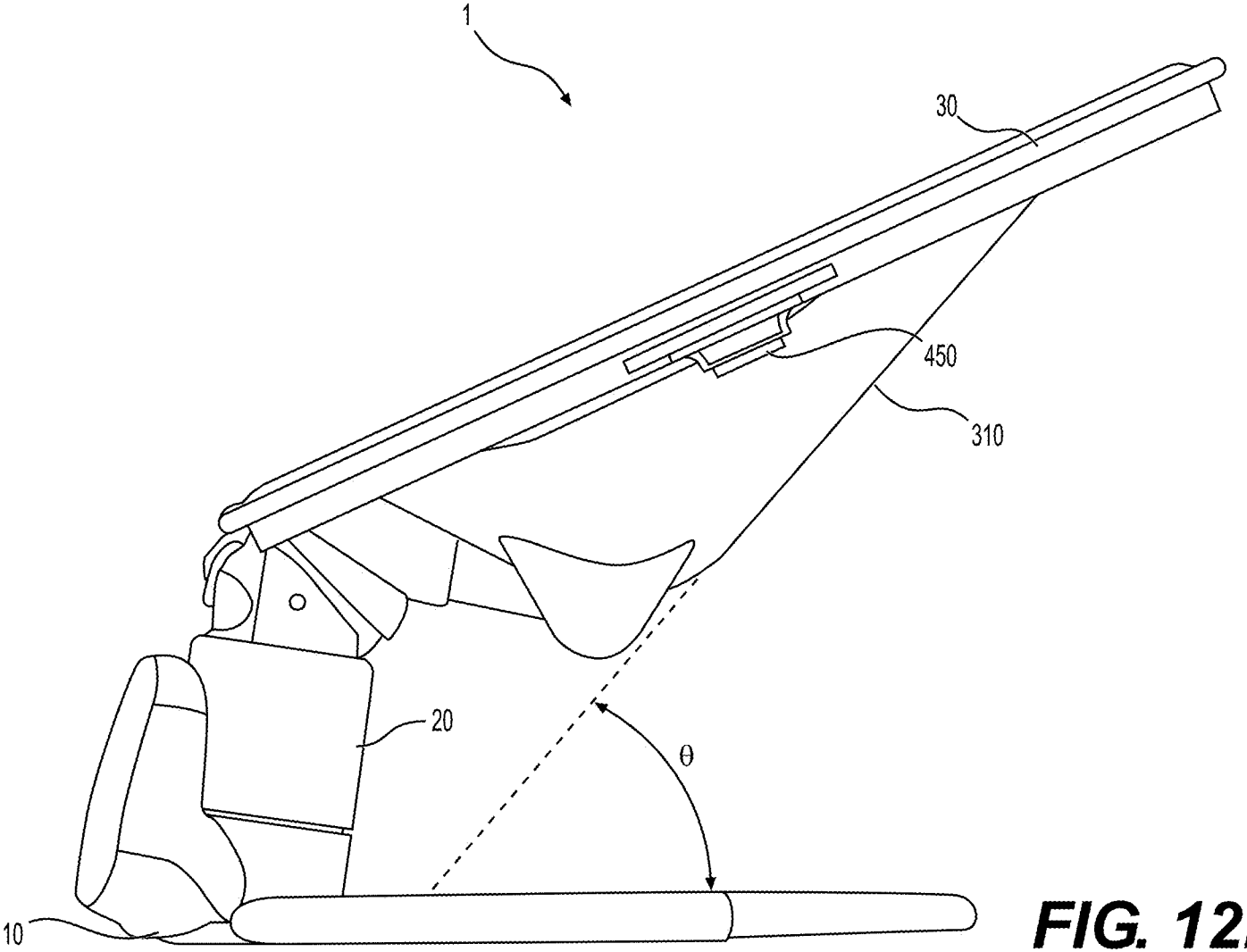
FIG. 12B shows a side view of the child swing of FIG. 1, with the seat in an intermediate recline position.
Figure 12C:
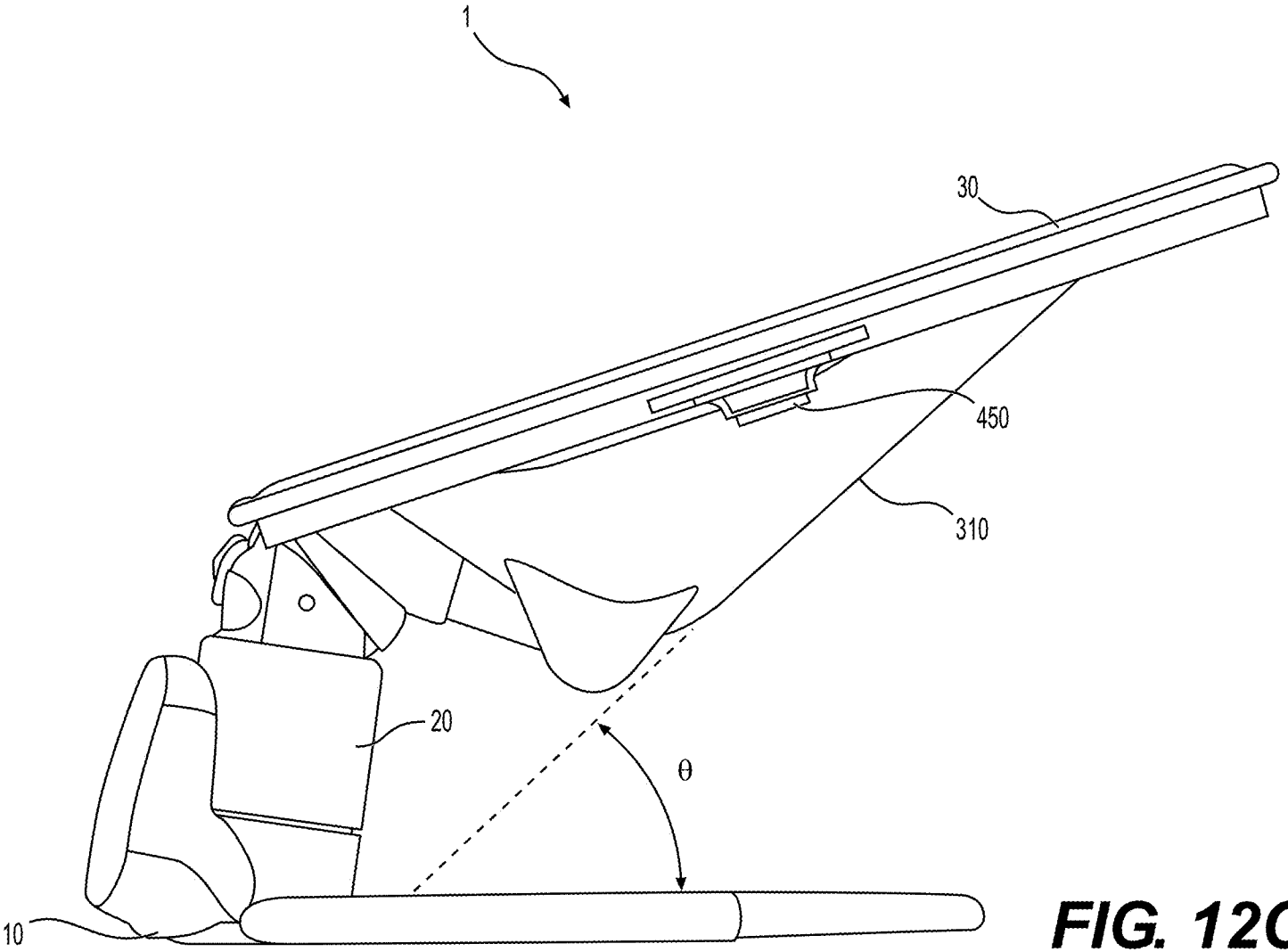
FIG. 12C shows a side view of the child swing of FIG. 1, with the seat in a reclined-most recline position.

Referring briefly to FIGS. 12A to 12C, the seat 30 of the child swing 1 can be cantilevered from the column 20. For instance, the seat 30 can be attached to the column 20 at only the front end of the seat 30, such as at the lower, front end 314*b* of the seat rim 314. It will be understood, however, that in alternative examples, the seat 30 could be attached to another portion of the seat 30, such as a middle portion or rear portion of the seat 30. The child swing 1 can be configured to selectively transition the seat 30 between a plurality of recline positions relative to the floor. The plurality of recline positions can include an upright-most recline position (FIG. 12A) and a reclined-most recline position (FIG. 12C). In some examples, the plurality of recline positions can include one or more intermediate recline positions (FIG. 12B) between the upright-most recline position and the reclined-most recline position. In each recline position, the seatback 310 is disposed at a different angle θ relative to the floor.

Turning now to FIGS. 8 to 11, the child swing 1 can include a recline mechanism 40 that couples the seat 30 to the column 20. The recline mechanism 40 is configured to selectively transition the seat 30 between the plurality of recline positions. The recline mechanism 40 can comprise a first seat mount 402 and a second seat mount 404 that are pivotably connected to one another about a recline pivot axis $A_{Recl}$. The recline pivot axis $A_{Recl}$ can extend along a direction that extends from the first side of the seat 30 to the second side of the seat 30. The first and second sides of the seat 30 can be spaced from one another along a second direction that is perpendicular to the first direction. The first seat mount 402 can be positionally fixed to the seat 30 such that movement (e.g., translation or rotation along any direction) of the seat 30 causes a corresponding movement of the first seat mount 402. The first seat mount 402 can have a first end 402*a* that is attached to the seat 30, such as to the lower, front end 314*b* of the seat rim 314, such that the first end 402*a* rotates with the seat 30 about the axis of rotation $A_R$ relative to the base 10 and translates with the seat 30 relative to the base 10. The first seat mount 402 can have a second end 402*b* opposite the first end 402*a*. In some examples, the second end 402*b* can be a free end that is not attached to the seat 30. For example, the second end 402*b* can be cantilevered from the seat 30. The first seat mount 402 can be configured to pivot about the recline pivot axis $A_{Recl}$. The first seat mount 402 can define a void 402*c* therein between the first end 402*a* and the second end 402*b*.

The recline mechanism 40 can comprise a latch 406 that is configured to selectively lock the seat 30 in each of the plurality of recline positions. The latch 406 can be configured to move between a latched position and an unlatched position to selectively lock the first and second seat mounts 402 and 404 relative to one another so as to prevent rotation of the first and second seat mounts 402 and 404 from pivoting relative to one another about the recline pivot axis $A_{Recl}$. The latch 406 can be any suitable latch that can selectively lock the first and second seat mounts 402 and 404 relative to one another. In one example, the latch 406 can be received within the void 402*c*. In the latched position, a protrusion 406*a* of the latch 406 extends out from an opening 402*d* defined in the second end 402*b* of the first seat mount 402. In the unlatched position, the protrusion 406*a* is retracted at least partially into the first seat mount 402. The recline mechanism 40 can comprise a biasing member 408, such as a spring or resilient material, that biases latch 406 towards the latched position. The void 402*c* can be configured such that, when the latch 406 is received therein, the latch 406 translates between the first and second ends 402*a* and 402*b* between the unlatched and latched positions.

The second seat mount 404 comprises a first end 404*a* and a second end 404*b* that are spaced from one another. The second seat mount 404 is positionally fixed to the first column portion 206, such as to the first shaft portion 212, such that movement (e.g., translation or rotation along any direction) of the first column portion 206 causes a corresponding movement of the second seat mount 404. For example, the second seat mount 404 can be attached to the first column portion 206 such that the second seat mount 404 rotates with the first column portion 206 about the axis of rotation $A_R$ relative to the base 10, and translates with the first column portion 206 relative to the base 10 along an axis of the first column portion 206. The second seat mount 404 can also be attached to the first column portion 206 such that the seat mount 404 does not rotate relative to the first column portion 206 about the recline pivot axis $A_{Recl}$. The second end 404*b* can be a free end that is not attached to the first column portion 206. For example, the second end 404*b* can be cantilevered from the first column portion 206. The second seat mount 404 can define a cavity 404*c* therein between the first and second ends 404*a* and 404*b*. The cavity 404*c* can be configured to receive the first seat mount 402 therein. The first seat mount 402 can be rotatable within the cavity 404*c* relative to the second seat mount 404 about the recline pivot axis $A_{Recl}$. In some examples, the recline mechanism 40 can comprise a cover 410 that covers an open upper end of the cavity 404*c*.

An inner surface of the second end 404*b* of the second seat mount 404 can define a plurality of recesses 404*d* therein. The recesses 404*d* can be offset from one another along a direction that extends from a bottom end of the second seat mount 404 to a top end of the seat mount 404. Each recess 404*d* can correspond to a different one of the recline positions. The protrusion 406*a* of the latch 406 can be configured to be selectively received in each of the recesses 404*d* so as to selectively lock the seat 30 in each of the recline positions. The inner surface of the second end 404*b* can define a plurality of teeth 404*e* that extend into the cavity 404*c*. Individual ones of the teeth 404*e* can be defined between a respective pair of recesses 404*d*. Each of the teeth 404*e* can have a lower surface that is ramped, and the protrusion 406*a* of the latch 406 can have an upper surface that is ramped. The child swing 1 can be configured such that, when a user pulls upwards on the seat 30, the ramped surface of the protrusion 406*a* rides along the ramped surface of a respective one of the teeth 404*e* so as to cause the latch 406 to move to the unlatched position. As the seat is moved further upwards, the latch 406 aligns with a corresponding one of the recesses 404*d*, and the biasing member 408 causes the latch 406 to move to the latched position such that the protrusion 406*e* moves into the recess 404*d*. When the latch 406 is in the latched position, the seat 30 is prevented from rotating downwards about the recline pivot axis $A_{Recl}$.

Figure 13:
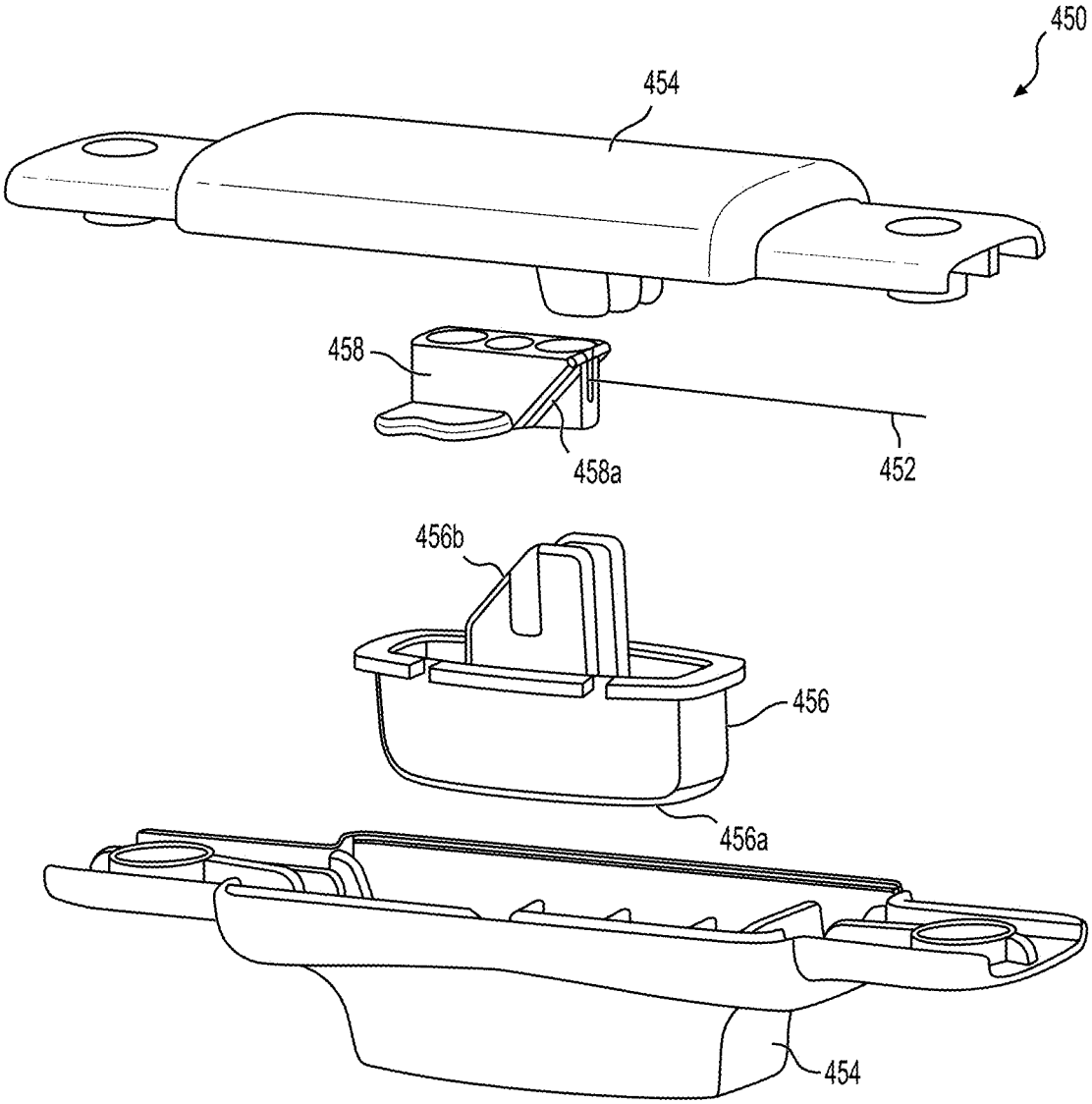
FIG. 13 shows an exploded perspective view of a recline actuator of the child swing of FIG. 1.
Figure 14:
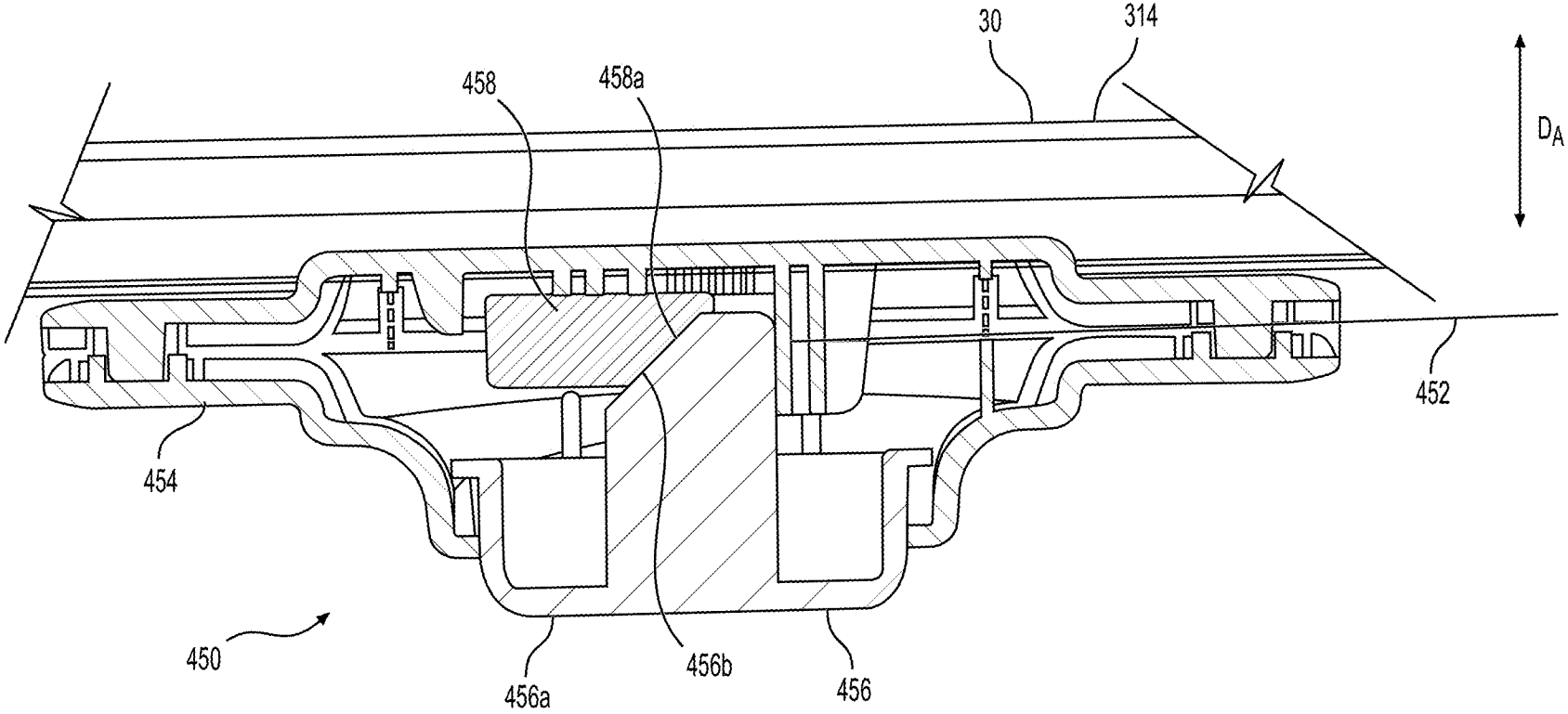
FIG. 14 shows a cross-sectional side view of the recline actuator of FIG. 13.

Turning to FIGS. 13 and 14, the child swing 1 can comprise a recline actuator 450 that is configured to be engaged by a caregiver to selectively transition the latch 406 between the latched and unlatched positions. The actuator 450 can be, for example (without limitation), a handle, a pushbutton, a lever, a trigger, or a switch that is engaged by the caregiver. The child swing 1 can comprise a link 452, such as a cable, that extends from the actuator 450 to the latch 406 such that actuation of the actuator 450 by the caregiver causes the latch 406 to transition between the latched and unlatched positions, such as from the latched position to the unlatched position. The actuator 450 can be disposed on the seat 30, such as on the seat rim 314. In other examples, the actuator 450 can be disposed on another portion of the child swing 1, such as on the column 20 or the base 10.

FIGS. 13 and 14 show one example of the actuator 450, although it will be understood that the actuator 450 can be implemented in any suitable alternative manner. The actuator 450 comprises a housing 454, a pushbutton 456, and a ramped body 458. The pushbutton 456 and ramped body 458 convert translational movement along an actuation direction $D_A$ into translation of the link 452 along a direction that is angularly offset from (e.g., perpendicular to) the actuation direction $D_A$. The pushbutton 456 has an engagement portion 456*a* that is retractably received in an opening 454*a* of the housing 454. The engagement portion 456*a* is configured to be engaged by a caregiver to depress the pushbutton 456 along an actuation direction $D_A$ into the housing 454, thereby actuating the actuator 450. The pushbutton 456 has a ramped surface 456*b*, offset from the engagement portion 456*a* along the actuation direction $D_A$. The ramped surface 456*b* can be angularly offset from the actuation direction $D_A$.

The ramped body 458 has a ramped surface 458*a* that engages the ramped surface 456*b* of the pushbutton 456 such that, when the pushbutton 456 is depressed along the actuation direction $D_A$, the ramped surface 456*b* of the pushbutton 456 rides along the ramped surface 458*a* of the ramped body 458 to cause the ramped body to translate along the direction that is angularly offset from the actuation direction $D_A$. This in turn, translates the link 452, thereby causing the latch 406 to translate between the latched and unlatched positions.

Drive Mechanism

In some examples, the child swing 1 can comprise a drive 50 that is configured to cause the seat 30 to move relative to the base 10. In other examples, the child swing 1 can be devoid of the drive 50 and the seat 30 can be configured to move relative to the base 10 by application of an external force by a caregiver on the seat 30 and optionally by a natural pendulum motion that results from the angled axis of rotation $A_R$ as discussed above. The drive 50 can be any suitable drive, including a mechanical drive (e.g., a wind-up and/or spring-activated drive), an electrical drive (e.g., a drive including a motor), a magnetic drive, or any combinations thereof. In some examples, as shown in FIGS. 4, 5, 15 to 19D, and 29A to 30D, the child swing 1 can comprise a magnetic drive 50.

The magnetic drive 50 can be configured to drive at least a portion of the column 20 to rotate so as to rotate the seat 30. The column 20 can be an extendable column as discussed above, or in alternative examples, the child swing can have a column that has a fixed length (is not extendable). The magnetic drive 50 comprises at least one magnet 502, and at least one other magnet 504. It will be understood that, in some examples, each of the at least one magnet 502 and/or the at least one other magnet 504 can comprise more than one magnet.

One of the magnet 502 or the at least one other magnet 504 can be positionally fixed relative to the base 10. The other of the magnet 502 and the at least one other magnet 504 can be coupled to at least a portion of the column 20 such that the at least one magnet 502 or the at least one other magnet 504 rotates about the axis of rotation $A_R$. Rotation of the one of the at least one magnet 502 or the at least one other magnet 504 relative to the base 10 can cause rotation of the at least a portion of the column 20 relative to the base 10. The magnet 502 and the at least one other magnet 504 can apply magnetic forces to one another so as to drive the column 20 to rotate about the axis of rotation $A_R$ relative to the base 10, thereby causing the seat 30 to rotate.

The at least one other magnet 504 comprises a north pole (N) and a south pole (S) that are spaced from one another along a direction of rotation of the column 20. In some examples, the north and south pole can be spaced from one another along a curve, such as an arc of a circle. The arc can be centered at the axis of rotation $A_R$ or other suitable location. The north and south poles are positioned relative to the at least one magnet 502 so as to alternatingly apply magnetic forces to the at least one magnet 502 as the at least one magnet 502 or at least one other magnet 504 rotates relative to the other.

In some examples, as shown in FIGS. 17A to 17D, the at least one magnet 502 can be positionally fixed relative to the base 10, and the at least one other magnet 504 can be positionally fixed to the column 20 such that the at least one other magnet 504 is rotatable relative to the base 10. The at least one magnet 502 can comprise an electromagnet that is configured to switch polarities. The at least one other magnet 504 can comprise first and second magnets. The first magnet can comprise a first end 504(1) that defines the north pole (N), and the second magnet can comprise a second end 504(2) that defines the south pole (S). The at least one magnet 502 is configured to apply a magnetic force to the north and south poles of the first and second ends 504(1) and 504(2) so as to cause the first and second ends 504(1) and 504(2), and consequently at least a portion of the column 20, to rotate. Each of the at least one other magnet 504 can be an electromagnet or can be a permanent magnet.

In other examples, the positions of the magnets 502 and 504 can be switched. For instance, as shown in FIGS. 19A to 19D, the at least one other magnet 504 can be positionally fixed to the base 10, and the at least one magnet 502 can be positionally fixed to the column 20 such that the at least one magnet 502 is rotatable relative to the base 10. The at least one magnet 502 can comprise an electromagnet that is configured to switch polarities. The at least one other magnet 504 can comprise a first end 504(1) that defines the north pole (N), and a second end 504(2) that defines the south pole (S). The at least one magnet 502 is configured to apply a magnetic force to the north and south poles of the first and second ends 504(1) and 504(2) so as to cause the at least one magnet 502, and consequently at least a portion of the column 20, to rotate. Each of the at least one other magnet 504 can be an electromagnet or can be a permanent magnet.

In yet other example, as shown in FIGS. 18A to 18D, the at least one other magnet 504 can be a single magnet that is bent (e.g., into a u-shape or c-shape), such that its first and second ends 504(1) and 504(2) defining the north and south poles, respectively, are oriented towards the at least one magnet 502. The at least one magnet 502 can be a fixed magnet that is positionally fixed relative to the base 10, and the at least one other magnet 504 can be a rotatable magnet that is configured to rotate relative to the base 10. The at least one other magnet 504 can be coupled to the column 20 so that rotation of the at least one other magnet 504 causes rotation of the column 20. Each of the north and south poles can be positioned to face the at least one magnet 502 when it is rotationally aligned with the at least one magnet 502. The single magnet 504 can be a permanent magnet or an electromagnet. In other examples (not shown), the positions of the magnets 502 and 504 can be switched. For instance, the single bent magnet 504 can be positionally fixed to the base 10, and the at least one magnet 502 can be positionally fixed to the column 20 such that the at least one magnet 502 is rotatable relative to the base 10.

Referring again to FIGS. 4, 5, 15 to 19D, and 29A to 30D, the magnetic drive 50 can comprise a hub 506 that couples one of the magnet 502 or the at least one other magnet 504 to the column 20 such that the one of the magnet 502 or the at least one other magnet 504 is configured to rotate about the axis of rotation $A_R$. For example, the hub 506 can couple one of the magnet 502 or the at least one other magnet 504 to the spindle 236, or directly to the pivot shaft in the event that the pivot shaft itself rotates. The hub 506 can comprise at least one magnet holder. For example, FIGS. 15 to 17D and 30A to 30D show specific examples in which the hub 506 comprises first and second magnet holders 506(1) and 506(2) that couple first and second ends 504(1) and 504(2), respectively, of the at least one other magnet 504 to the pivot shaft 232. FIGS. 18A to 19D and 29A to 29D shows specific examples in which the hub 506 comprises a single magnet holder 506(1). The hub 506 can couple to the shaft 210 to the pivot shaft 232 such that the shaft 210 is configured to rotate about the axis of rotation $A_R$. In examples comprising the first and second magnet holders 506(1), 506(2), north and south poles of the at least one magnet 502 or the at least one other magnet 504 can be disposed on opposing sides of the shaft 210 such that the shaft 210 is between the north and south poles.

The one of the magnet 502 or the at least one other magnet 504 is configured to rotate along a movement path $M_P$ (labeled in FIGS. 17A to 17D) such as an arc (herein referred to as a movement arc) about the axis of rotation $A_R$. The north and south poles of the at least one other magnet 504 can be spaced apart along the movement path $M_P$. The other of the magnet 502 or the at least one other magnet 504 is disposed along the movement path $M_P$ such that the at least one magnet 502 and the at least one other magnet 504 are configured to apply magnetic forces to one another as the one of the magnet 502 or the at least one other magnet 504 rotate along the movement path $M_P$. The magnetic drive 50 can be configured such that, when the seat 30 is in the neutral position ($\alpha$=0 degrees) and the electromagnet (or electromagnets) is activated, the north and south poles of the at least one other magnet 504 concurrently apply attractive and repulsive forces, respectively, to the at least one magnet 502. This can enable the seat 30 of the child swing 1 to begin motion upon activation of the at least one magnet 502, without a need for the caregiver to apply an external force to the child swing 1.

The drive 50 can have a compact configuration. For example, the at least one magnet 502 and the at least one other magnet 504 can be spaced from the axis of rotation $A_R$ by no more than 5.0 inches. In some examples, the magnets 502 and 504 can be spaced from the axis of rotation $A_R$ by no more than 4.5 inches, by no more than 4.0 inches, or by no more than 3.5 inches. In some examples, the magnets 502 and 504 can be spaced from the axis of rotation $A_R$ by about 3.0 inches. The north and south poles of the at least one other magnet 504 can be angularly offset from one another along the movement path $M_P$ by an angle $\beta$. In various examples, the angle $\beta$ can be no more than 70 degrees, no more than 60 degrees, or no more than 50 degrees. In various examples, the angle $\beta$ can greater than 20 degrees or greater than 30 degrees. In one example, the angle $\beta$ can be about 40 degrees. The angle $\beta$ can be defined between a first line that extends through the south pole of the at least one other magnet 504 and the axis of rotation $A_R$, and a second line that extends through the north pole of the at least one other magnet 504 and the axis of rotation $A_R$. The drive 50 can be configured to rotate at least a portion of the column 20 by a maximum swing angle $\alpha$ that is less than or equal to the angle $\beta$. In some examples, the drive 50 can be configured to rotate at least a portion of the column 20 by a maximum swing angle $\alpha$ that does not exceed the angle $\beta$. The drive 50 can be configured such that the magnet 502 does not swing beyond the north or south poles. Thus, the drive 50 can be configured to reverse rotation of the at least a portion of the column 20 when the magnet 502 is aligned with either the north pole or the south pole of the at least one other magnet 504. The drive 50 can be configured such that the magnet 502 and the at least one other magnet 504 apply a magnetic force to one another over a full range of motion of the child swing 1. The child swing 1 has a maximum swing angle that defines a first outermost seat position along a first rotational direction $R_1$ and a second outermost position along a second rotational direction $R_1$. The at least one magnet 502 is aligned with the first and second ends 504(1) and 504(2) when the seat 30 is rotated to the first and second outermost seat positions, respectively.

In some examples, the swing 1 can be configured to selectively operate at different rotational angles $\alpha$ (i.e., different speeds). For example, the swing 1 can be configured to operate at the maximum swing angle $\alpha$, and at one or more swing angles $\alpha$ that are less than the maximum swing angle $\alpha$. In one example, the maximum swing angle can be less than or equal to 90 degrees (±45 degrees from the neutral position), such as less than or equal 80 degrees (±40 degrees from the neutral position), such as less than or equal to 70 degrees (±35 degrees from the neutral position), such as less than or equal to 60 degrees (±30 degrees from the neutral position). The minimum swing angle $\alpha$ can be greater than or equal to 4 degrees (±2 degrees from the neutral position), such as greater than or equal to 6 degrees (±3 degrees from the neutral position), such as greater than or equal to 8 degrees (±4 degrees from the neutral position). The swing 1 can be optionally configured to swing at one or more swing angles $\alpha$ between the minimum and maximum swing angles $\alpha$.

Referring to the operation of the examples of FIGS. 17A to 19D, the polarity of the at least one magnet 502 can be switched between a north polarity in which the magnet 502 has a north pole that is oriented towards the movement path $M_P$ (or at least one other magnet 504), and a south polarity in which the magnet 502 has a south pole that is oriented towards the movement path $M_P$ (or at least one other magnet 504). When the magnet 502 is switched to the south polarity (FIGS. 17A, 18A, 19C), the south pole of the magnet 502 and the north pole of the at least one other magnet 504 are attracted to one another causing at least a portion of the column 20, and hence the seat 30, to rotate along a first rotational direction $R_1$. The rotation of the column 20 along the first rotational direction $R_1$ can stop when the magnet 502 is aligned with the north pole of the at least one other magnet 504.

Figure 17B:
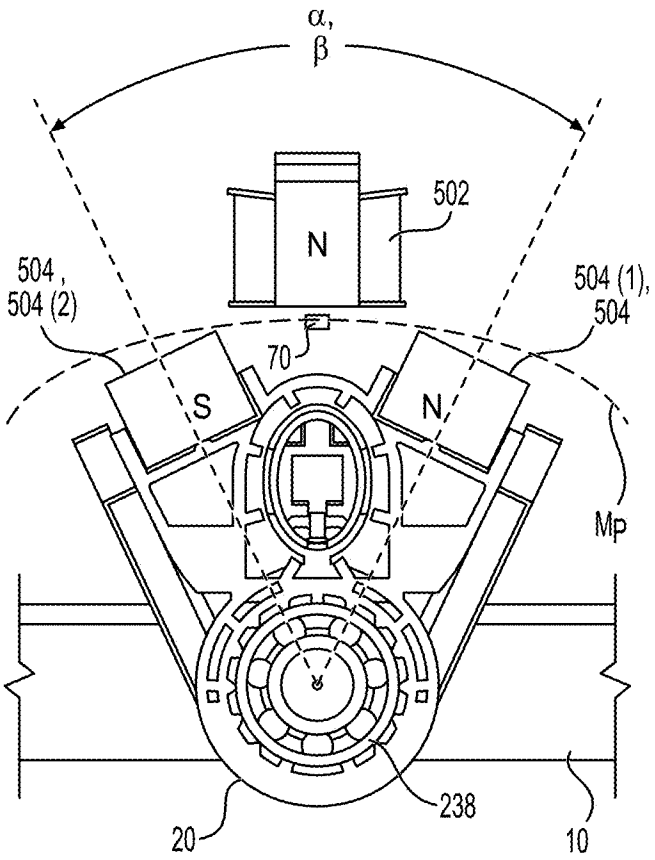
FIG. 17B shows the cross section of FIG. 17A with the hub being rotated to a neutral position.
Figure 17A:
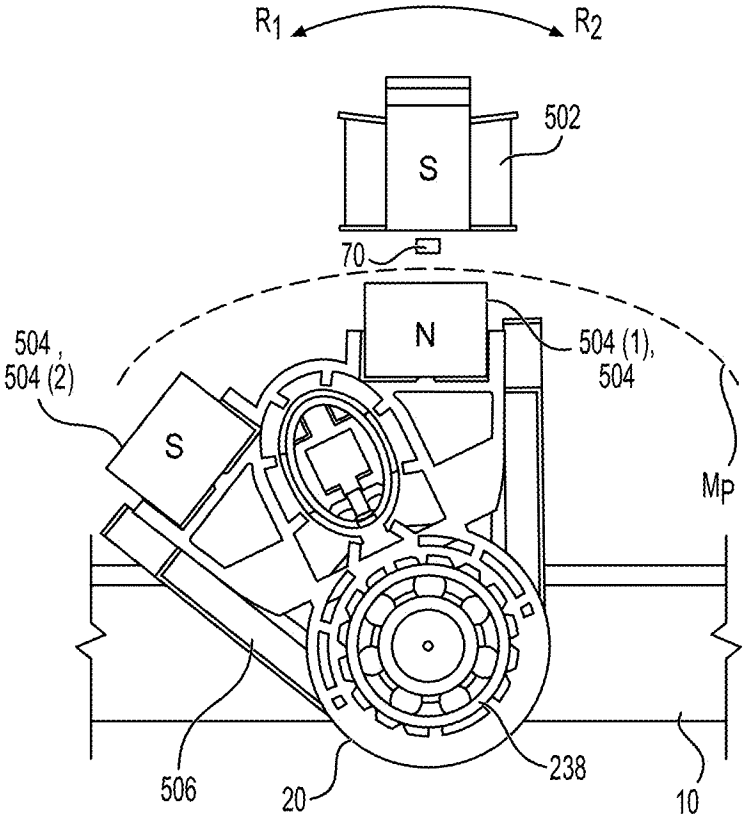
FIG. 17A shows a cross section of the child swing of FIG. 1 according to one example with an electromagnet, and a hub supporting first and second magnets that apply magnetic forces to the electromagnet to rotate the hub in a first rotational direction.
Figure 17D:
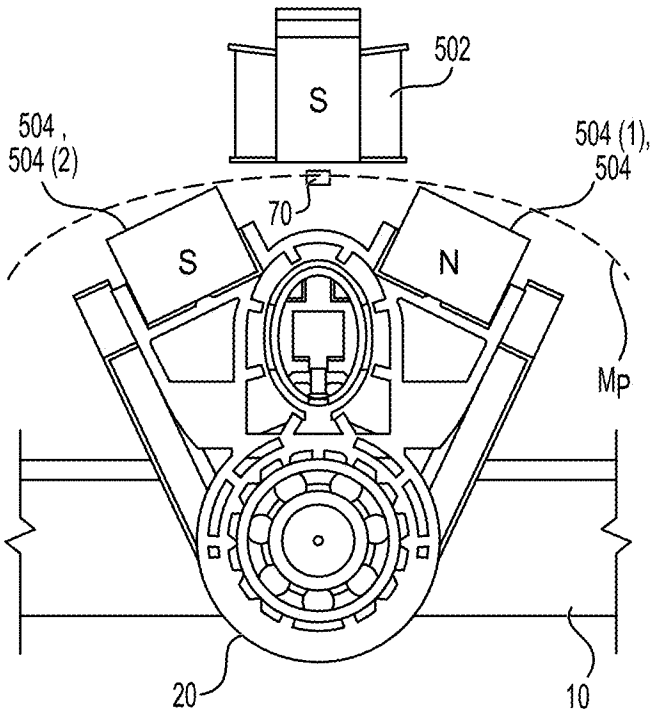
FIG. 17D shows the cross section of FIG. 17A with the hub being rotated to a neutral position and the polarity of the electromagnet being reversed from FIG. 17B.
Figure 17C:
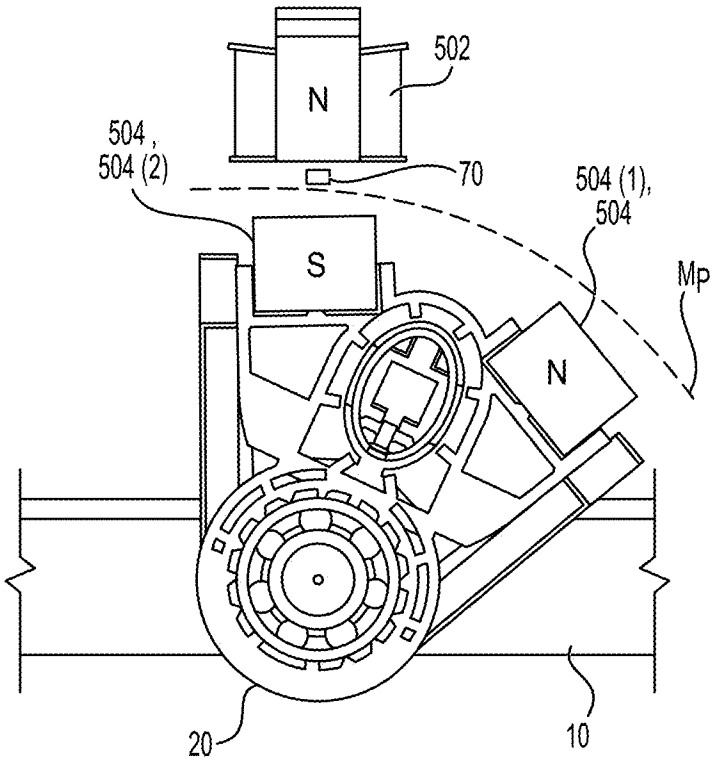
FIG. 17C shows the cross section of FIG. 17A with the hub being rotated in a second rotational direction, opposite the first rotational direction.
Figure 18B:
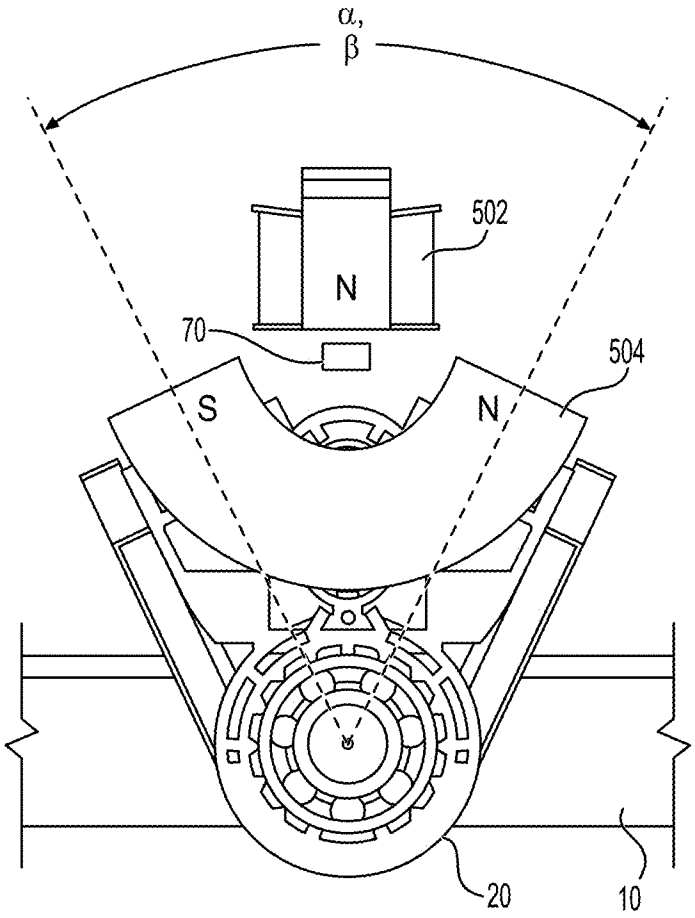
FIG. 18B shows the cross section of FIG. 18A with the hub being rotated to a neutral position.
Figure 18A:
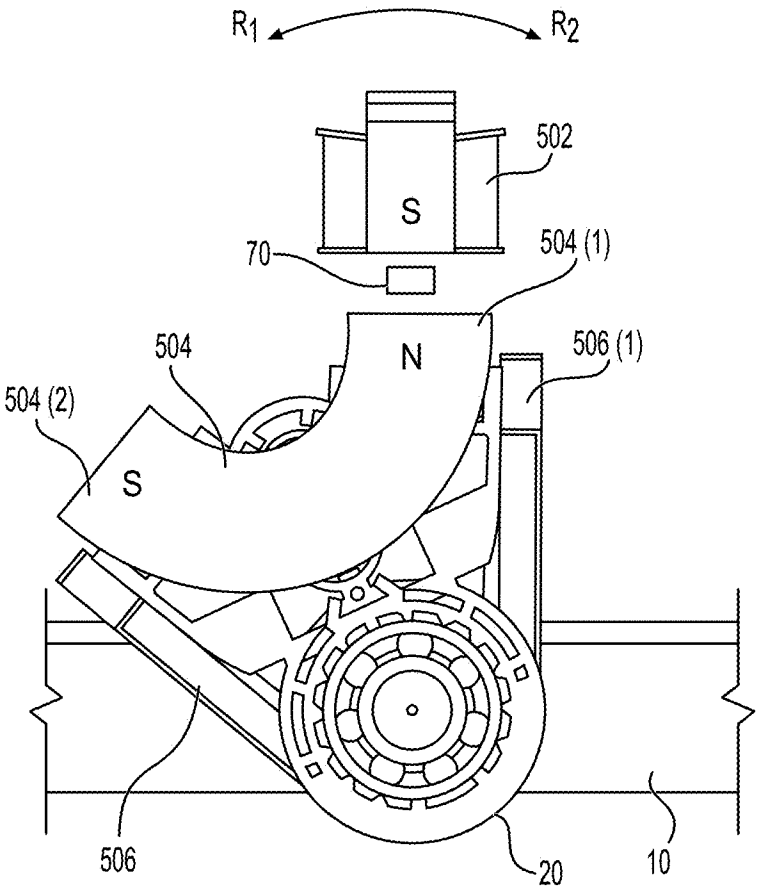
FIG. 18A shows a cross section of a child swing according to another example with an electromagnet, and a hub supporting a single magnet with north and south poles that apply magnetic forces to the electromagnet to rotate the hub in a first rotational direction.
Figure 18D:
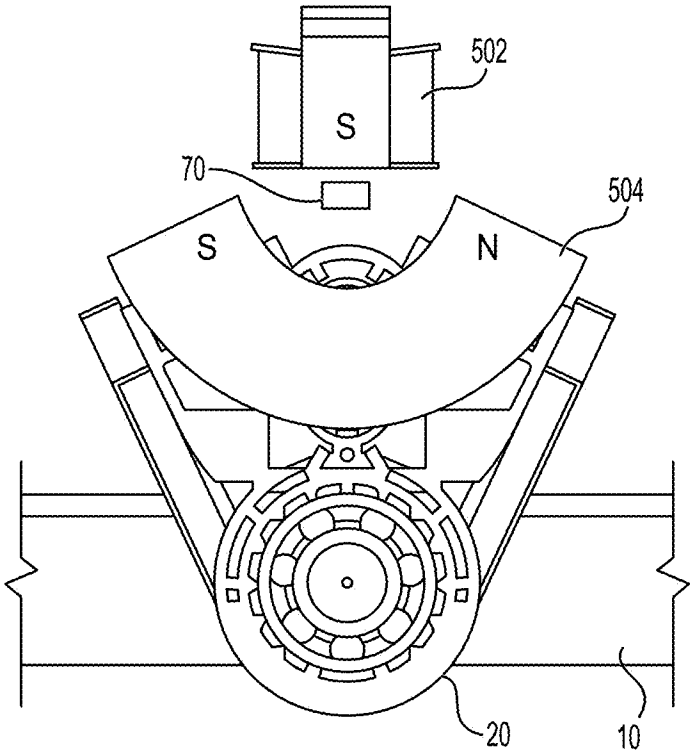
FIG. 18D shows the cross section of FIG. 18A with the hub being rotated to a neutral position and the polarity of the electromagnet being reversed from FIG. 18B.
Figure 18C:
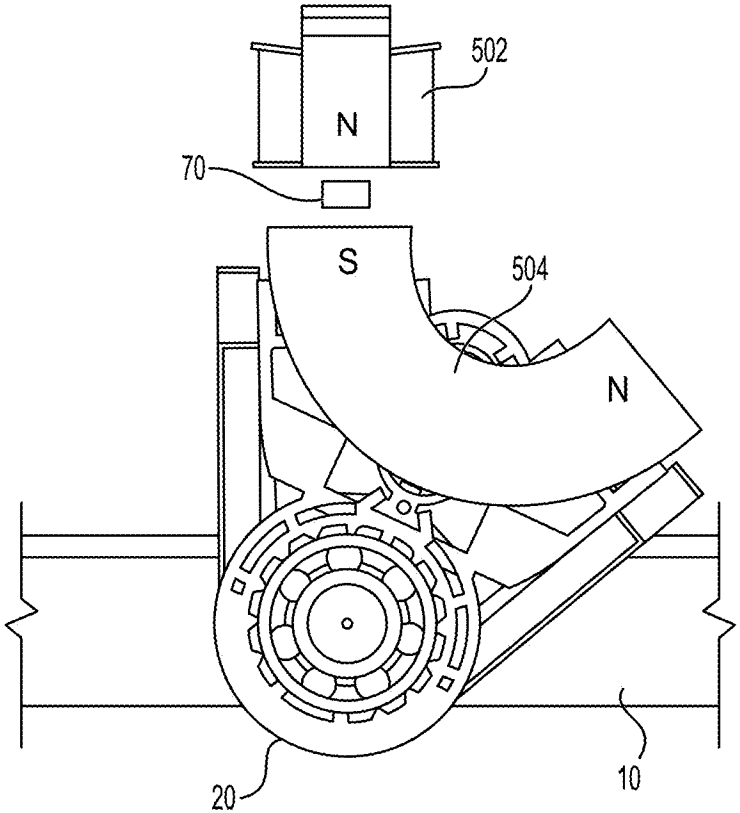
FIG. 18C shows the cross section of FIG. 18A with the hub being rotated in a second rotational direction, opposite the first rotational direction.
Figure 19B:
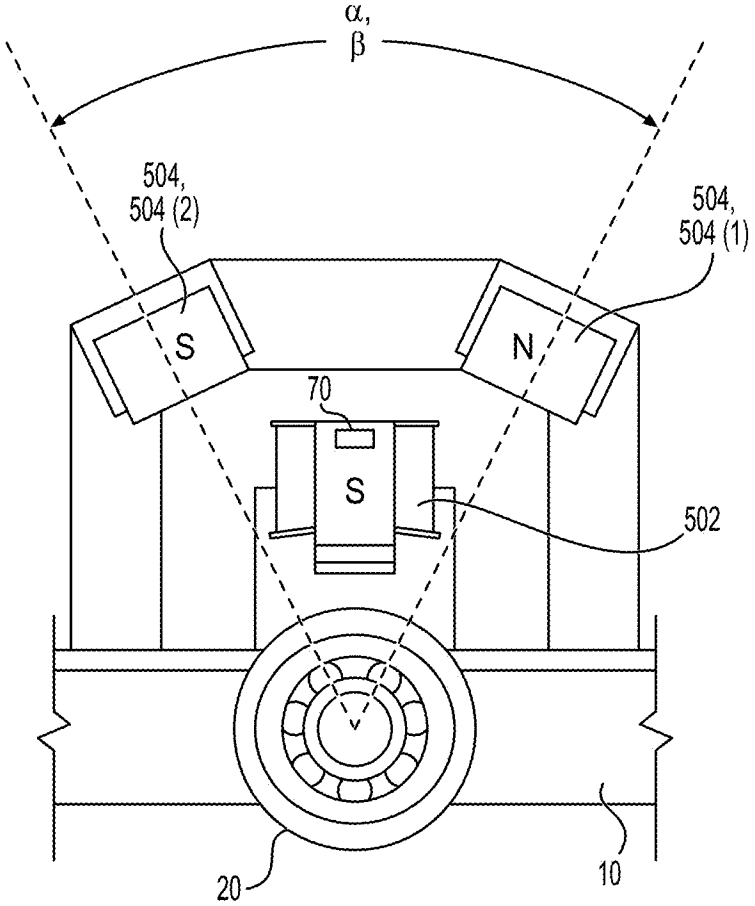
FIG. 19B shows the cross section of FIG. 19A with the hub being rotated to a neutral position.
Figure 19A:
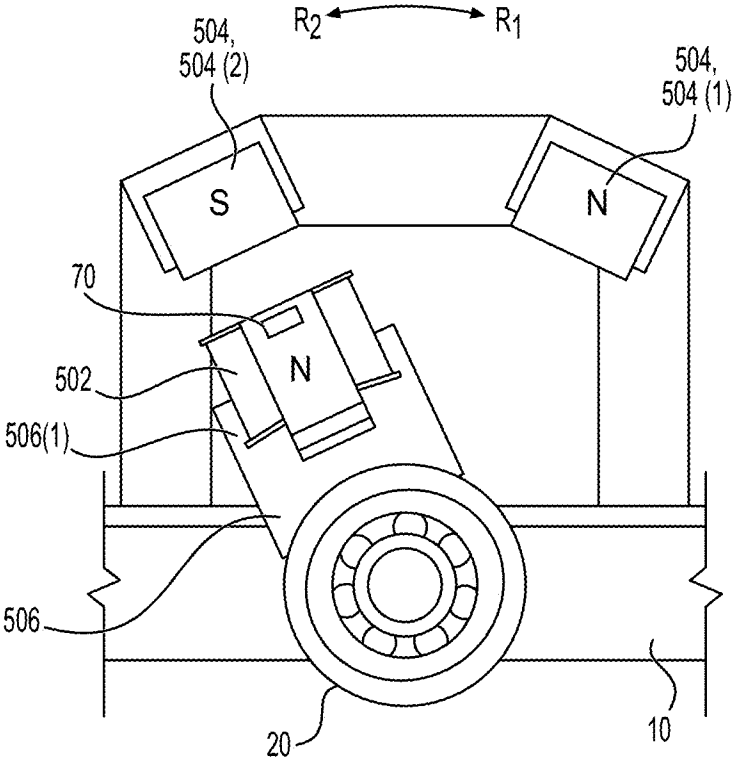
FIG. 19A shows a cross section of a child swing according to yet another example, with a hub supporting an electromagnet, and at least one other magnet having north and south poles that apply magnetic forces to the electromagnet to rotate the hub in a first rotational direction.
Figure 19D:
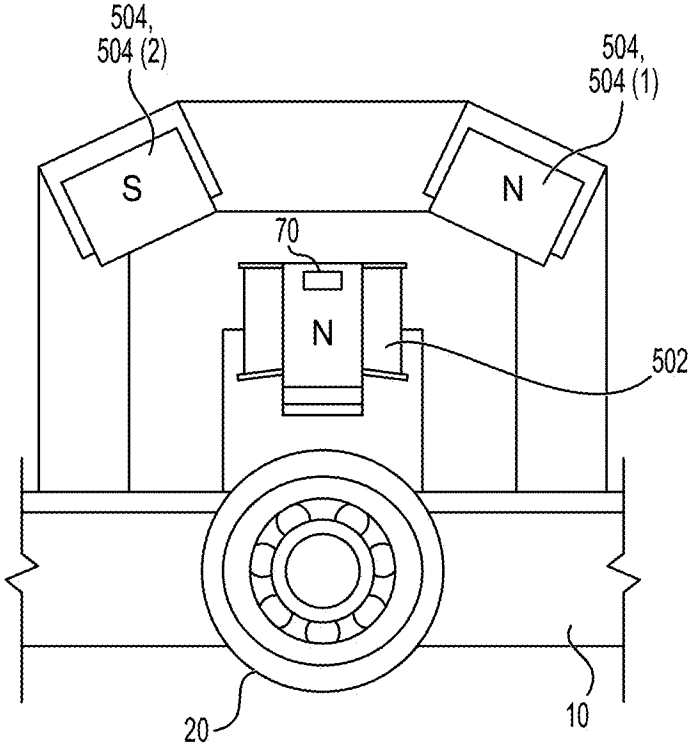
FIG. 19D shows the cross section of FIG. 19A the hub rotated to the neutral position and the polarity of the electromagnet being reversed from FIG. 19B.

The polarity of the magnet 502 can then be switched to a north polarity (FIGS. 17B, 18B, 19D) such that the north poles of the magnet 502 and the at least one other magnet 504 repel one another causing at least a portion of the column 20, and hence the seat 30, to rotate along a second rotational direction $R_2$, opposite the first rotational direction $R_1$. When the column 20, and hence the seat 30, is in the neutral position (FIGS. 17B, 18B, 19D), the magnet 502 is concurrently attracted to the south pole of the at least one other magnet 504 and repulsed from the north pole of the at least one other magnet 504. The attractive forces of between the north pole of the magnet 502 and the south pole of the at least one other magnet 504 causes at least a portion of the column 20, and hence the seat 30, to continue to rotate along the second rotational direction (FIG. 17C, 18C, 19A). The rotation of the column 20 along the second rotational direction $R_2$ can stop when the magnet 502 is aligned with the south pole of the at least one other magnet 504.

Figure 19C:
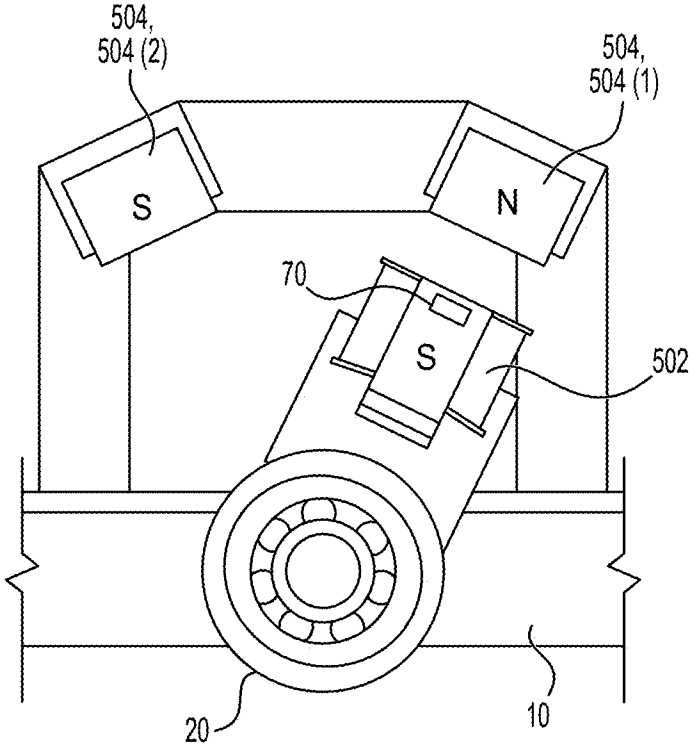
FIG. 19C shows the cross section of FIG. 19A with the hub being rotated in a second rotational direction, opposite the first rotational direction.

The polarity of the magnet 502 can then be switched to a south polarity (FIGS. 17D, 18D, 19B) such that the south poles of the magnet 502 and the at least one other magnet 504 repel one another causing at least a portion of the column 20, and hence the seat 30, to rotate along the first rotational direction $R_1$. When the column 20, and hence the seat 30, is in the neutral position (FIGS. 17D, 18D, 19B), the magnet 502 is concurrently attracted to the south pole of the at least one other magnet 504 and repulsed from the north pole of the at least one other magnet 504. The attractive forces of between the south pole of the magnet 502 and the north pole of the at least one other magnet 504 causes at least a portion of the column 20, and hence the seat 30, to continue to rotate along the first rotational direction $R_1$ (FIG. 17A, 18A, 19C). The rotation of the column 20 along the first rotational direction $R_1$ can stop when the magnet 502 is aligned with the north pole of the at least one other magnet 504.

In some examples, the polarity of the at least one magnet 502 can be selectively switched to cause the seat to slow down and/or stop. For example, the at least one magnet 502 can be selected to maintain a north polarity when the at least one magnet 502 is aligned with the south pole of the at least one other magnet 504 so that the at least one magnet 502 is attracted to the south pole. Similarly, the at least one magnet 502 can be selected to maintain a south polarity when the at least one magnet 502 is aligned with the north pole of the at least one other magnet 504 so that the at least one magnet 502 is attracted to the north pole.

Turning now to FIGS. 29A to 30D, in other examples, the at least one magnet 502 can be a permanent magnet or magnet that does not switch polarities, and the at least one other magnet 504 can comprise at least one electromagnet having first and second ends 504(1) and 504(2) that are each configured to switch polarities between a north pole and a south pole. In some examples, the at least one electromagnet can comprise first and second electromagnets that define the first and second ends 504(1) and 504(2), respectively. In alternative examples (not shown), the at least one electromagnet could be a single electromagnet having first and second ends 504(1) and 504(2) that are each configured to switch polarities between a north pole and a south pole. As shown in FIGS. 29A to 29D, the at least one other magnet 504 can be positionally fixed to the base 10, and the at least one magnet 502 can be positionally fixed to the column 20 such that rotation of the at least one magnet 502 causes rotation of at least a portion of the column 20, and consequently, rotation of the seat 30. Alternatively, as shown in FIGS. 30A to 30D, the at least one magnet 502 can be positionally fixed to the base 10, and the at least one other magnet 504 can be positionally fixed to the column 20 such that rotation of the at least one other magnet 504 causes rotation of at least a portion of the column 20, and consequently, rotation of the seat 30.

Referring to the operation of the examples of FIGS. 29A to 30D, the at least one magnet 502 can have a polarity that is fixed. FIGS. 29A to 30D show the polarity of the at least one magnet 502 being fixed as a north pole that is oriented towards the at least one other magnet 504, but in alternative examples, the polarity could be fixed as a south pole that is oriented towards the at least one other magnet 504. The polarities of the first and second ends 504(1) and 504(2) of the at least one other magnet 504 can be switchable between a north polarity in which the north pole is oriented towards the movement path $M_P$ (or at least one magnet 502), and a south polarity in which the south pole is oriented towards the movement path $M_P$ (or at least one magnet 502). Further, the polarities of the ends 504(1) and 504(2) can be controlled to be opposite one another.

When the first and second ends 504(1) and 504(2) are switched to the north and south polarities (FIGS. 29A, 30A), respectively, the at least one magnet 502 is attracted to one of the first and second ends 504(1) and 504(2) causing at least a portion of the column 20, and hence the seat 30, to rotate along a first rotational direction $R_1$. The rotation of the column 20 along the first rotational direction $R_1$ can stop when the at least one magnet 502 is aligned with the one of the first and second ends 504(1) and 504(2) of the at least one other magnet 504.

Figure 29A:
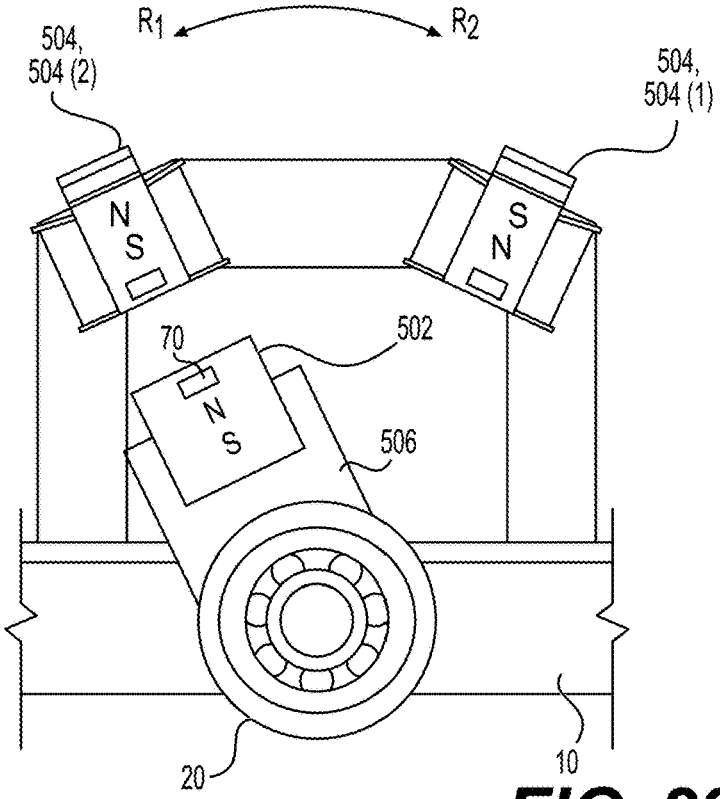
FIG. 29A shows a cross section of a child swing according to yet still another example, with a hub supporting a magnet having a fixed polarity, and first and second electromagnets that apply magnetic forces to the magnet to rotate the hub in a first rotational direction.
Figure 29B:
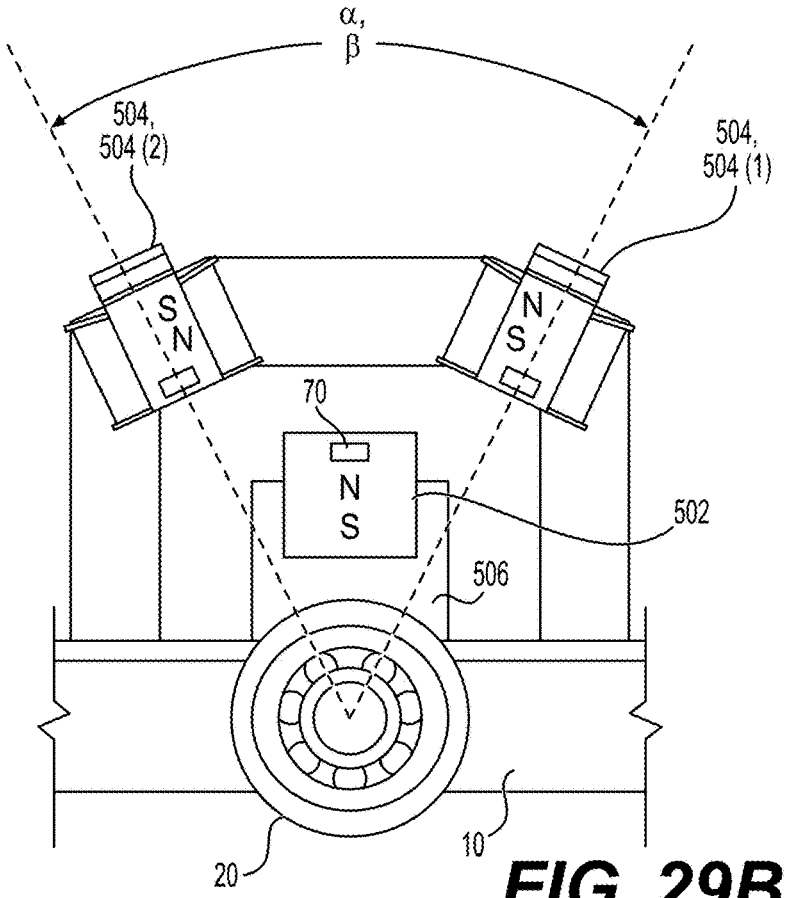
FIG. 29B shows the cross section of FIG. 29A with the hub being rotated to a neutral position and the polarities of the electromagnets being reversed from FIG. 29A.
Figure 29C:
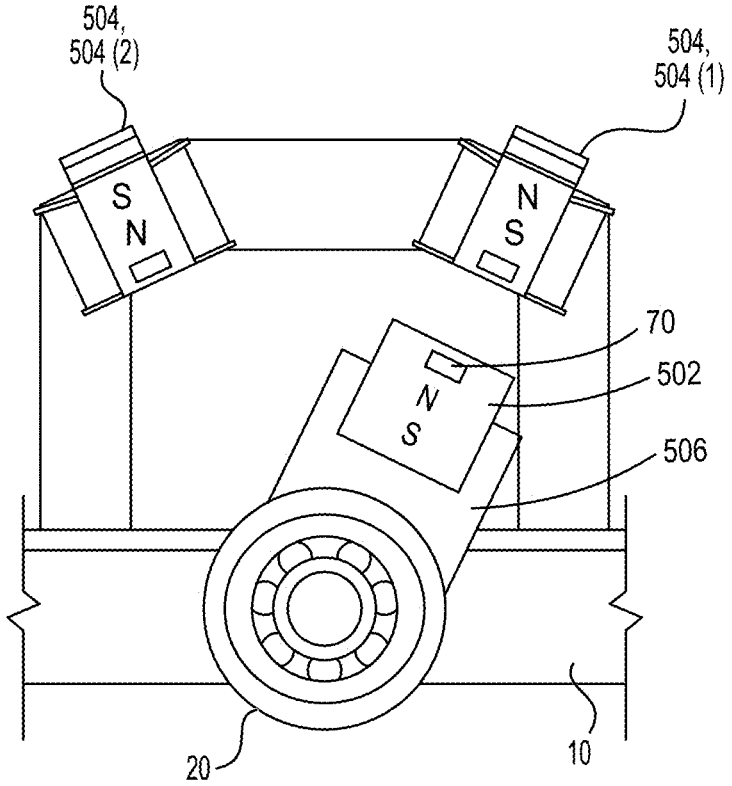
FIG. 29C shows the cross section of FIG. 29A with the hub being rotated in a second rotational direction, opposite the first rotational direction.
Figure 29D:
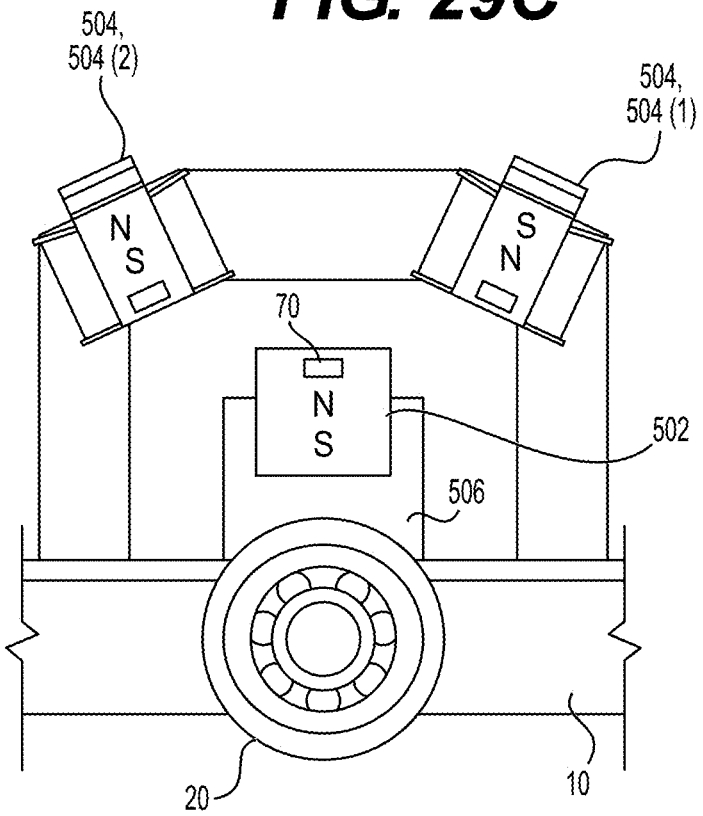
FIG. 29D shows the cross section of FIG. 29A the hub rotated to the neutral position and the polarity of the electromagnet being reversed from FIG. 29B.
Figure 30B:
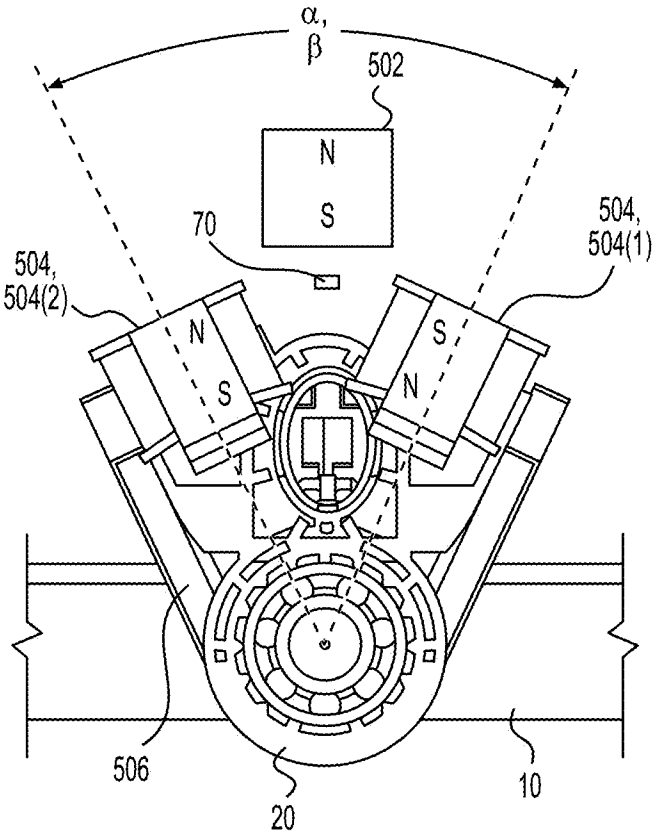
FIG. 30B shows the cross section of FIG. 30A with the hub being rotated to a neutral position, and the polarity of the electromagnets being reversed from FIG. 30A.
Figure 30A:
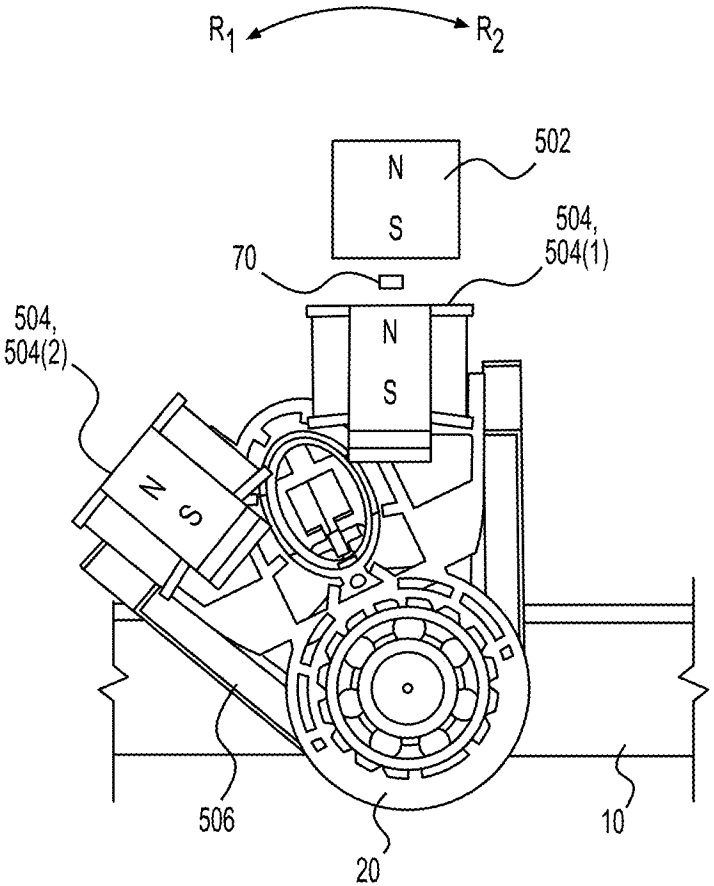
FIG. 30A shows a cross section of a child swing according to even yet still another example with first and second electromagnets, and a hub supporting a magnet that applies magnetic forces to the first and second electromagnets to rotate the hub in a first rotational direction.
Figure 30D:
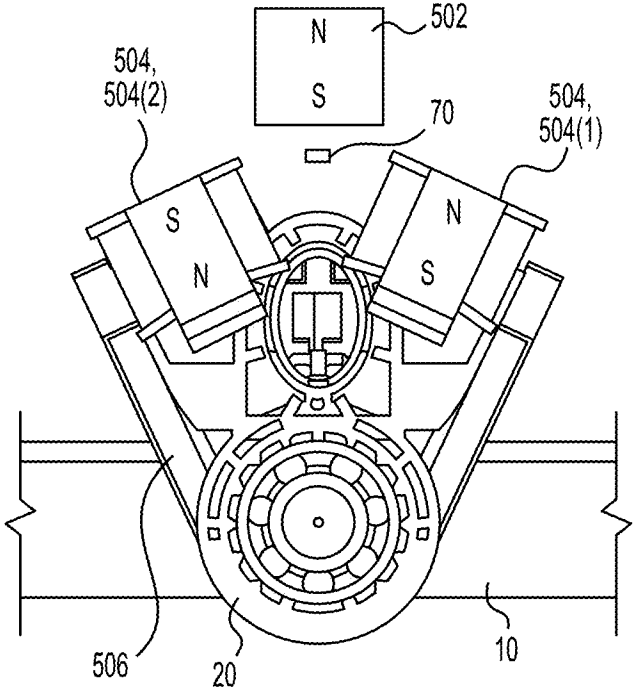
FIG. 30D shows the cross section of FIG. 30A with the hub being rotated to a neutral position and the polarity of the electromagnet being reversed from FIG. 30B.
Figure 30C:
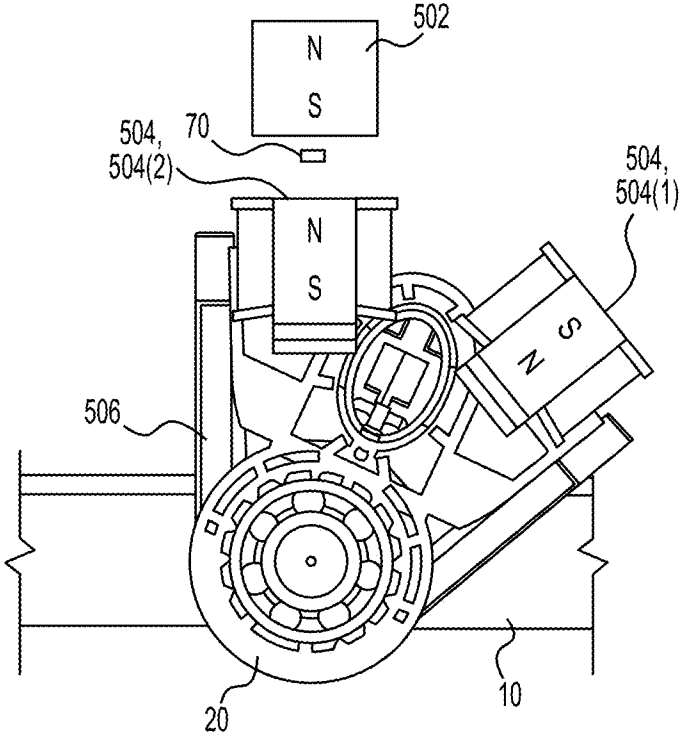
FIG. 30C shows the cross section of FIG. 30A with the hub being rotated in a second rotational direction, opposite the first rotational direction.

The polarity of the first and second ends 504(1) and 504(2) can then be switched to south and north polarities (FIGS. 29B, 30B), respectively, such that the at least one magnet 502 is repulsed by the one of the first and second ends 504(1) and 504(2) causing at least a portion of the column 20, and hence the seat 30, to rotate along a second rotational direction $R_2$, opposite the first rotational direction $R_1$. When the column 20, and hence the seat 30, is in the neutral position (FIGS. 29B, 30B), the magnet 502 is concurrently attracted to the other one of the ends 504(1) and 504(2) and repulsed from the one of the ends 504(1) and 504(2) of the at least one other magnet 504. The attractive forces of between the magnet 502 and the other one of the ends 504(1) and 504(2) causes at least a portion of the column 20, and hence the seat 30, to continue to rotate along the second rotational direction $R_2$ (FIG. 29C, 30C). The rotation of the column 20 along the second rotational direction $R_2$ can stop when the magnet 502 is aligned with the other one of the ends 504(1) and 504(2) of the at least one other magnet 504.

The polarity of the first and second ends 504(1) and 504(2) can then be switched to north and south polarities (FIGS. 29D, 30D), respectively, such that the at least one magnet 502 is repulsed by the one other of the first and second ends 504(1) and 504(2) causing at least a portion of the column 20, and hence the seat 30, to rotate along the first rotational direction $R_1$. When the column 20, and hence the seat 30, is in the neutral position (FIGS. 29D, 30D), the magnet 502 is concurrently attracted to the one of the first and second ends 504(1) and 504(2) and repulsed from the other one of the first and second ends 504(1) and 504(2) of the at least one other magnet 504. The attractive forces of between the magnet 502 and the one of the first and second ends 504(1) and 504(2) causes at least a portion of the column 20, and hence the seat 30, to continue to rotate along the first rotational direction $R_1$ (FIG. 29A, 30A). The rotation of the column 20 along the first rotational direction $R_1$ can stop when the magnet 502 is aligned with the one of the first and second ends 504(1) and 504(2) of the at least one other magnet 504.

In some examples, the polarity of each of the at least one other magnet 504 can be selectively switched to cause the seat to slow down or stop. For example, when the at least one magnet 502 is aligned with the first end 504(1), the first end 504(1) can be selected to maintain a polarity that is the same as the polarity of the at least one magnet 502. Similarly, when the at least one magnet 502 is aligned with the second end 504(2), the second end 504(2) can be selected to maintain a polarity that is the same as the polarity of the at least one magnet 502.

Controller Circuit and Operation

Referring to FIGS. 1, 2, and 4, the child swing 1 can comprise a housing 60 that houses at least a portion of the drive 50 and/or a controller circuit 64 of the child swing 1. The housing 60 can support a control panel 62 that is configured to be engaged by a user to operate various parameters of the child swing 1 (e.g., speed, sounds, etc.). The housing 60 can have an inner side 60*a*, opposite the control panel 62. The inner side 60*a* can face the column 20. The inner side 60*a* can be shaped to conform to a shape of the column 20, such as a shape of an outer surface of the column 20. For example, the column 20 can have an outer curved surface, and the inner side 60*a* can have an inner curved surface that faces the column. The inner side 60*a* can be spaced entirely from the column 20. The housing 60 can be spaced entirely from the column 20 such that no portion of the housing 60 engages the column 20 and the column 20 is free from contact with the housing 60. Thus, the control panel 62 and the inner side 60*a* can be spaced entirely from the column 20. The control panel 62 can be raised from the base 10 such that the control panel 62 is supported at a height that is in-line with the column 20. The control panel 62 can be positionally fixed relative to base 10. In some examples, the column 20 can disposed behind the control panel 62, and the column 20 can be rotatable relative to the control panel 62. Positioning the control panel 62 above the base 10 can make the control panel 62 easier to access for a caregiver standing over the child swing 1.

Figure 15:
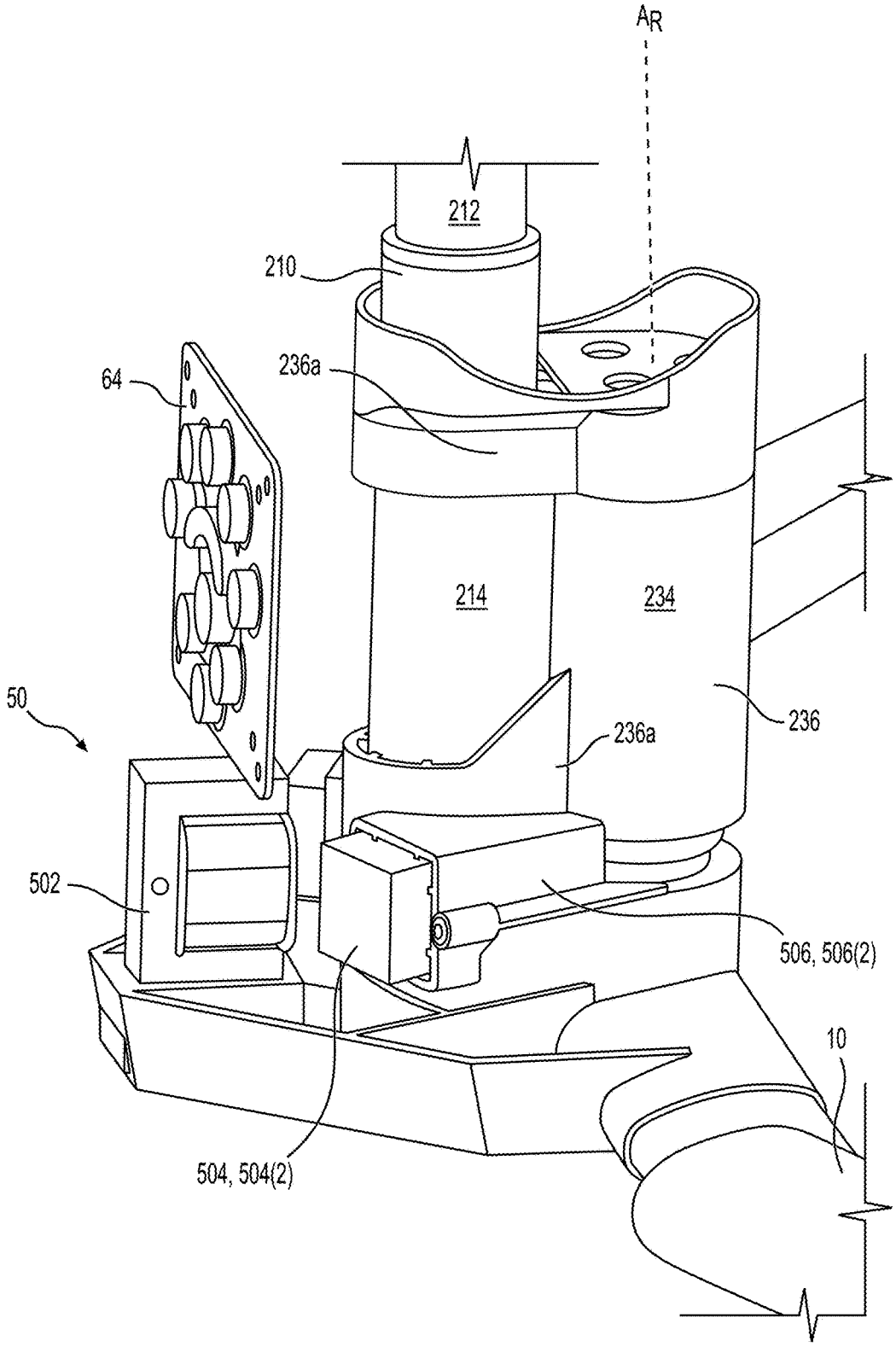
FIG. 15 shows a side perspective view of a lower portion of the child swing of FIG. 1, with housings removed to show a drive unit, a control panel, the extendable shaft, and a pivot shaft of the child swing.
Figure 16:
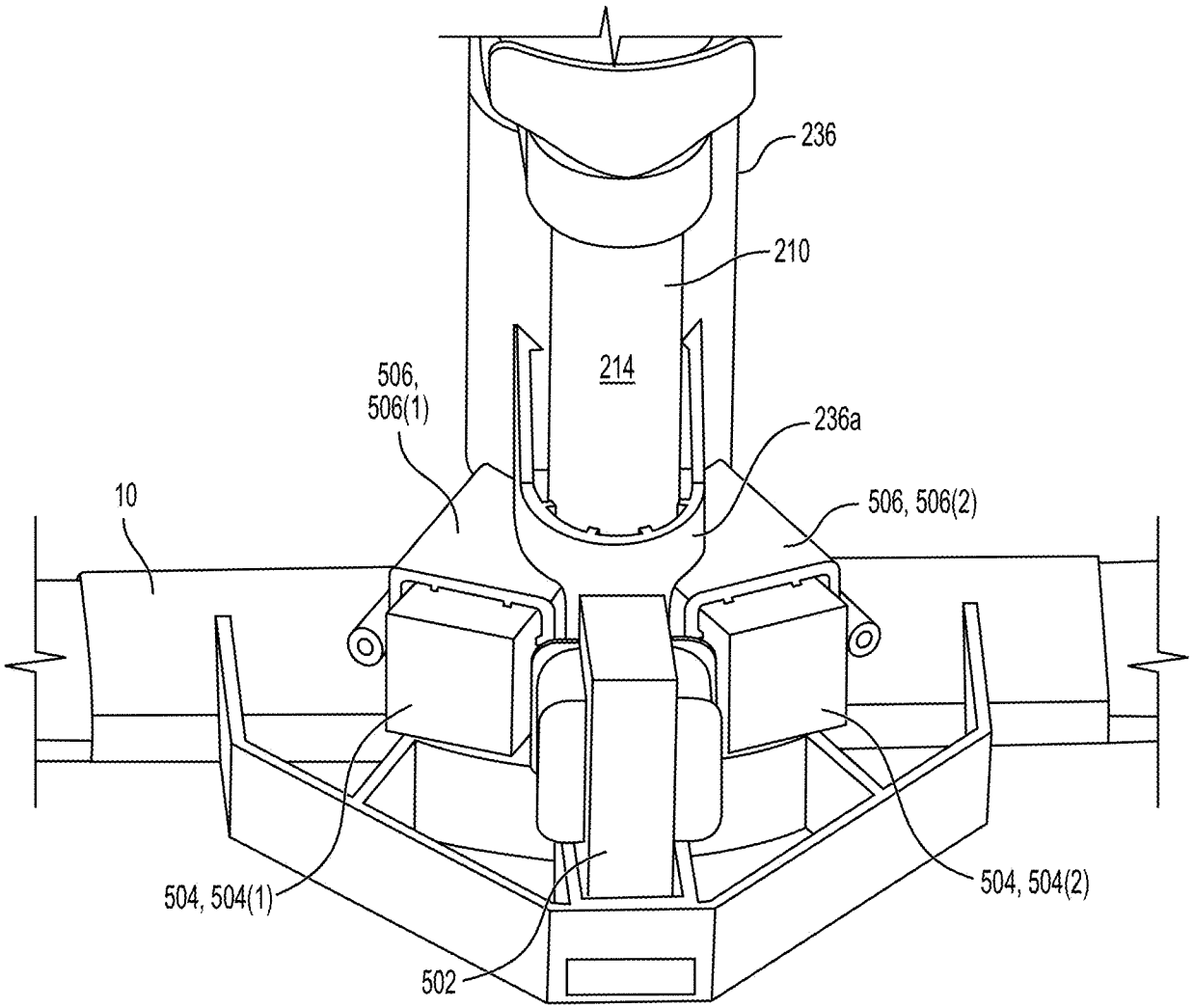
FIG. 16 shows a front perspective view of the lower portion of FIG. 15, with the housings and control panel removed.
Figure 20:
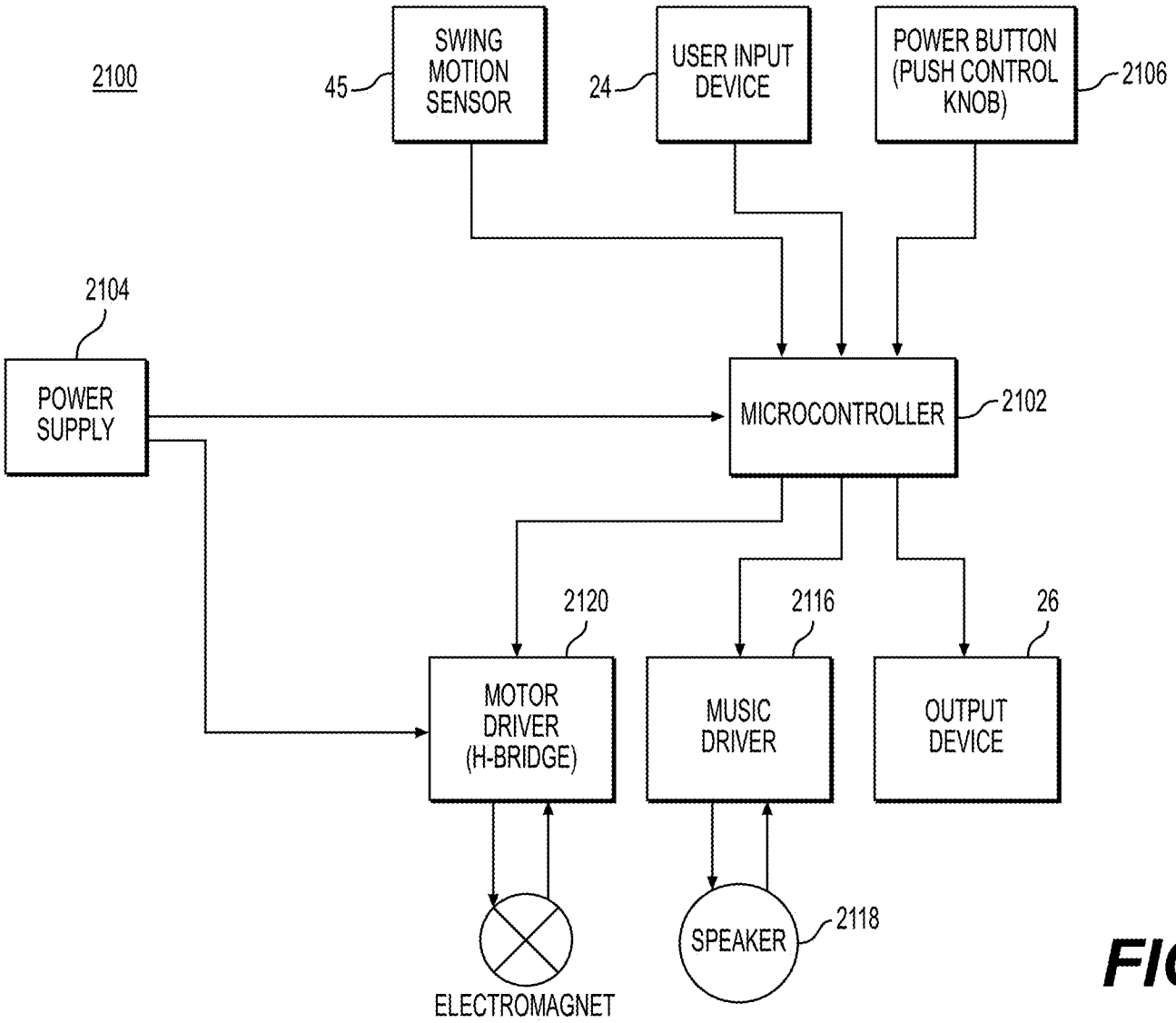
FIG. 20 shows a simplified block diagram of a circuit including a controller for controlling operation of a child swing with a magnetic drive, according to one example.

Referring to FIG. 20, a simplified block diagram of a controller circuit 2100 is shown that can be used to implement the controller of a child swing, such as the controller circuit 64 of FIG. 15. Explained with reference to the child swing 1 for simplicity, portions/components of the circuit 2100 can be formed on a circuit board as shown in FIG. 15. The circuit 2100 includes a controller 2102, and can further include a memory or database (not shown) communicably coupled to the controller. The controller 2102 can be any suitable processing device configured to run and/or execute a set of instructions or code associated with the child swing 1. The controller 2102 can be, for example, a general-purpose processor, a Field Programmable Gate Array (FPGA), an Application Specific Integrated Circuit (ASIC), a Digital Signal Processor (DSP), and/or the like.

The memory/database can encompass, for example, a random access memory (RAM), a memory buffer, a hard drive, a database, an erasable programmable read-only memory (EPROM), an electrically erasable read-only memory (EEPROM), a read-only memory (ROM), Flash memory, and/or so forth. The memory/database can store instructions to cause the controller 2102 to execute processes and/or functions associated with the child swing 1.

The circuit 2100 can further include a network interface (not shown) for communication to one or more external devices (e.g., a remote, a Smartphone, other compute devices, and/or the like) and/or virtual assistants (e.g., Amazon Alexa), such as for remote control of the child swing 1. The communication with the external device(s) can be direct, such as via Bluetooth, low-power Bluetooth, Near-Field Communication (NFC), WiFi, and/or the like. Additionally, or alternatively, the communication with the external device(s) can be via one or more networks such as, for example, a local area network (LAN), a wide area network (WAN), a virtual network, a telecommunications network, and/or the Internet, implemented as a wired network and/or a wireless network. Any or all communications can be secured (e.g., encrypted) or unsecured, as is known in the art.

The controller 2102 is coupled to a power supply 2104 of the apparatus, which can be, for example, a utility power supply, a battery, a rechargeable battery, and/or the like. As an example, the controller 2102 receives a power input from the power supply 2104, such as a 12 V DC power supply or a power supply having any other suitable voltage. The circuit 2100 can include a power button 2106 coupled to the controller 2102 to permit the user to power the child swing 1 on and off. The control circuit 2100 can comprise at least one user input device 24. Each user input device 24 can be a device that is configured to be a computer input device, such as a button, switch, touch screen, capacitive touch sensor, speaker, dial, track ball, joy stick, mouse, keyboard, or other suitable input device. The user input device 24 is configured to receive an input from a user to permit the user to select apparatus parameters to manipulate a swing amplitude, swing duration, music, and/or the like. The controller 2102 receives an input from each user input device 24 that permits the user to manipulate a selected apparatus parameter, such the extent of swing (i.e., the swing angle $\alpha$), how long the swing should run for, and/or the like.

The control circuit 2100 can comprise at least one output device 26. The at least one output device 26 can provide feedback to a user regarding a selected parameter of the child swing 1. The controller 2102 can control operation of the at least one output device 26. In some examples, the at least one output device 26 can comprise a visual output device such as at least one light (e.g., LED) or a screen. Additionally, or alternatively, the at least one output device 26 can comprise an audio output device, such as a speaker. In some examples, the control circuit 2100 can comprise a music driver 2116 and a speaker 2118. The controller 2102 can control music play via the music driver 2116 of the circuit 2100 through the speaker 2118.

The circuit 2100 also includes a driver circuit 2120 for controlling and switching the polarities of a voltage signal applied to the magnet 502, and thereby switching the magnetic poles of the electromagnet. The circuit 2120 can be, for example, an H-bridge circuit with an output voltage line to which the magnet 502 is coupled. When more than one electromagnet is employed, they can be connected to the H-bridge circuit in parallel, with reverse polarities to each other. Generally, whenever more than one electromagnet is employed, adjacent electromagnets can be wired in reverse to each other. As a result, the same voltage/polarity applied by the circuit 2120 will result in the electromagnets having opposite magnetic polarities, that are switched when the voltage polarity is switched.

Referring again to the single magnet 502 design, as also illustrated in FIG. 20, the circuit 2120 is also coupled to the power supply 2104 to receive, for example, a signal such as a 12 V signal or signal having another suitable voltage, that can both power the circuit 2120 and provide the voltage signal to be applied to the magnet 502. The voltage signal can be, for example, a pulse-width modulated (PWM) signal. FIG. 20 also illustrates communicative coupling between the controller 2102 and a seat motion sensor 70 (discussed further below).

The child swing 1 can include other components (not shown) that are readable and/or controllable by the controller 2102 such as, for example: an ambient light sensor for use in controlling brightness of any LEDS on the housing, for turning a nightlight on and off; a motion sensor for turning a nightlight on and off when a user approaches it; a weight sensor coupled to the seat 30 for sensing whether a child is sitting on the seat; a tilt sensor, a gyroscope, and/or a gyrometer coupled to the seat 30 that can be used to turn the child swing 1 off if the seat tilt or orientation renders it unsafe for use.

Figure 21:
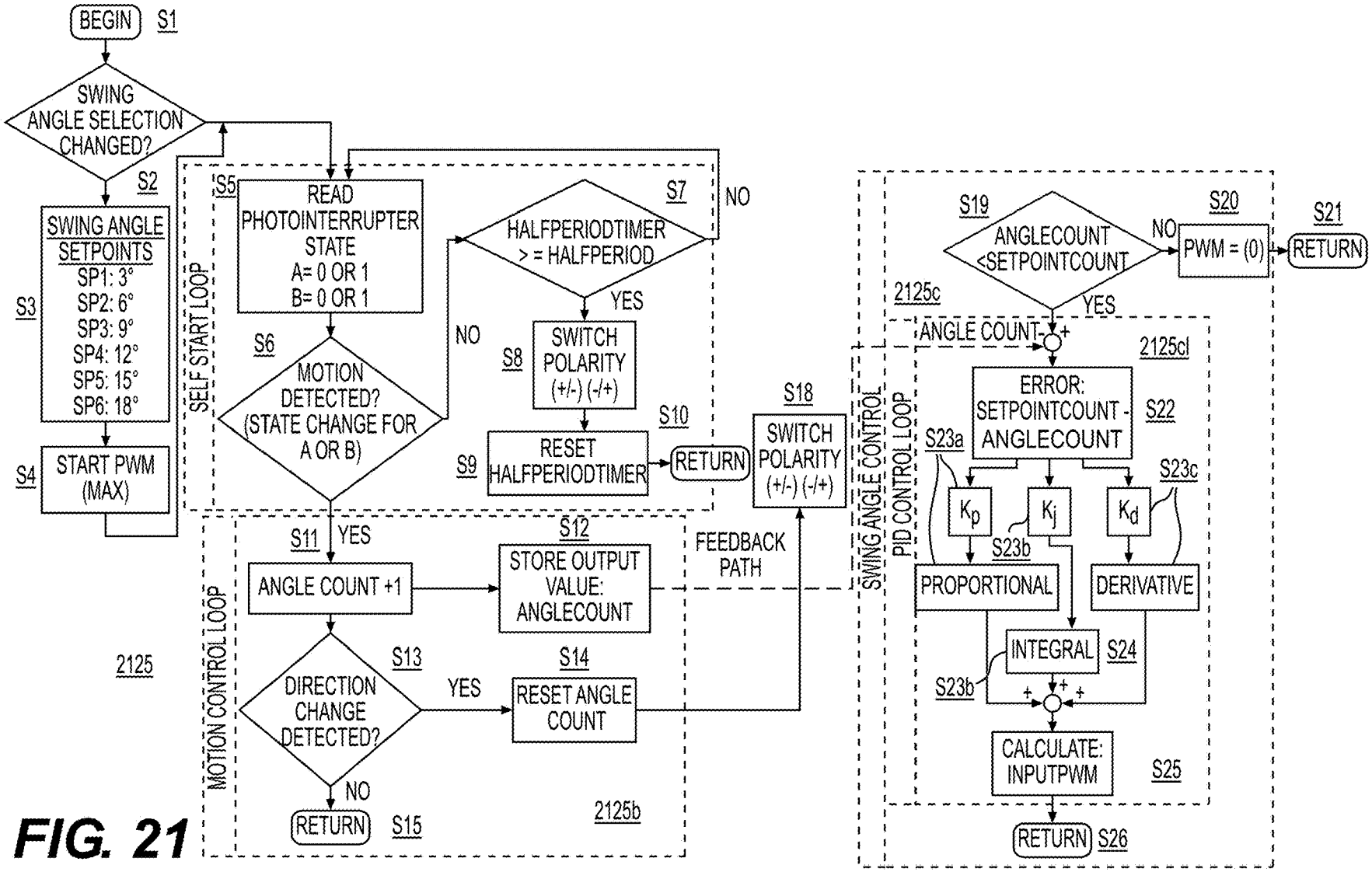
FIG. 21 shows a simplified flow diagram of a method of operating a child swing with a magnetic drive, according to one example.

FIG. 21 shows a simplified flow diagram of a method 2125 of operation of the child swing 1 according to one example, and that can be executed by the circuit 2100, such as by the controller 2102. The method 2125 begins at step S1 such as, for example, after the user powers on the swing 1 and makes a selection of a swing angle $\alpha$. At step S2, a check is made if the selection of the swing angle $\alpha$ has changed. When this check is made at least the first time after the user makes a selection (i.e., apparatus is at rest and the swing angle is currently zero), the latest value of the swing angle is read at step S3. Step S3 here indicates six example values or "setpoints" (SPs) of swing angle that the user can set, from a SP1 of 3 degrees to a SP6 of 18 degrees, which is the maximum permissible swing angle. After the setpoint is determined at S3, at step S4, a maximal value of a voltage signal (e.g., a PWM signal, as illustrated in FIG. 21) is applied to the at least one electromagnets 502 with a given (say, first) polarity. As explained above, in this manner, the magnet 502 is energized and depending on the polarity of the electromagnet, swing motion can, in at least some examples, be initiated in the first or second rotational direction without any additional input from the user, i.e., the user does not need to push the swing 1 to start swing motion, or do anything else other than provide a setpoint for the swing motion. Also, at step S4, a clock or timer is initiated (referred to as a "halfPeriodTimer" in FIG. 21) to reflect the duration for which the voltage signal at a given polarity has been applied.

Then the controller 2102 executes a self-start sequence/loop 2125*a* which permits the swing 1 to start swing motion upon input from the user through the control panel 62, and without requiring, as is the case with several conventional devices, a manual push from the user. Self-start can be affected by the off-axis placement of the north and south poles of the at least one other magnet 504 and at least one magnet 502 during rest, such that powering the at least one electromagnet substantially immediately results in attractive and repulsive forces that can initiate swing motion. The sequence 2125*a* includes, at step S5, reading the output of a seat motion sensor 70. The seat motion sensor 70 can be configured to generate signals that are indicative of angular positions of the seat 30. At step S6, it is determined whether the output of the seat motion sensor 70 has changed. A change in output of the seat motion sensor 70 can be indicative of some movement of the magnetic drive 50 induced by the application of the maximum voltage signal to the electromagnet at step S4. The output of the seat motion sensor 70 can be compared to threshold to determine whether movement has been induced.

If motion is not detected at step S6, then at step S7, the timer started at step S4 is checked against a predetermined time period (illustrated in FIG. 21 as a "halfPeriod") to determine if a time duration of application of the voltage signal at the first polarity is greater than the time period of, for example, 700 ms. Generally, the time period can be from about 400 ms to about 900 ms, including all values and sub-ranges in between. In some cases, the time period can be about 700 ms. If the timer value is greater than or equal to the predetermined time period, then at step S8, the polarity of the voltage signal applied to the magnet 502 is switched. At step S9, the timer is reset, and step S10, control passes back to step S1. Regularly passing control back to step S1, as done at step S9 and at various other times during the method 2125 (explained later) enables any user changes to the swing angle/setpoint to be quickly accounted for at steps S2-S4; if the user has made no such change, control returns to the self-start sequence 2125*a*, and to step S5.

If the timer value is less than the predetermined time period at step S7, then the time value continues to increment, and the self-start sequence 2125*a* loops back to step S5. In this manner, during the self-start sequence 2125*b*, the controller 2102 will periodically switch at step S8, with the periodicity based on the predetermined time period, the polarity on the magnet 502 until some swing motion is underway, as detectable at step S5.

Once some swing motion is detected per the analysis at step S6, the controller 2102 can execute a swing motion control sequence/loop 2125*b*. At step S11, a swing angle measure (illustrated in FIG. 21 as a "AngleCount"), which is set to zero at start up, is incremented by one degree as an initial estimate of the swing motion achieved during the self-start sequence 2125*a*. The updated swing angle measure is stored at step S12, for use during the swing angle control sequence/loop 2125*c*, described later.

At step S13, the seat motion sensor 70 is continuously read or monitored by the controller 2102 to determine the direction of swing and whether it has changed. If there is no swing direction change determined at step S13, then at step S15 control returns to step S1 which as explained before, is beneficial for reassessing whether the user has changed the swing setpoint. Since the apparatus is now in motion and the motion detection criterion at step S6 is readily satisfied, control returns quickly to the motion control sequence 2125*b*, where the swing angle measure continues to be incremented at step S11, since the child swing 1 continues to swing in the same direction.

If a swing direction change is determined at step S13, then the swing angle measure is reset to zero at step S14. Since the swing 1 is now swinging in the reverse direction, polarity of the magnet 502 can be switched, and this is done at step S18, in a manner similar to that explained for step S8. Subsequently, the controller 2102 can execute a swing angle control sequence/loop 2125*c* to determine if the extent of swing motion is commensurate with the setpoint specified by the user at step S3, and this is accomplished as follows. At step S19, the stored value of swing angle measure from step S12 (since the current value of swing angle measure has been reset at step S17) is compared against desired setpoint specified at step S3. If the swing angle measure is equal to or exceeds the desired setpoint, this indicates the swing motion has exceeded or will exceed that specified by the user. In such a scenario, at step S20, the voltage signal applied to the electromagnet (e.g., as a PWM signal) is set to zero and/or turned off, to permit the swing motion to dampen of its own accord. At step S21, control then returns to step S1.

If it is determined, at step S19, that the swing angle measure is less than the setpoint specified by the user at step S3, it indicates that swing is still gaining angular motion towards achieving the desired setpoint, but has not done so yet. In such a scenario, the controller 2102 can execute a control loop 2125*c*1 that modulates the voltage signal applied to the electromagnet 51 with the goal of obtaining oscillatory convergence between the swing angle measure and the desired setpoint over time, accounting for and permitting a gradual buildup of swing motion towards the desired swing angle. In this manner, the voltage signal applied to the magnet 502 upon polarity change accounts for the last swing motion completed in a specific direction.

The control loop 2125*c*1, illustrated and explained here as a proportional-integral-derivative (PID) control loop, can be any other suitable feedback loop (e.g., controlled damping) capable of estimating a magnitude of the voltage signal to be applied to the magnet 502 to reduce the differential between the desired setpoint and the observed swing angle. Here, at step S22, a difference or error value is calculated as the difference between the desired setpoint and the observed swing angle. The error value is used to calculate a proportional term at step S23*a* based on a predetermined proportional coefficient Kp. Generally, the calculated proportional term is based on the current error value, i.e., that calculated immediately prior at step S22. The error value is also used to calculate an integral term at step S23*b* based on predetermined integral coefficient Ki. Generally, the calculated integral term is based on the current and past error value, i.e., that calculated immediately prior at step S22, as well as at step S22 during previous execution of the control sequence 2125*c*1. In some cases, the control sequence 2125*c*1 can also encompass calculating a derivative term at step S23*c* based on the error value, and reflects a rate of change in the error value. The terms calculated at steps S23*a*, S23*b*, and optionally at S23*c*, are then summed at step S24 to generate a control output. At step S25, the control output is employed to determine the magnitude of the voltage signal to be applied to the magnet 502, in addition to the change in polarity affected at step S18. At step S26, control is returned to step S1.

In this manner, aspects of the method 2125 are useful for attaining and maintaining the desired swing angle based on detecting change of direction, and without the need for ascertaining a center of the swing motion, as is common in conventional approaches. This is especially beneficial when the swing 1 may be placed on a tilted, inclined, and/or generally non-level surface, such that a center of the swing motion may be different than a geometric center of the apparatus. In some cases, the swing 1 also does not detect and/or otherwise evaluate speed of the swing motion.

Figure 22:
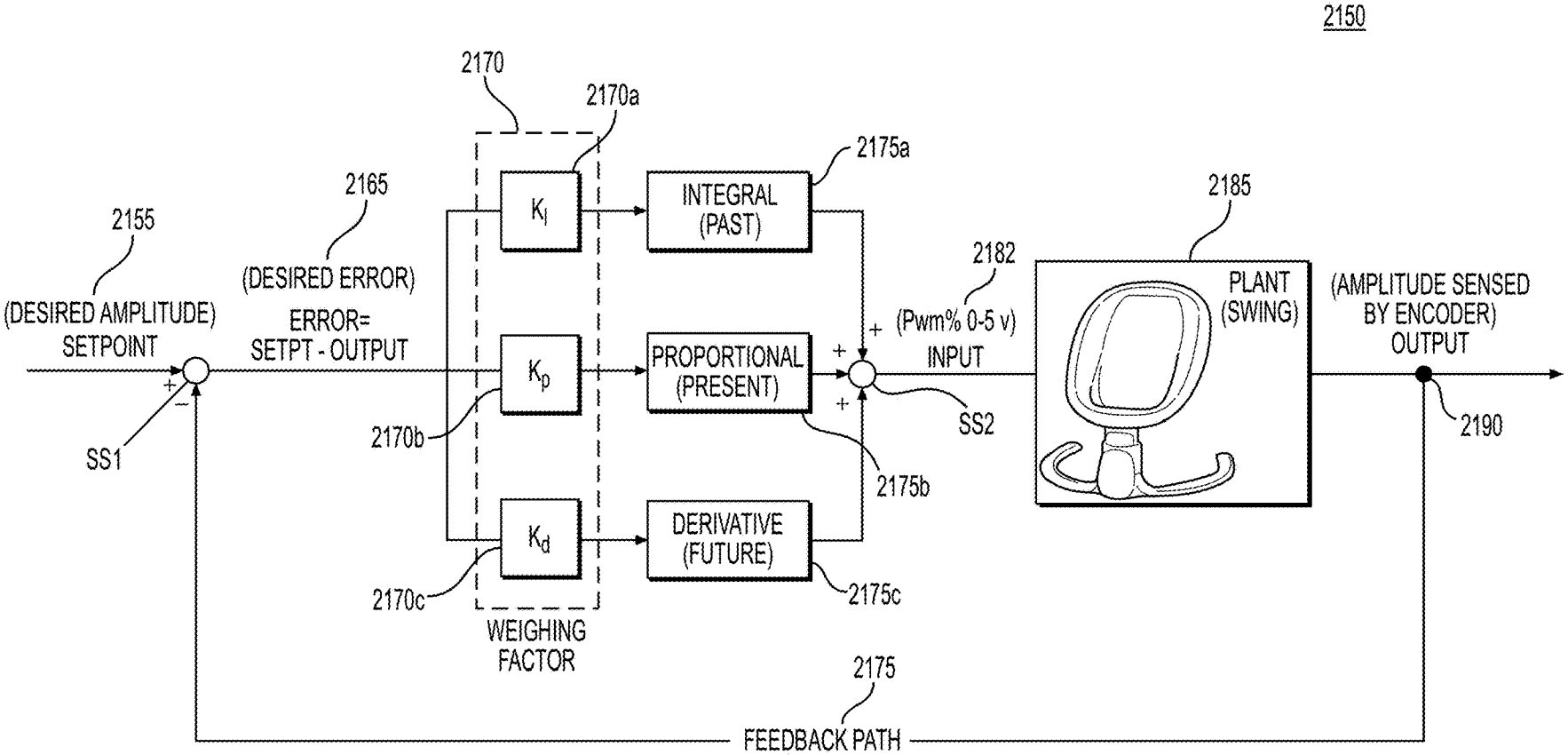
FIG. 22 shows a simplified flow diagram of a control loop of a proportional—integral—derivative (PID) controller for controlling operation of the child swing, according to an example.

FIG. 22 illustrates a control sequence/loop 2150 executable by the controller 2102 to manage the swing control. Unless noted otherwise, aspects of the control sequence may be similar to the control sequence 2125*c*1 and other aspects of the method 2125. At step SS1, a desired swing angle, setpoint, or "desired" amplitude 2155 that was previously selected by the user (e.g., such as at step S3) is compared against the observed swing or output swing amplitude 2190 that is determined based on the seat motion sensor 70, generating an error value 2115. As described above for FIG. 21, if the swing amplitude 2190 is greater than or equal to the desired swing angle, the power to the electromagnet can be shut off. If the swing amplitude is less than the desired swing angle, the error can be input to a PID algorithm, with coefficients 2170 (integral coefficient 2170*a*, proportional coefficient 2170*b*, derivative coefficient 2170*c*) that are combined with the proportional, integral, derivative terms 2175*a*, 2175*b*, 2175*c* respectively to generate, at step SS2, an indication of an output voltage and/or input power (e.g., a relatively increased input PWM duty cycle) 2182 that can be applied to the magnet 502. This can cause the swing amplitude 2190 to increase until the setpoint amplitude 2155 is reached.

Swing Motion Sensor

Turning to FIGS. 4 and 5, in some examples, a child swing according to this disclosure can comprise a swing motion sensor 70. The at least one motion sensor 70 is configured to detect angular positions of the seat 30 during operation of the child swing 1. The swing motion sensor 70 can be implemented with a swing such as swing 1 that has a base 10, a seat 30, and a rotatable column 20. However, the swing motion sensor 70 can alternatively be implemented in other child swings and in child swings other than those shown in the figures herein. For example, the swing motion sensor can be implemented with a child swing that has a base, a seat, and at least one swing arm, where the at least one swing arm can be configured to hang down from the base and the seat 30 can be attached to a lower end of the at least one swing arm.

The child swing 1 can comprise at least one magnet 504 having a north pole and a south pole, and the sensor 70 can comprise a hall effect sensor that senses a strength of each of the north and south pole. In some examples, the at least one magnet 504 can be at least one other magnet 504 of a magnetic drive 50 as discussed above. However, in alternative examples, the at least one magnet that is sensed by the motion sensor 70 need not be a magnet of the magnetic drive 50. In fact, the motion sensor 70 can be used with any drive, including a mechanical drive (e.g., a wind-up and/or spring-activated drive) or an electrical drive (e.g., a drive including a motor). For example, the at least one magnet 504 can be attached to the column 20 or at least one swing arm, but not drive the column 20 to rotate.

The at least one magnet 504 or the hall effect sensor 70 are rotatable relative to the other of the magnet 504 and the hall effect sensor 70. For instance, in some examples (FIGS. 17A to 18D and 30A to 30C), the sensor 70 can be positionally fixed relative to the base 10, and the at least one magnet 504 can be configured to rotate relative to the base 10 and the sensor 70. In other examples (FIGS. 19A-D and 29A-D), the at least one magnet 504 can be positionally fixed relative to the base 10, and the sensor 70 can be configured to rotate relative to the base 10 and the at least one magnet 504. Preferably, the hall effect sensor 70 is substantially centered between the north and south poles of the at least one magnet 504 when the seat 30 is in the neutral position. The hall effect sensor 70 is configured to generate a signal that is indicative of a strength of each magnetic field generated by the north and south poles of the at least one magnet 504 during the relative rotation. For example, a voltage level or current output by the sensor 70 can be indicative of the strength of each magnetic field. The signal can be indicative of an angular rotation of the column 20, and consequently the seat 30.

Figure 23:
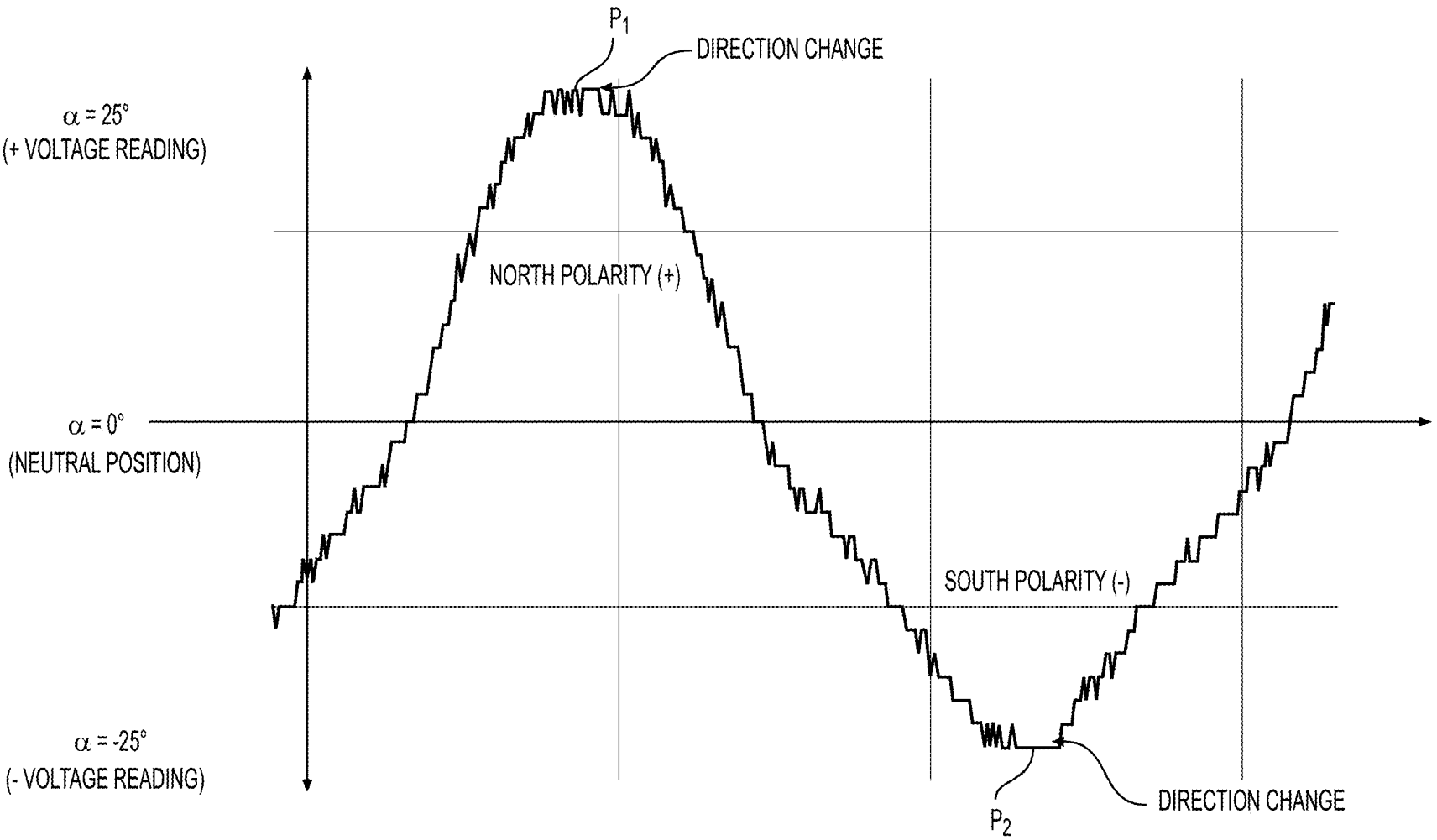
FIG. 23 shows a graph of a voltage reading of a motion sensor of the child swing of FIG. 1 over a full rotation of the seat of the child swing.
Figure 24:
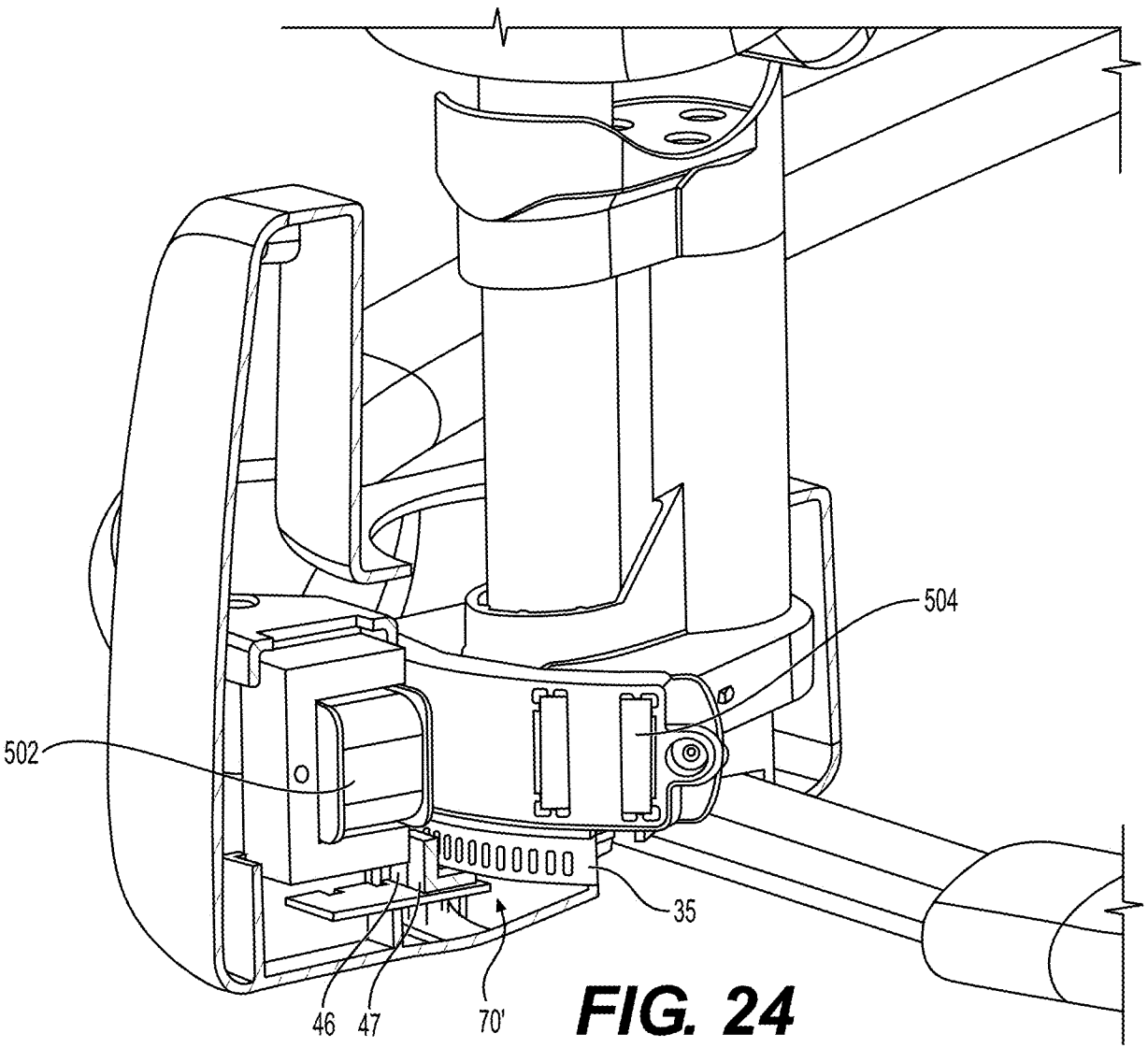
FIG. 24 shows a cross-sectional perspective view of a portion of a child swing according to an example with an optical sensing device.
Figure 25:
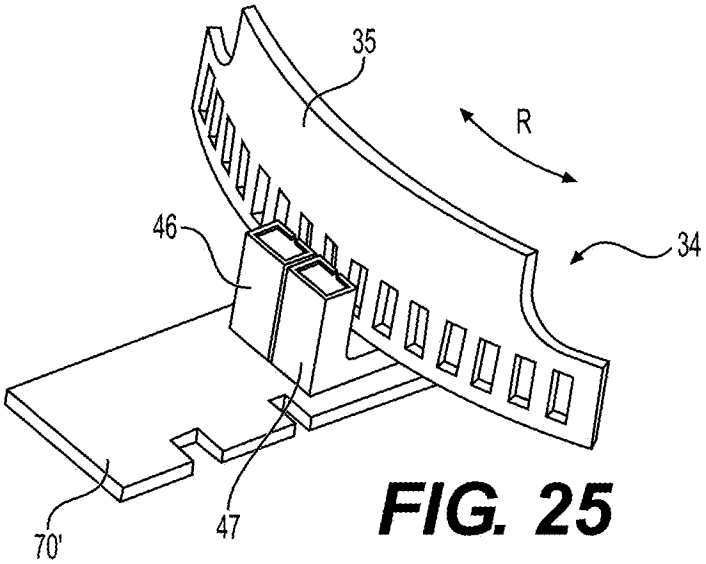
FIG. 25 shows a perspective view of the sensing device shown in FIG. 24, the sensing device having an encoder and an optical sensor.
Figure 27:
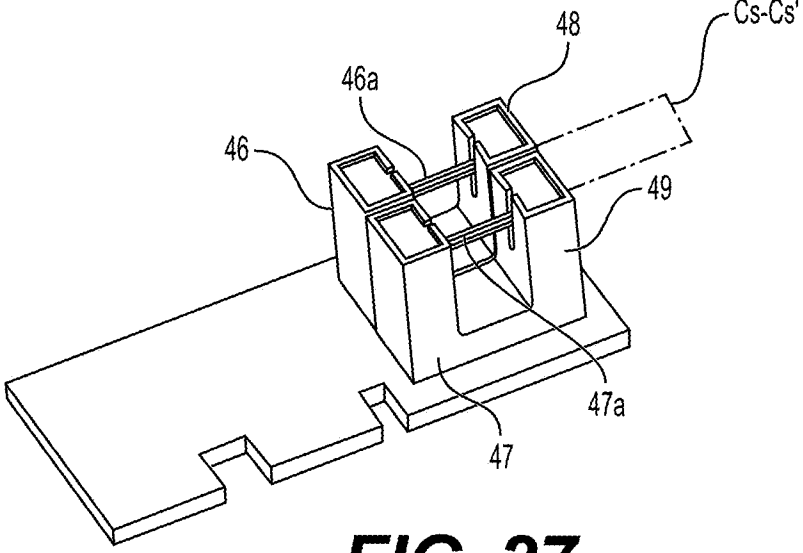
FIG. 27 shows a perspective view of the optical sensor of the sensing device of FIG. 24.
Figure 26:
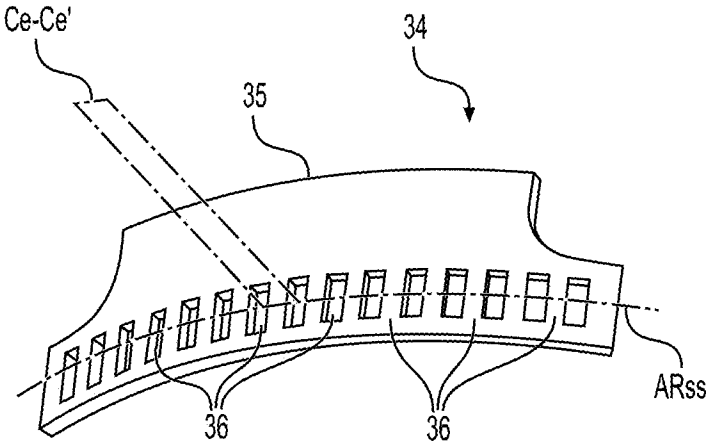
FIG. 26 shows a perspective view of an encoder of the sensing device of FIG. 24.

For example, FIG. 23 shows an example of the signal for just over a full rotation of the seat 30. As shown, when the seat 30 is in the neutral position ($\alpha$=0 degrees), the voltage level is zero. As one of the poles (e.g., the north or south pole) of the at least one other magnet 504 and the hall effect sensor 70 move closer to one another, the voltage of the signal can become increasingly more positive as illustrated in FIG. 23. The voltage peaks at the position $P_1$ where the seat 30 changes direction. As the other one of the poles of the at least one other magnet 504 and the hall effect sensor 70 move closer to one another, the voltage of the signal can become increasingly more negative as illustrated in FIG. 23. The voltage bottoms out at the position P2 where the seat 30 changes direction.

The controller circuit (e.g., 64 of FIG. 5 or 2100 of FIG. 20) can be configured to determine a value of one or more, up to all, of (1) an angular position of the seat 30, (2) a direction of rotation of the seat 30, or (3) a moment of direction change of the seat 30. In particular, each value of the signal (e.g., voltage level) can correspond to a different angular position of the seat 30. Thus, the controller circuit 64 can determine the value based on the signal. In some examples, the value for each angular position of the seat 30 can be stored in a lookup table in memory, and the controller circuit 64 can look up the value in the memory based on a value of the signal. In other examples, the controller circuit 64 can determine each value by applying a value of the signal to a formula. The controller circuit 64 can determine the direction of rotation from the neutral position based on whether a value of the signal is zero, positive, or negative.

Another example of a swing motion sensor 70' is shown in FIGS. 24 to 27. The swing motion sensor 70' can be an optical sensor. The swing 1 can comprise the optical sensor 70' and an encoder 34. Comprising an opaque body 35. The optical sensor 70' can comprise first and second light sources 46 and 47, and first and second light detectors 48 and 49. The first and second light sources 46 can be light-emitting diodes (LEDS) or other suitable lights. The light detectors 48 and 49 can be photodetectors, photodiodes, or other suitable light detectors. The opaque body 35 can be positionally fixed relative to one of the column 20 and the base 10. The first and second light sources 46 and 47 and the first and second light detectors 48 and 49 can be positionally fixed relative to the other one of the column 20 and the base 10. Each of the first and second light sources 46 and 47 can be aligned with, and spaced from, a corresponding one of the first and second light detectors 48 and 49, respectively. Each of the first and second light sources 46 and 47 can be configured to emit light beams 46*a*, 47*a* towards a corresponding one of the first and second light detectors 48 and 49. While illustrated here as collimated beams, it is understood that the beams 46*a*, 47*a* may exhibit some degree of convergence and/or divergence, i.e., be conically shaped. As explained in greater detail herein, the use of two sensing beams 46*a*, 47*a* can be useful for detecting change in swing direction.

The opaque body 35 can be disposed between in a space between the light sources 46 and 47 and the light detectors 48 and 49. The opaque body 35 defines a plurality of translucent windows 36 that are spaced apart from one another along a direction of rotation R. The translucent windows 36 can define slots that extend through the opaque body 35 and/or translucent pieces of material such as film. The opaque body 35 may be generally curved in form, and define a curvature/arc $AR_{SS}$ that is centered about the axis of rotation $A_R$. The opaque body 35 may define from about 6 to about 20 translucent windows 36, including all values and sub-ranges in between. The opaque body 35 is opaque between the translucent windows 36. The translucent windows 36 can be spaced apart by about 1 degree of swing angle to about 3 degrees of swing angle or greater, including all values and sub-ranges in between. A center-to-center separation Cs-Cs' between adjacent windows 36 can be from about 0.15 inches, about 0.21 inches, about 0.3 inches, about 0.4 inches, to about 0.5 inches, including all values and sub-ranges in between. The curvature of the opaque body 35 and the separation Cs-Cs' can be selected such that the angular separation between centers of adjacent translucent windows 36 can be from about 1 degree to about 3 degrees, including all values and sub-ranges in between. The number of translucent windows 36 can be selected such that the angular separation between the first and last translucent window 36 is at least equal to the maximum permissible swing angle $\alpha$.

The optical sensor 70' and the opaque body 35 are positioned with respect to each other such that, when the column 20, and consequently the seat 30, rotates relative to the base 10, the opaque body 35 passes through the space between the light sources 46, 47 and the light detectors 48, 49. The translucent windows 36 permit the beams 46*a*, 47*a* to pass through them, while opaque body 35 blocks this continuity of the beams. It is generally understood that, depending on the beam width relative to the widths of the windows 36 and the portions of the opaque body 35 between the windows 36, a sensing beam may not be completely blocked by the opaque body 35. The opaque body 35 between adjacent windows 36 can also be referred to as a "photo-interrupter", so that the opaque body 35 can generally be considered to include interleaved windows and photo-interrupters.

Nevertheless, if the optical signal detected at a light detector 48, 49 of the optical sensor 70' is below a predetermined threshold, it can be deemed, by a controller, that the corresponding sensing beam is blocked by the opaque body 35. Conversely, a sensing beam may not be fully transmitted through a window 36, but if the optical signal detected at the respective light detector 48, 49 is above a predetermined threshold, then the controller can determine that the corresponding sensing beam is transmitted through one of the windows 36. In some cases, each light detector 48, 49 of the optical sensor 70' can further include a slit that limits the width of the optical signal that reaches it.

This disruption in the transmission of the beams 46*a*, 47*a* is detectable by the photodetectors of the sensor 70' and can generally resemble, for example a periodic signal that is different for each light detector 48, 49, with maxima at the times where the windows 36 engage with that beam, and minima at the times where the opaque body 35 engages with that beams. This is explained in greater detail for FIG. 28. Since the beams 46*a*, 47*a* have finite cross-sectional width that can be wider or narrower than the windows 36 and opaque body 35 between consecutive windows 36 at the point of interaction, it is not necessary that the entirety of the beam is blocked by the opaque body 35 when interacting with it. Similarly, it is not necessary that the entirety of the beam, by virtue of its width, passes through a window 36. Accordingly, it is understood that the beams 46*a*, 47*a* can be deemed to be passing through a window 36 when the detected signal at the light detectors 48, 49 is above a predetermined threshold. Similarly, the beams 46*a*, 47*a* can be deemed to be blocked by the opaque body 35 when the detected signal at the light detectors 48, 49 is below a predetermined threshold, and not necessarily zero.

A center-to-center separation Ce—Ce' between the beams 46*a*, 47*a* can be from about 0.25 inches, 0.26 inches, to about 0.4 inches, including all values and sub-ranges in between. In some cases, the separation Ce—Ce' can be such that at least one complete window 36 is always disposed between the beams 46*a*, 47*a* during swing motion. Generally, the result of such a separation is that when one of the sensing beams (e.g., the beam 46*a*) is centered on a window 36 and is not blocked, the other beam (e.g., the beam 47*a*) will be on or encompass an edge of another window 36, and transitioning from being blocked or unblocked to the other state. Similarly, if one of the sensing beams 46*a*, 47*a* is centered on a portion between windows 36, the other beam will be on or encompass an edge of another window 36 and transitioning from blocked to unblocked or vice versa, depending swing direction.

In some cases, the separation Ce—Ce' can be such that at least portions of two windows 36, and the opaque body 35 (i.e., a photo-interrupter) therebetween, are always disposed between the beams 46*a*, 47*a* during swing motion. Such separation Ce—Ce' can provide increased resolution of swing motion determination compared to conventional techniques. The swing motion corresponding to a change in state for a light detector 48, 49 can be from about just greater than zero degrees (e.g., when the light beam 46*a* is positioned just inside a window and adjacent a window edge, and the swing motion pushes it outside that adjacent window edge) to about one degree (e.g., when the light beam 46*a* is positioned just inside a window and adjacent a window edge, and the swing motion moves the light beam 46*a* across the window and pushes it out the opposing window edge), with an average of about 0.5 degrees.

Figure 28:
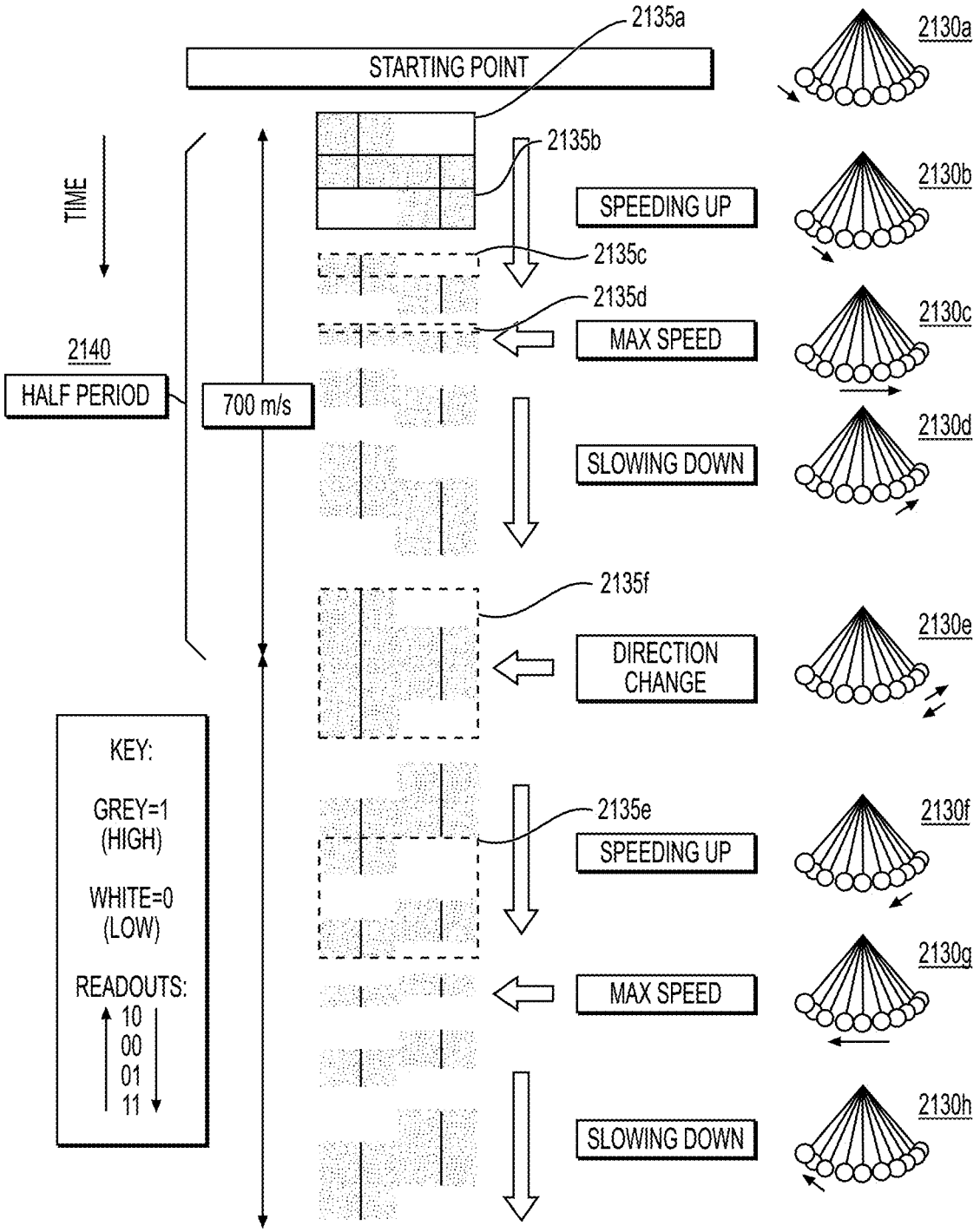
FIG. 28 illustrates an example operation of the optical sensing device of FIGS. 24 to 27, including detection of change of swing direction.

Referring to FIG. 28, for ease of explanation, direction change is explained when the swing motion starts at one end of the swing motion as represented by the state 2130*a* ("starting point"), at which the swing angle is maximum, and swing speed is substantially zero. The swing 1 then moves through state 2130*b* to state 2130*c*, where the swing angle is substantially zero and swing speed is maximum. During this motion, the sensing beams 46*a*, 47*a* will be differently blocked and transmitted by the opaque body 35, which can be detected by the controller 2102 as a '0' (or 'LOW', when that beam is blocked) or a '1' (or 'HIGH', when that beam is not blocked and is detectable), as also illustrated in the legend of FIG. 28. For example, the controller can detect a '10' (generally illustrated as a readout/readout block 2135*a*) when swing motion is between states 2130*a* and 2130*b*, i.e., when the beam 46*a* is not blocked and the beam 47*a* is blocked.

The swing motion then continues through a readout of '11' to a readout of '01' (see readout 2135*b*), to '00', and then back to '10' (see readout 2135*c*). Since the swing motion is speeding up from state 2130*a* though 2130*b* to 2130*c*, the readout 2135*c* has a shorter duration (i.e., reduced thickness, as illustrated in FIG. 8) than 2135*a*, and the readout 2135*d*, at state 2130*c*, has an even shorter duration due to the swing motion being at maximum speed.

As illustrated in the legend of FIG. 28, any one of these transitions between readouts can be used to ascertain the direction of swing motion. When the readouts transition in the opposite direction then, i.e., from '10' to '00', to '01', to '11', and back to '10' as illustrated in the readout block 2135*e*, it can be determined that the swing motion is in the opposite direction (here, from states 2130*e* to state 2130*f*). In this manner, the sizing of the windows 36 in the opaque body 35 and the separation Cs-Cs' between the beams 46*a*, 47*a* can be selected so that there is one full window 36 between the beams 46*a*, 47*a*, which in turn permits the readout-based direction determination as explained herein. Further, a change in the readout of just one of the beams 46*a*, 47*a* is sufficient to determine swing direction. As explained above with respect to the self-start sequence 2125*a*, this determination can be made within about 0.5 degree of swing motion on average.

Accordingly, the controller 2102 can determine a direction change (e.g., from clockwise/CW to counterclockwise/CCW or vice versa) has occurred when the cyclical transition between the readouts reverses. As illustrated in the readout block 2135*f*, when the swing motion is in state 2130*e*, it will reverse direction. This is detected by the controller 2102 as a transition from a '10', to '11', and then back to a '10'. If there was no direction change, on the other hand, the transition would have been from '10' to '11' to '01', i.e., similar to that explained for the readouts 2135*a*, 2135*b* above.

FIG. 28 also generally illustrates the notion of a half period 2140 (e.g., about 300 ms, about 500 ms, about 700 ms as illustrated, about 900 ms, about 1 s, about 1.2 s, about 1.5 s, including all values and sub-ranges in between), which is the time it takes, during steady state motion to move from one end of the motion (state 2130*a*), through the swing angle α to center (state 2130*c*), and through the swing angle α to the other end of the motion (state 2130*e*). It then takes another half period for the motion to progress from the state 2130*e*, through state 2130*f* to center 2130*g*, and then through state 2130*h* back to the state 2130*a*. The determination of a swing direction change, which is a fleeting instantaneous state that occurs between half periods, is generally made at the beginning of the next half period since that is when a reversal of readouts is detectable as explained above for the readout block 2135*f*

Removable Seat

Figure 31:
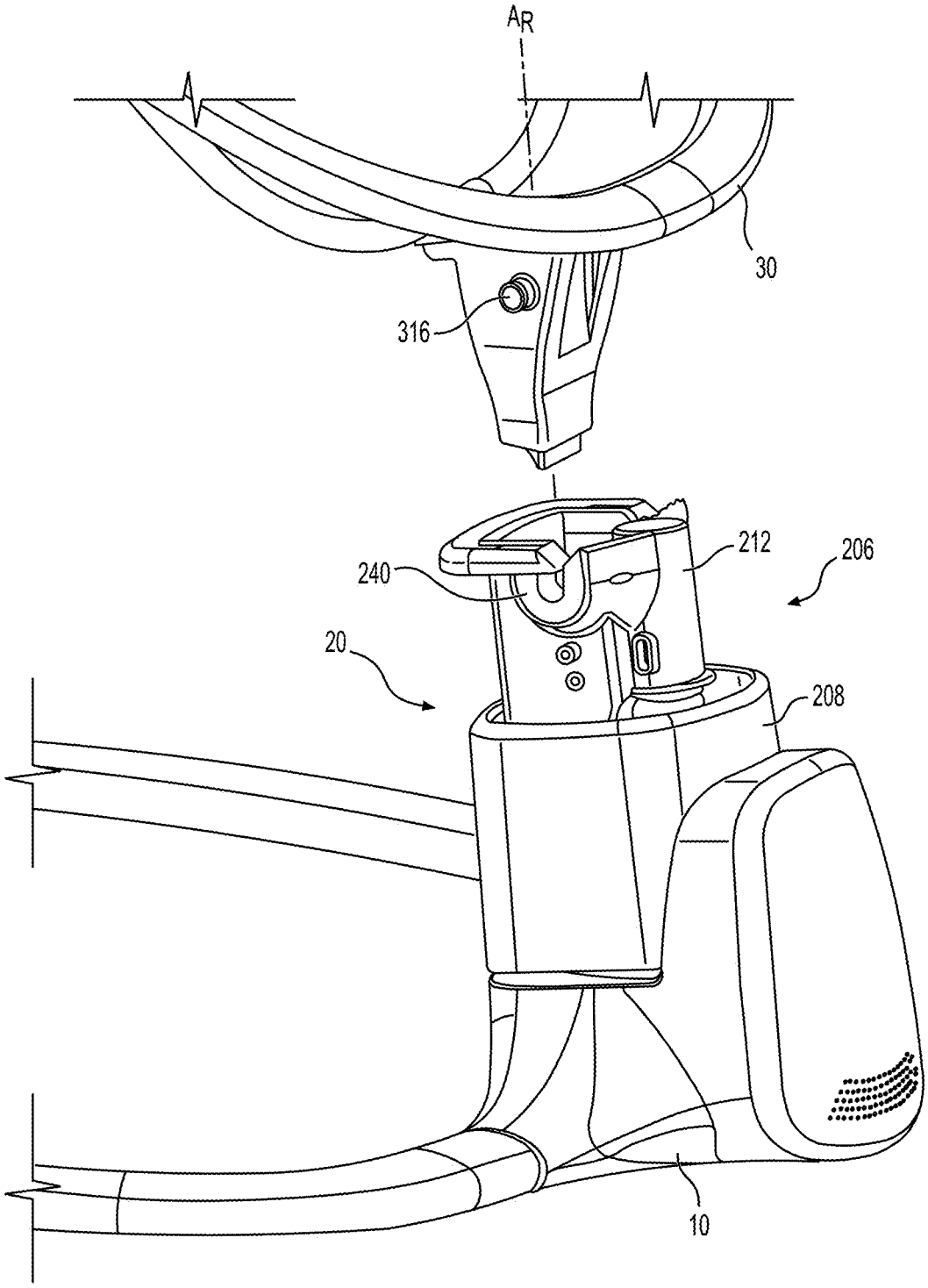
FIG. 31 shows a perspective view of a portion of the child swing with the seat removed from the column.
Figure 32:
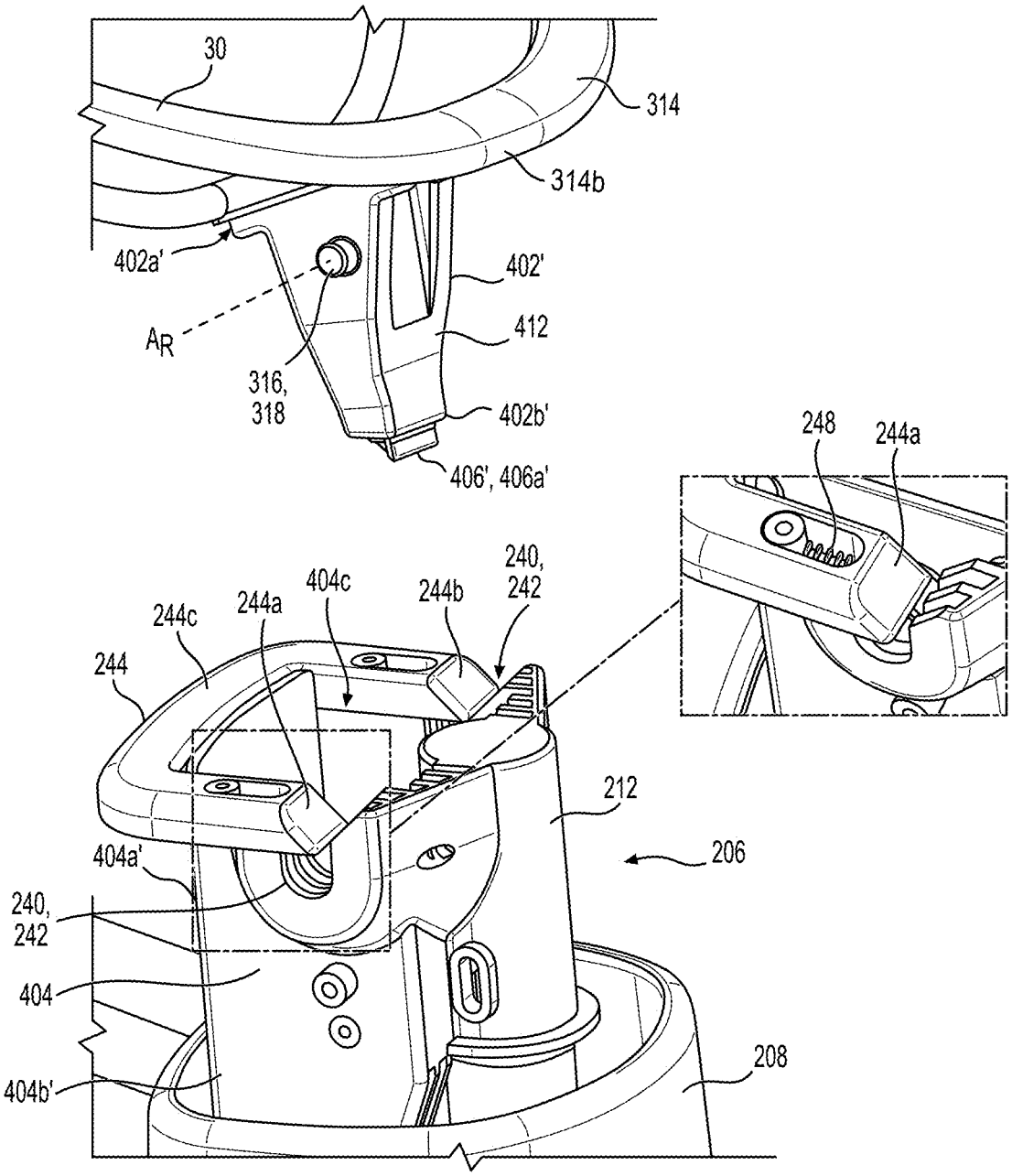
FIG. 32 shows an enlarged perspective view of a portion of the child swing with the seat removed from the column.

Turning to FIGS. 31 and 32, in some examples, the seat 30 can be configured to removably couple to the column 20. The seat 30 can be configured to couple to the column 20 such that the seat 30 is rotationally fixed relative to the column 20 such that rotation of the column 20 causes a corresponding rotation of the seat 30. For instance, the seat 30 can comprise at least one engagement feature 316 that is configured to engage at least one corresponding engagement feature 240 of the column 20. The at least one engagement feature 316 can have a shape that is keyed to a shape of the at least one engagement feature 240 such that rotation of the column 20, and consequently the at least one engagement feature 240, causes rotation of the at least one engagement feature 316, and consequently the seat 30. The at least one engagement feature 316 can comprise at least one of a protrusion and a recess, and the at least one engagement feature 240 can comprise another of a protrusion and a recess. In the example shown, the at least one engagement feature 316 comprises at least one protrusion 318, such as a pair of protrusions 318 that extend from opposing sides of the seat 30, each defining a pin. Further, the at least one engagement feature 240 defines at least one recess 242 that receives the at least one protrusion 318, such as a pair of recesses 242 defined on opposing sides of the column 20.

The seat 30 can be configured to couple to the first column portion 206 of the column 20, such as to the first shaft portion 212, such that the seat 30 is translatably fixed to the first column portion 206 with respect to translation along the axis of rotation $A_R$ (e.g., along a substantially vertical direction). Thus, the seat 30 is configured to raise and lower with the first column portion 206 between the plurality of height positions. The child swing 1 can comprise at least one latch 244 that is configured to translatably fix the seat 30 to the at least a portion of the column 20, such as to the first column portion 206. In some examples, the at least one latch 244 can be supported by the column 20 as shown, while in other examples (not shown), the at least one latch can be supported by the seat 30. The at least one latch 244 can be configured to be hand actuated by a caregiver so that the seat 30 can be coupled to, and removed from, the column 20 without the use of a tool, although it will be understood that, in alternative examples, a tool could be used. In the example shown, each recess 242 extends downwards into the first column portion 206 such that recess 242 is open at its upper end, and the at least one latch 244 is configured to translate between a latched position, wherein the at least one latch 244 obstructs the open upper end of each recess 242 to trap a corresponding protrusion 318 therein, and an unlatched position, wherein the obstruction is removed. The at least one latch 244 can comprise at least one stop that obstructs the at least one recess 242. For example, the at least one latch 244 can have a first stop 244*a* configured to obstruct a first one of the recesses 242 and a second stop 244*b* configured to obstruct a second one of the recesses 242. The at least one latch 244 can have a crosspiece 244*c* that extends from the first stop 244*a* to the second stop 244*b*. The crosspiece 244*c* can be configured to be engaged by a caregiver to move the at least one latch 244 from the latched position to the unlatched position. The at least one latch 244 can comprise at least one biasing element 246, such as spring or resilient material, that biases the at least one latch 244 towards latched position.

Figure 33C:
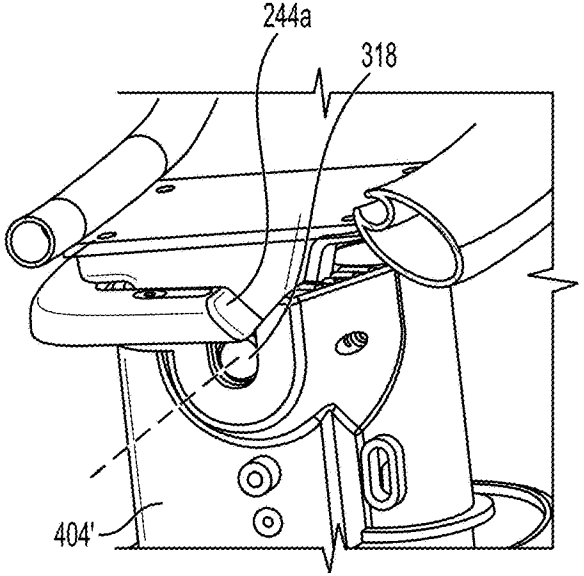
FIG. 33A to 33C show three perspective views of a portion of the child swing, with each view showing a different stage of coupling the seat of the child swing to the column.
Figure 33B:
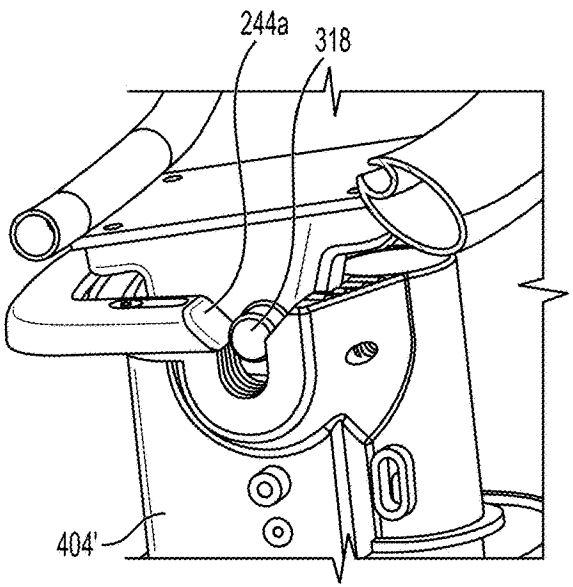
Figure 33A:
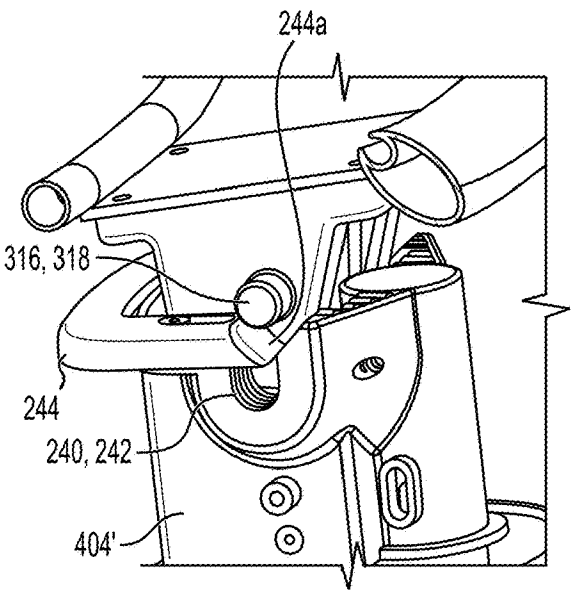

As shown in FIGS. 33A to 33C, each stop 244*a*, 244*b* can have a ramped surface. The child swing 1 can be configured such that, as each protrusion 318 engages a ramped surface of a corresponding stop 244*a*, 244*b*, the protrusion 318 rides along the ramped surface to thereby move the stop 244*a*, 244*b* from the latched position towards the unlatched position (FIGS. 33A to 33B). As each stop 244*a*, 244*b* moves towards the unlatched position, each corresponding protrusion 318 moves beyond the stop 244*a*, and 244*b* into a corresponding recess 242, and the at least one latch 244 is biased by the at least one biasing element 246 back into the latched position (FIG. 33C).

Referring now to FIGS. 32 and 34A to 34C, an alternative example of a recline mechanism 40' is shown. The recline mechanism 40' is configured to selectively transition the seat 30 between a plurality of recline positions. The recline mechanism 40' can comprise a first seat mount 402' and a second seat mount 404' that pivotably couple to one another about a recline pivot axis $A_{Recl}$. The recline pivot axis $A_{Recl}$ can extend along a direction that extends from the first side of the seat 30 to the second side of the seat 30. The first seat mount 402' can be positionally fixed to the seat 30 such that movement (e.g., translation or rotation along any direction) of the seat 30 causes a corresponding movement of the first seat mount 402'. The first seat mount 402' can have a first end 402*a*' that is attached to the seat 30, such as to the lower, front end 314*b* of the seat rim 314, such that the first end 402*a*' rotates with the seat 30 about the axis of rotation $A_R$ relative to the base 10 and translates with the seat 30 relative to the base 10. The first seat mount 402' can have a second end 402*b*' opposite the first end 402*a*'. In some examples, the second end 402*b*' can be a free end that is not attached to the seat 30. For example, the second end 402*b*' can be spaced from the seat 30 along a downward direction. In some examples, as shown, the first seat mount 402' can comprise a bayonet 412 that defines the first and second ends 402*a*' and 402*b*'.

The first seat mount 402' can be configured to pivot relative to the second seat mount 404' about the recline pivot axis $A_{Recl}$. The recline pivot axis $A_{Recl}$ can be defined by the at least one protrusion 318. For example, the recline pivot axis $A_{Recl}$ can be defined by a central axis of the at least one protrusion 318. The at least one protrusion 318 can extend from the bayonet 412, such as from opposite sides of the bayonet 412.

The recline mechanism 40' can comprise a latch 406' that is configured to selectively lock the seat 30 in each of the plurality of recline positions. The latch 406' can be configured to move between a latched position and an unlatched position to selectively lock the first and second seat mounts 402' and 404' relative to one another so as to prevent rotation of the first and second seat mounts 402' and 404' from pivoting relative to one another about the recline pivot axis $A_{Recl}$. The latch 406' can be any suitable latch that can selectively lock the first and second seat mounts 402' and 404' relative to one another. The first seat mount 402' can define a void 402*c*' therein between the first end 402*a*' and the second end 402*b*'. In one example, the latch 406' can be received within a void 402*c*'. In the latched position, a protrusion 406*a*' of the latch 406' extends out from an opening defined in the second end 402*b*' of the first seat mount 402'. In the unlatched position, the protrusion 406*a*' is retracted at least partially into the first seat mount 402'. The recline mechanism 40' can comprise a biasing member 408', such as a spring or resilient material, that biases latch 406' towards the latched position. The void 402*c*' can be configured such that, when the latch 406' is received therein, the latch 406' translates between the first and second ends 402*a*' and 402*b*' between the unlatched and latched positions.

The second seat mount 404' comprises a first end 404*a*' and a second end 404*b*' that are spaced from one another. The second seat mount 404' is positionally fixed to the first column portion 206, such as to the first shaft portion 212, such that movement (e.g., translation or rotation along any direction) of the first column portion 206 causes a corresponding movement of the second seat mount 404. For example, the second seat mount 404' can be attached to the first column portion 206 such that the second seat mount 404' rotates with the first column portion 206 about the axis of rotation $A_R$ relative to the base 10, and translates with the first column portion 206 relative to the base 10 along an axis of the first column portion 206. The second seat mount 404' can also be attached to the first column portion 206 such that the seat mount 404' does not rotate relative to the first column portion 206 about the recline pivot axis $A_{Recl}$. The second seat mount 404' can define a cavity 404*c*' therein between the first and second ends 404*a*' and 404*b*'. The cavity 404*c*' can be configured to receive the first seat mount 402' therein. The first seat mount 402' can be rotatable within the cavity 404*c*' relative to the second seat mount 404' about the recline pivot axis $A_{Recl}$.

An inner surface of the second end 404*b*' of the second seat mount 404' can define a plurality of recesses 404*d*' therein. The recesses 404*d*' can be offset from one another along a direction that extends from a first side of the second seat mount 404' to a second side of the seat mount 404'. Each recess 404*d*' can correspond to a different one of the recline positions. The protrusion 406*a*' of the latch 406' can be configured to be selectively received in each of the recesses 404*d*' so as to selectively lock the seat 30' in each of the recline positions. The inner surface of the second end 404*b*' can define a plurality of teeth 404*e*' that extend into the cavity 404*c*'. Individual ones of the teeth 404*e*' can be defined between a respective pair of recesses 404*d*'. Each of the teeth 404*e*' can have a lower surface that is ramped, and the protrusion 406*a*' of the latch 406' can have an upper surface that is ramped. The child swing 1 can be configured such that, when a user pulls upwards on the seat 30, the ramped surface of the protrusion 406*a*' rides along the ramped surface of a respective one of the teeth 404*e*' so as to cause the latch 406' to move to the unlatched position. As the seat is moved further upwards, the latch 406' aligns with a corresponding one of the recesses 404*d*', and the biasing member 408' causes the latch 406' to move to the latched position such that the protrusion 406*e*' moves into the recess 404*d*'. When the latch 406' is in the latched position, the seat 30 is prevented from rotating downwards about the recline pivot axis $A_{Recl}$. The child swing 1 can comprise a recline actuator that is configured to be engaged by a caregiver to selectively transition the latch 406 between the latched and unlatched positions. The recline actuator can be implemented in any suitable manner as discussed above in relation to FIGS. 13 and 14.

Removable Leg(s)

In various examples, the present disclosure relates to a coupling mechanism for removably coupling at least one leg, or portion thereof, of a juvenile product such as a swing to another component of the juvenile product. For instance, turning to FIGS. 35, 36, and 37A to 37C, a coupling mechanism is shown according to a first example for removably coupling the at least one leg 102, 104 to the main body 108 of the base 10. One of the main body 108 and the at least one leg 102, 104 can define a plate 106 having an end 106*a* that defines an opening 106*b* therethrough. The end 106*a* of the plate 106 can have a first broadside 106*c* and a second broadside 106*d* that are opposite one another along a select direction $D_S$. In some examples, the end 106*a* of the plate 106 can be planar in a first (e.g., horizontal) plane, and the opening 106*b* can extend through the plate 106 along a direction that is substantially perpendicular to the first plane.

The other of the main body 108 and the at least one leg 102, 104 can comprise a socket 110 configured to receive the end 106*a* of the plate 106 therein. The socket 110 can define an opening shaped as a slot that receives the end 106*a* of the plate 106. The socket 110 can be configured to receive the end 106*a* along an insertion direction $D_I$ and the end 106*a* can be removed along a removal direction $D_R$, opposite the insertion direction $D_I$. The socket 110 can have opposed surfaces 110*a* and 110*b* that face one another. The opposed surfaces 110*a* and 110*b* can abut the broadsides 106*c* and 106*d* of the plate 106, respectively, so as to limit movement of the plate 106 along the select direction $D_S$. In some examples, the socket 110 can be an insert, formed from plastic or other suitable material, that is received in an opening in the other of the main body 108 and the at least one leg 102, 104. In the example shown, each of the at least one leg 102, 104 comprises a socket 110 and the main body 108 comprises a plate end 106*a* for each leg 102, 104. The plate ends 106*a* can extend out of opposing sides of the main body 108. It will be understood that, in alternative examples, each of the at least one leg 102, 104 can comprise a plate end 106*a*, and the main body 108 can comprise a socket 110 for each leg 102, 104. Attaching each leg 102, 104 as discussed above can allow the juncture between the base 10 and the legs 102, 104 to be smooth. This is in contrast to conventional methods in which each leg tube nests inside of the base or vice versa.

Figure 37A:
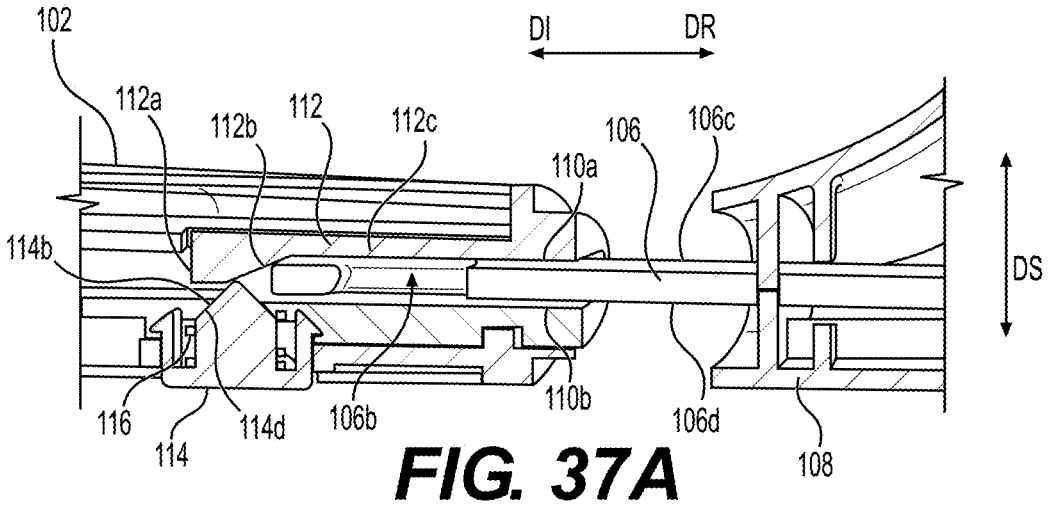
FIGS. 37A to 37C show three cross-sectional views of a portion of the child swing, each illustrating a different stage of coupling one of the legs to the child swing.
Figure 37B:
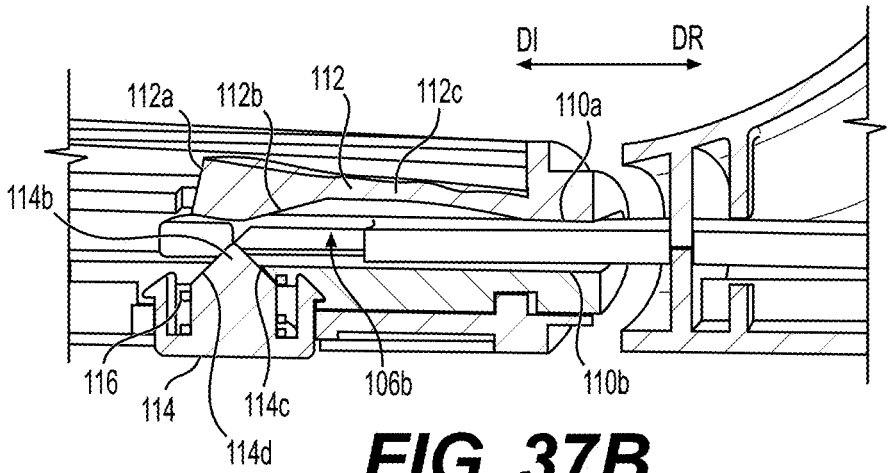
Figure 37C:
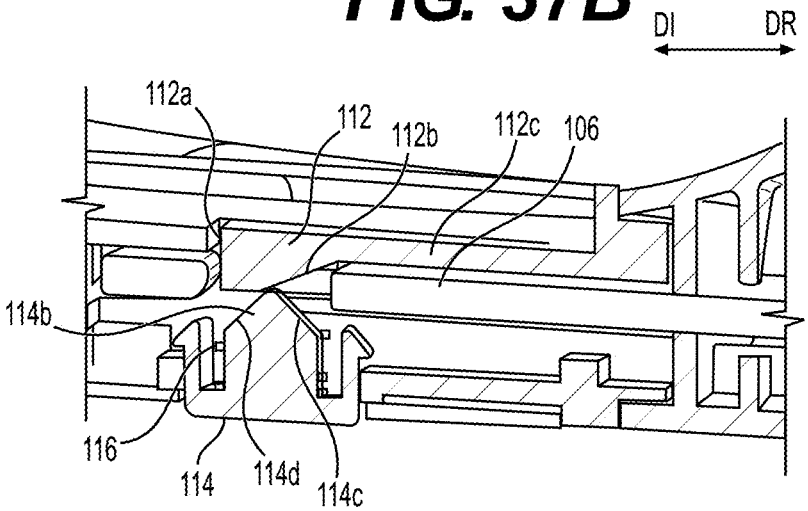

With specific reference to FIGS. 37A to 37C, the child swing 1 can comprise a latch 112 that is configured to transition between a latched configuration and an unlatched configuration. In the latched configuration, the latch 112 engages the end 106*a* of the plate 106 within the socket 110 to releasably lock the plate 106 within the socket 110. In the unlatched configuration, the latch 112 is disengaged from the end 106*a* of the plate 106 to allow the plate 106 to be removed from the socket 110. The latch 112 can comprise a stopping surface 112*a* that is configured to be received in the opening 106*b* of the plate 106 when the latch 112 is in the latched configuration as shown in FIG. 37C. In the latched configuration, the stopping surface 112*a* engages an inner wall of the plate 106 that defines the opening 106*b* so as to prevent the end 106*a* of the plate 106 from being removed from the socket 110 along the removal direction $D_R$ as shown in FIG. 37C. The stopping surface 112*a* can be biased into the latched configuration. For example, the stopping surface 112*a* can be biased into the opening 106*b* when the end 106*a* of the plate 106 is received in the socket 110. The latch 112 can comprise a biasing element such as a spring finger 112*c* that resiliently biases the stopping surface 112*a* into the latched configuration. In other examples (not shown), the biasing element can be a spring or resilient material.

The latch 112 can comprise a ramped surface 112*b* that is spaced from the stopping surface 112*a* along the removal direction $D_R$. The ramped surface 112*b* can facilitate movement of the stopping surface 112*a* from the latched configuration to the unlatched configuration as the end 106*a* of the plate 106 is inserted into the socket 110. For instance, the latch 112 can be configured such that, as the end 106*a* of the plate 106 is inserted into the socket 110, the end 106*a* of the plate 106 engages and rides along the ramped surface 112*b* to cause the stopping surface 112*a* to move to the unlatched configuration as shown in FIGS. 37A and 37B. When the stopping surface 112*a* is aligned with the opening 106*b*, the latch 112 biases the stopping surface 112*a* into the latched configuration in the opening 106*b*.

The child swing 1 can comprise an actuator 114 that is configured to be engaged by a caregiver to move the latch 112 to the unlocked configuration so that the plate 106 can be removed from the socket 110. In some examples, the actuator 114 can be a push button that is configured to move between an unactuated (e.g., extended) position and an actuated (e.g., depressed) position. The actuator 114 can be biased by a biasing element 116 such as a spring or resilient material towards the unactuated position. The actuator 114 can have an outer side 114*a* that is configured to be engaged by a caregiver. The actuator 114 can have an inner side 114*b* that is configured to move the latch 112 to the unlatched configuration. For example, when the actuator 114 is moved to the actuated position, the inner side 114*b* can be configured to extend into the opening 106*b* in the end 106*a* of the plate 106 and engage the latch 112 to move the stopping surface 112*a* out of the opening 106*b*. The stopping surface 112*a* of the latch 112 can extend into a first side of the opening 106*b* when in the latched configuration, and the inner side 114*b* of the actuator 114 can extend into a second side of the opening 106*b*, opposite the first side, when actuated so as to move the stopping surface 112*a* out of the opening 106*b* on the first side.

In some examples, the inner side 114*b* of the actuator 114 can comprise a ramped surface 114*d* that is configured to be engaged by the end 106*a* of the plate 106 when the plate 106 is being removed from the socket 110. In particular, while the actuator 114 is actuated and the inner side 114*b* extends into the opening 106*b* to engage the latch 112, the end 106*a* of the plate 106 engages and rides along the ramped surface 114*d* to cause the actuator 114 to move towards the extended position such that the inner side 114*b* is moved out of the opening 106*b*. In some examples, the inner side 114*b* of the actuator 114 can comprise a ramped surface 114*c* that is configured to be engaged by the end 106*a* of the plate 106 when the end 106*a* is inserted to the socket 110. The end 106*a* of the plate 106 can engage and ride along the ramped surface 114*c* to cause the actuator 114 to move towards the unactuated position.

Turning to FIGS. 42 to 46 and 47A to 47D, a coupling mechanism is shown according to a second example for removably coupling the at least one leg 102, 104 to the main body 108 of the base 10. One of the main body 108 and the at least one leg 102, 104 can define the plate 106, and the other of the main body 108 and the at least one leg 102, 104 can comprise a socket 110' configured to receive the end 106*a* of the plate 106 therein. The socket 110' can define an opening shaped as a slot that receives the end 106*a* of the plate 106. The socket 110' can be configured to receive the end 106*a* along the insertion direction $D_I$ and the end 106*a* can be removed along the removal direction $D_R$. The socket 110' can have opposed surfaces 110*a* and 110*b* that face one another. The opposed surfaces 110*a* and 110*b* can abut the broadsides 106*c* and 106*d* of the plate 106, respectively, so as to limit movement of the plate 106 along the select direction $D_S$. In some examples, the socket 110' can be an insert, formed from plastic or other suitable material, that is received in an opening in the other of the main body 108 and the at least one leg 102, 104. In the example shown, each of the at least one leg 102, 104 comprises a socket 110' and the main body 108 comprises a plate end 106*a* for each leg 102, 104. The plate ends 106*a* can extend out of opposing sides of the main body 108. It will be understood that, in alternative examples, each of the at least one leg 102, 104 can comprise a plate end 106*a*, and the main body 108 can comprise a socket 110' for each leg 102, 104. Attaching each leg 102, 104 as discussed above can allow the juncture between the base 10 and the legs 102, 104 to be smooth. This is in contrast to conventional methods in which each leg tube nests inside of the base or vice versa.

Figure 43:
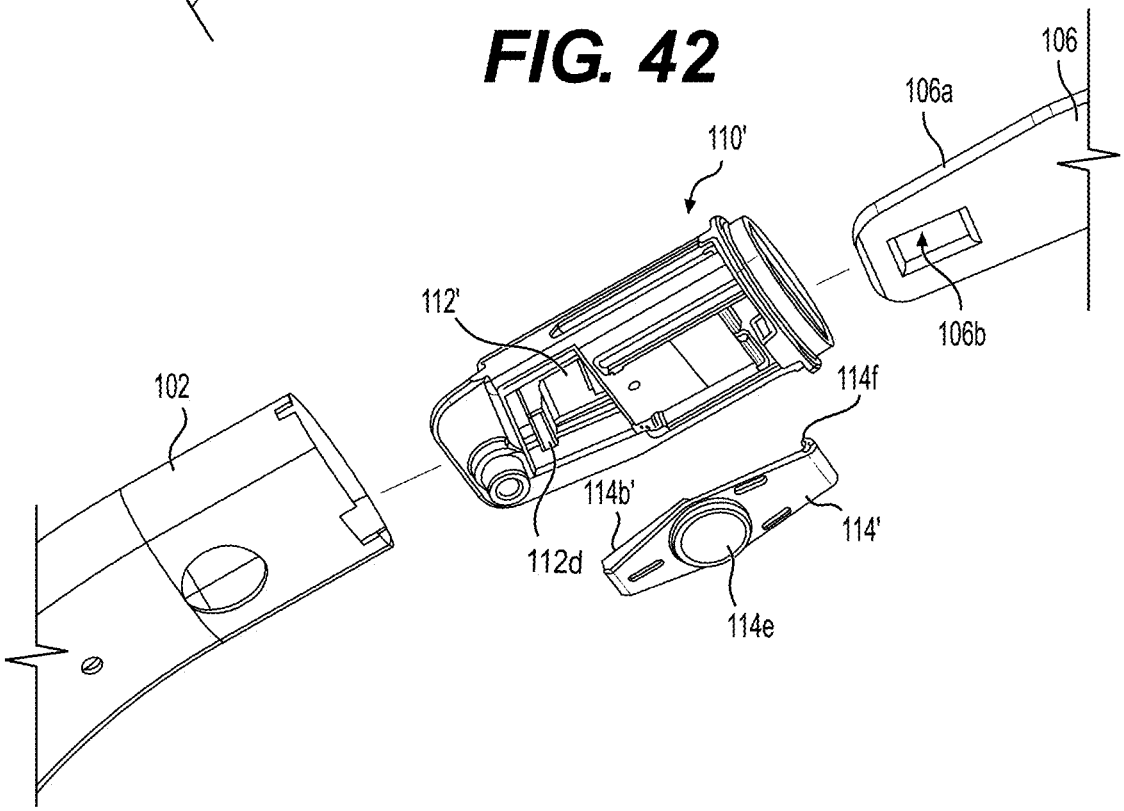
FIG. 43 shows an exploded bottom perspective view of the coupling of FIG. 35, with an insert and actuator of the coupling exploded.
Figure 45:
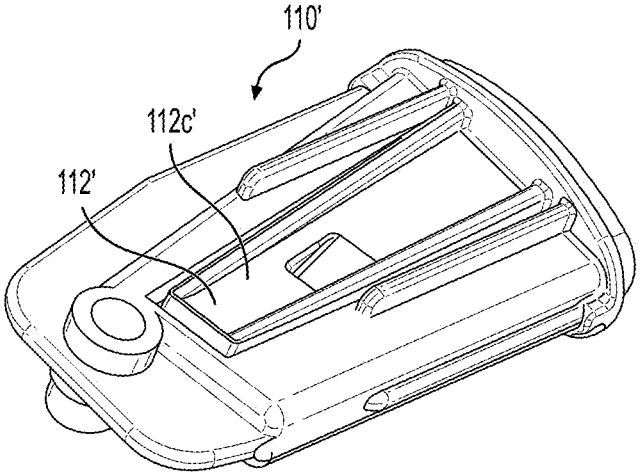
FIG. 45 shows a perspective view of the insert of FIG. 43.
Figure 47A:
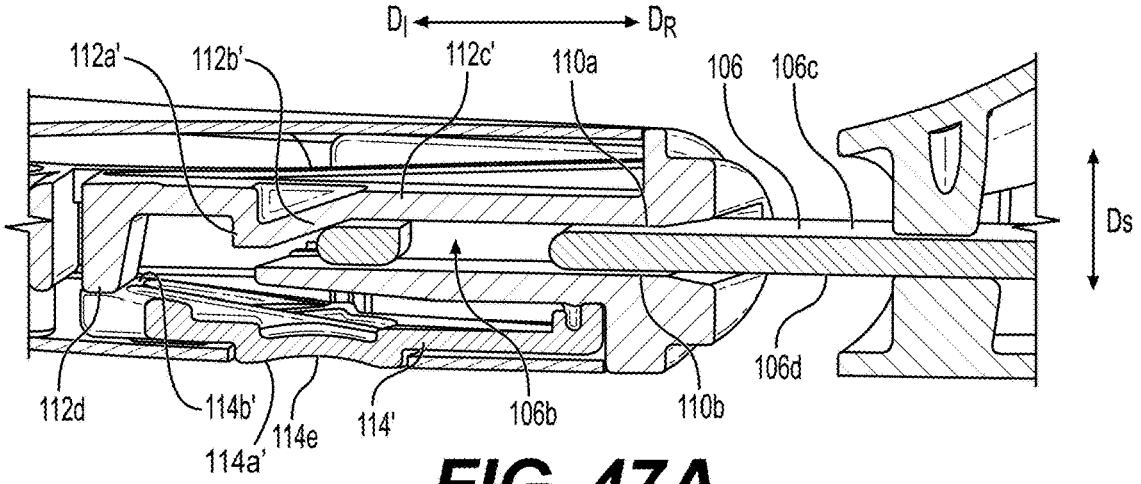
FIGS. 47A to 47C show cross-sectional views of a portion of the child swing, each illustrating a different stage of coupling one of the legs to the child swing.
Figure 47B:
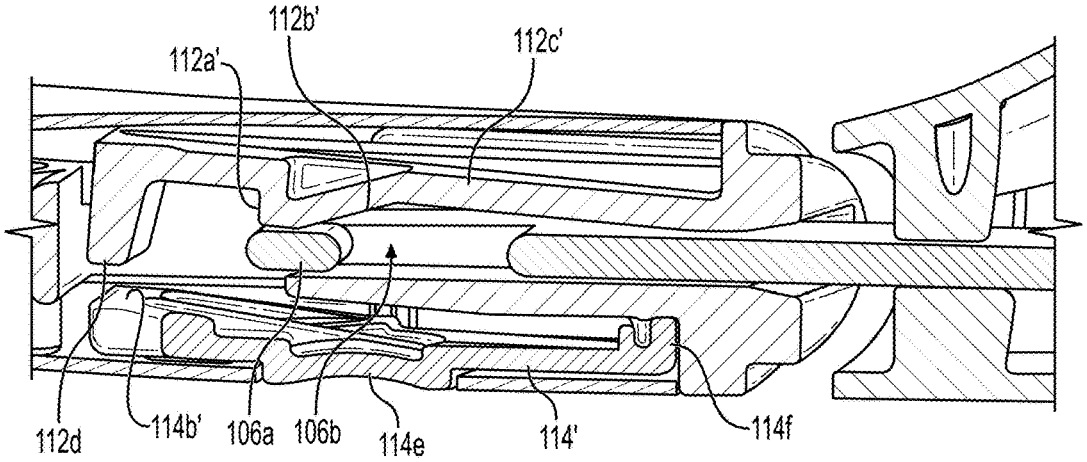
Figure 47C:
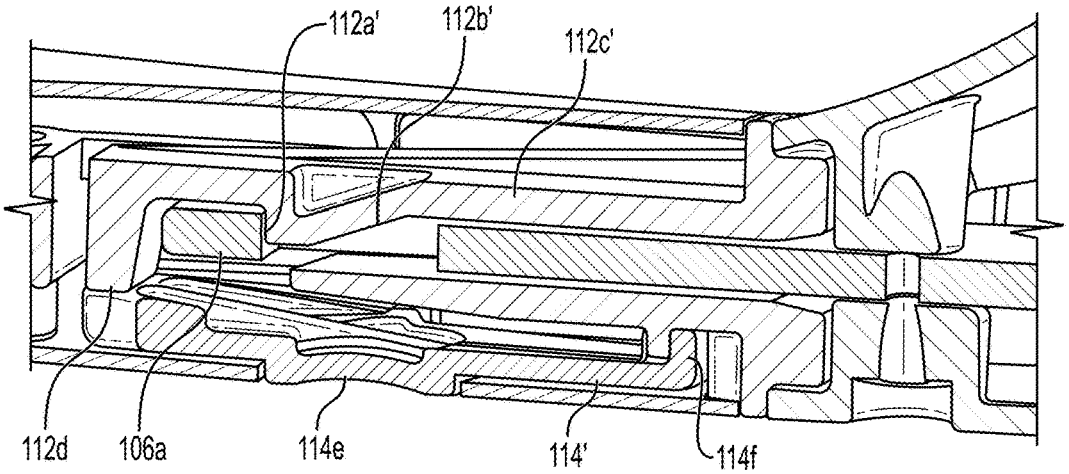
Figure 47D:
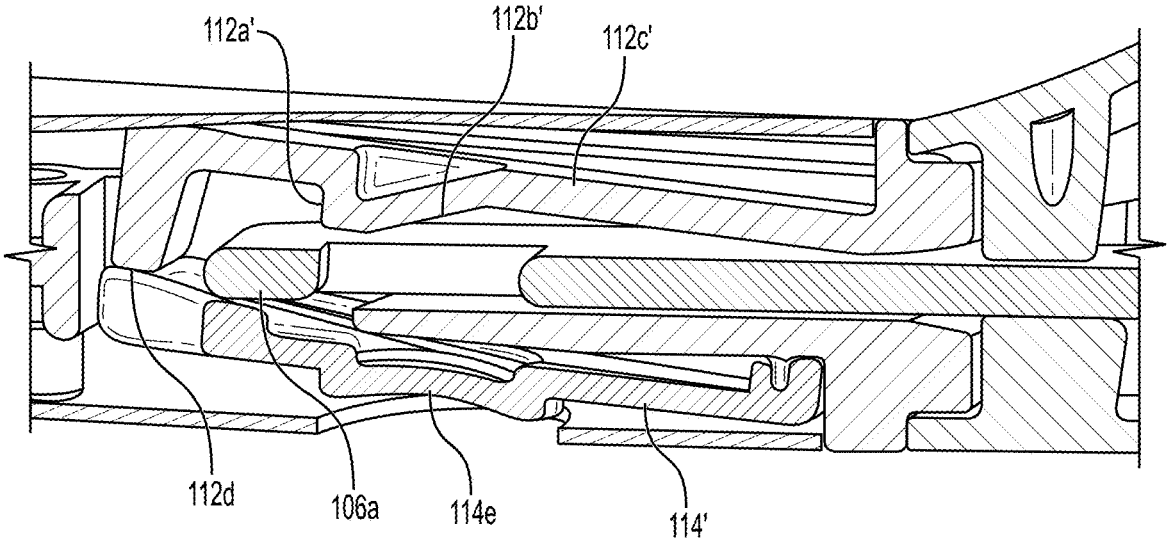
FIGS. 47D and 47E show cross-sectional views of a portion of the child swing, each illustrating a different stage of decoupling one of the legs from the child swing.
Figure 47E:
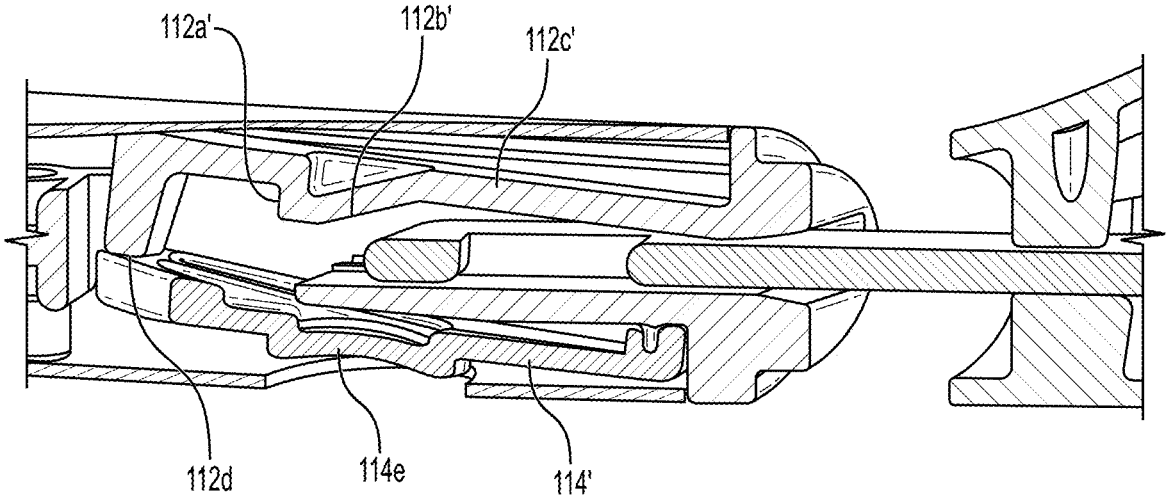

With specific reference to FIGS. 43 and 45, the child swing 1 can comprise a latch 112' that is configured to transition between a latched configuration and an unlatched configuration. In the latched configuration, the latch 112' engages the end 106*a* of the plate 106 within the socket 110' to releasably lock the plate 106 within the socket 110'. In the unlatched configuration, the latch 112' is disengaged from the end 106*a* of the plate 106 to allow the plate 106 to be removed from the socket 110'. The latch 112' can comprise a stopping surface 112*a'* (labeled in FIGS. 47A to 47E) that is configured to be received in the opening 106*b* of the plate 106 when the latch 112' is in the latched configuration as shown in FIG. 47C. In the latched configuration, the stopping surface 112*a'* engages an inner wall of the plate 106 that defines the opening 106*b* so as to prevent the end 106*a* of the plate 106 from being removed from the socket 110' along the removal direction $D_R$ as shown in FIG. 47C. The stopping surface 112*a'* can be biased into the latched configuration. For example, the stopping surface 112*a'* can be biased into the opening 106*b* when the end 106*a* of the plate 106 is received in the socket 110'. The latch 112' can comprise a biasing element such as a spring finger 112*c'* that resiliently biases the stopping surface 112*a'* into the latched configuration. In other examples (not shown), the biasing element can be a spring or resilient material.

The latch 112' can comprise a ramped surface 112*b'* that is spaced from the stopping surface 112*a'* along the removal direction $D_R$. The ramped surface 112*b'* can facilitate movement of the stopping surface 112*a'* from the latched configuration to the unlatched configuration as the end 106*a* of the plate 106 is inserted into the socket 110' as illustrated in FIGS. 47A to 47C. For instance, the latch 112' can be configured such that, as the end 106*a* of the plate 106 is inserted into the socket 110', the end 106*a* of the plate 106 engages and rides along the ramped surface 112*b'* to cause the stopping surface 112*a'* to move to the unlatched configuration as shown in FIGS. 47A and 47B. When the stopping surface 112*a'* is aligned with the opening 106*b*, the latch 112' biases the stopping surface 112*a'* into the latched configuration in the opening 106*b*.

Figure 44:
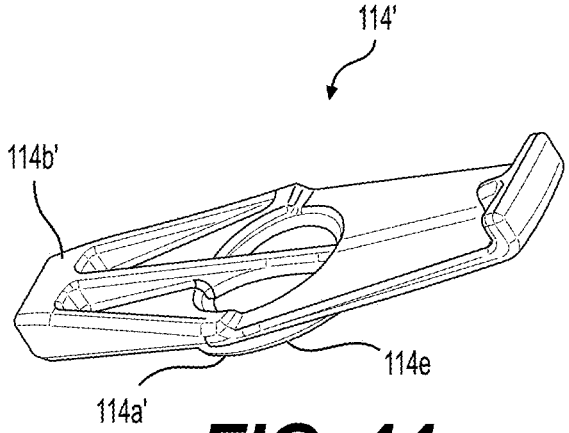
FIG. 44 shows a perspective view of the actuator of FIG. 43.
Figure 46:
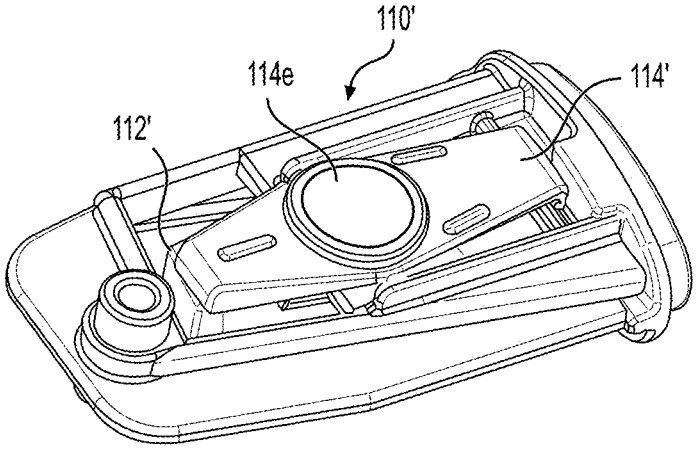
FIG. 46 shows a perspective view of the actuator of FIG. 43 coupled to the insert of FIG. 43.

With reference to FIGS. 43, 44, and 46, the child swing 1 can comprise an actuator 114' that is configured to be engaged by a caregiver to move the latch 112' to the unlocked configuration so that the plate 106 can be removed from the socket 110'. In some examples, the actuator 114' can include a push button 114*e* that is configured to move between an unactuated (e.g., extended) position and an actuated (e.g., depressed) position. The actuator 114' can be biased by an engagement surface 112*d* of the latch 112', such as a surface of the spring finger 114*c'*, towards the unactuated position. The engagement surface 112*d* can be spaced from the stopping surface 112*a'* along the insertion direction $D_I$ such that, when the stopping surface 112*a'* is received in the recess of the plate 106, the end 106*a* of the plate terminates between the stopping surface 112*a'* and the engagement surface 112*d*. The actuator 114' can have an outer side 114*a'* that is configured to be engaged by a caregiver. The actuator 114' can have an inner side 114*b'* that is configured to move the latch 112' to the unlatched configuration. For example, when the actuator 114' is moved to the actuated position, the inner side 114*b'* can be configured to engage the engagement surface 112*d* to move the stopping surface 112*a'* out of the opening 106*b*. The inner side 114*b'* can be configured to engage the engagement surface 112*d* at a first side of the actuator 114', and to provide a pivot 114*f* at a second side of the actuator 114'. Unlike the example of FIGS. 35 to 37C in which the actuator 114 extends into the opening 106*b* in the plate 106 in the actuated position, the actuator 114' of FIGS. 42 to 47E does not extend into the opening 106*b*. Thus, the plate 106 can be coupled to and decoupled from the socket 110' without the actuator 114' interfering with the end 106*a* of the plate 106 as the plate 106 is inserted and removed from the socket 110'. Although the plate 106 has been described as having an opening 106*b* and the latches 112, 112' have been described as having a protrusion (stopping surface 112*a*, 112*a'*) that is received in the opening 106*b*, it will be understood that, in alternative examples, the opening and protrusion can be reversed. For example, the latch 112, 112' can define an opening, and the plate 106 can have a protrusion that is received in the opening when the latch 112, 112' is in the latched position.

Although the plate 106 and sockets 110, 110' have been described in terms of their use with a leg 102, 104 and a main body 108 of the base 10, it will be understood that the plate 106 and sockets 110, 110' can be used to couple other components of a child swing or other juvenile product to one another. For instance, alternative examples may include a juvenile product that is configured to support a child above a floor. The juvenile product can be a swing, a stroller, a highchair, or any other suitable juvenile product having at least one leg. The juvenile product comprises a component, and at least a portion of a leg configured to removably couple to the component. In some examples, the component can be a main body of a base as discussed above. In other examples, the component can be a seat, such as the seat of a highchair. In yet other examples, the at least the portion of the leg can be a first portion of the leg, and the component can be a second portion of the leg. Thus, the plate 106 and sockets 110, 110' can be used to join two portions of a leg, such as two portions of a tubular leg, to one another. One of the components and the at least the portion of the leg defines the plate 106 and the other of the component and the at least the portion of the leg defines a sockets 110, 110' configured to receive an end of the plate therein. The juvenile product can comprise a latch 112 configured to releasably secure the end of the plate within the socket to secure the at least the portion of the leg to the component.

Examples of this disclosure include a method of coupling at least a portion of a leg to a component and a method of decoupling at least a portion of a leg from a component. The method of coupling comprises a step of aligning at least a portion of a leg 102, 104 of the juvenile product with a component (e.g., 108) of the juvenile product, where one of the leg 102, 104 and the component (e.g., 108) comprises a plate 106 and the other of the at least the portion of the leg 102, 104 and the component (e.g., 108) defines a socket 110 or 110'. The method comprises a step (e.g., FIGS. 37A, 47A) of inserting an end 106*a* of the plate 106 into the socket 110 or 110' so as to couple the at least the portion of the leg 102, 104 to the component (e.g., 108). The inserting step can comprise inserting the end 106*a* of the plate 106 into the socket 110 or 110' so that opposed surfaces of the socket 110 or 110' abut first and second broadsides of the plate 106 so as to limit movement of the plate 106 along the select direction $D_S$. The inserting step can comprise causing the end 106*a* of the plate 106 to engage and ride along the ramped surface 112*b*, 112*b'* to cause the stopping surface 112*a*, 112*a'* to move to an unlatched configuration as shown in FIGS. 37B, 47B. The method comprises a step (FIGS. 37C, 47C) of causing a latch 112, 112' to releasably secure the end 106*a* of the plate 106 within the socket 110, 110' to secure the at least the portion of the leg 102, 104 to the component (e.g., 108). The causing step can comprise causing a stopping surface 112*a*, 112*a'* of the latch 112, 112' to be received in the opening 106*b* of the plate 106.

The method of decoupling the plate 106 from the socket 110, 110' can comprise a step (FIG. 47D) of actuating the actuator 114, 114' by, for example, depressing the button 114*e* of the actuator. This in turn causes the stopping surface 112*a*, 112*a'* to be removed from the opening 106*a*.

The method of decoupling the plate 106 can then comprise a step (FIG. 47E) of removing the plate 106 from the socket 110, 110' along the removal direction $D_R$. The stopping surface 112*a*, 112*a'* can then return to the latched position by a biasing force of the spring finger 112*c*, 112*c'*, a spring, or other biasing element.

FIGS. 51-54 illustrate an alternative aspect of a plate 706 and socket 710. The plate 706 can be inserted into and locked within the socket 710 in a substantially similar manner as described above with respect to the plate 106 and the socket 110. The socket 710 is defined by a first socket member 711*a* and a second socket member 711*b*. The first and second socket members 711*a* and 711*b* can be received within an opening of the leg 102, 104. The plate 706 extends from the main body 108. Alternatively, the first and second socket members 711*a* and 711*b* can be inserted into an opening in the main body 108, and the plate 706 can extend from the leg 102, 104.

Figure 54:
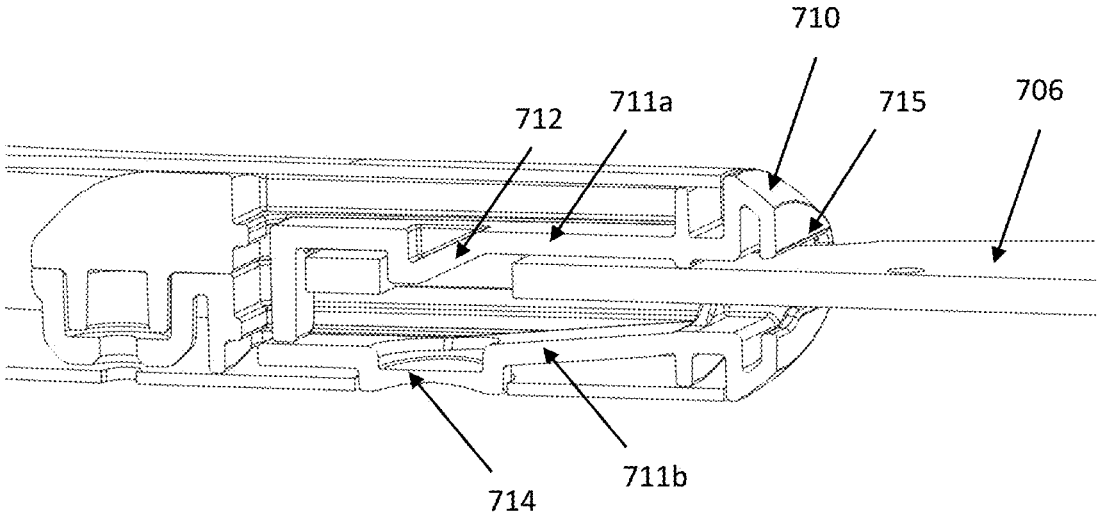
FIGS. 54 and 55 show two cross-sectional views of a portion of the child swing, each illustrating a different stage of coupling one of the legs to the child swing.
Figure 55:
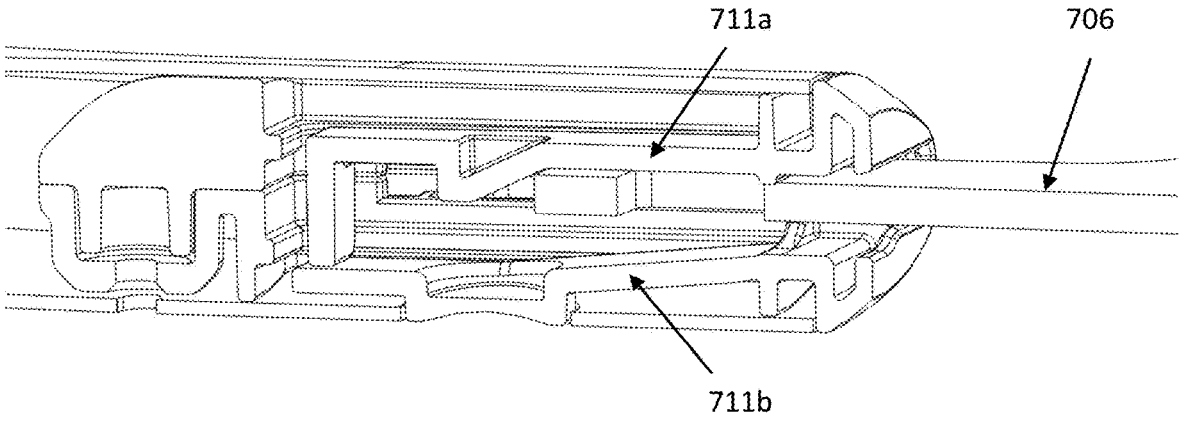

With reference to FIG. 54, the first socket member 711*a* can include a latch 712. The second socket member 711*b* can include an actuator 714. The latch 712 and the actuator 714 can function in a substantially similar manner as the latch 112, 112' and the actuator 114, 114', respectively. Both of the first and second socket members 711*a* and 711*b* define a socket opening 715. For example, the first socket member 711*a* can define a first half of the opening 715, and the second socket member 711*b* can define a second half of the opening 715. The socket opening 715 is sized to receive the plate 706 within.

Compact Storage

Figure 38C:
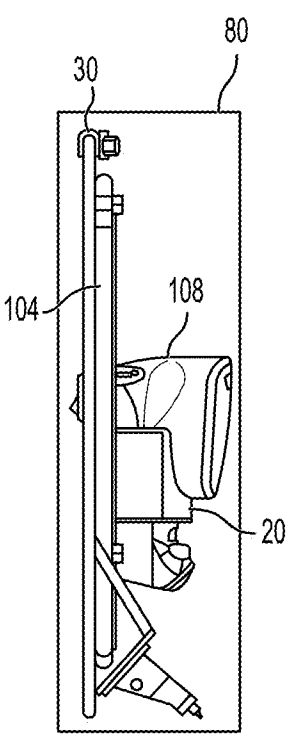
FIG. 38C shows a side plan view of the child swing packaged in the package.
Figure 38B:
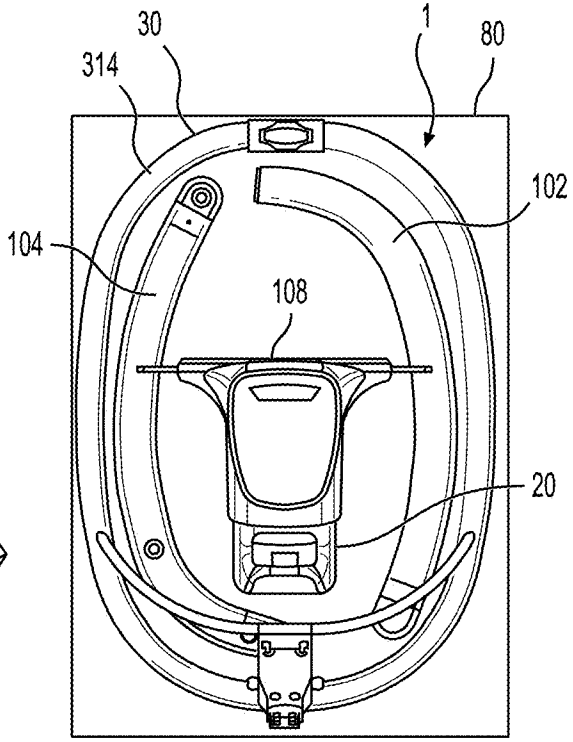
FIG. 38B shows a top plan view of the child swing packaged in the package.
Figure 38A:
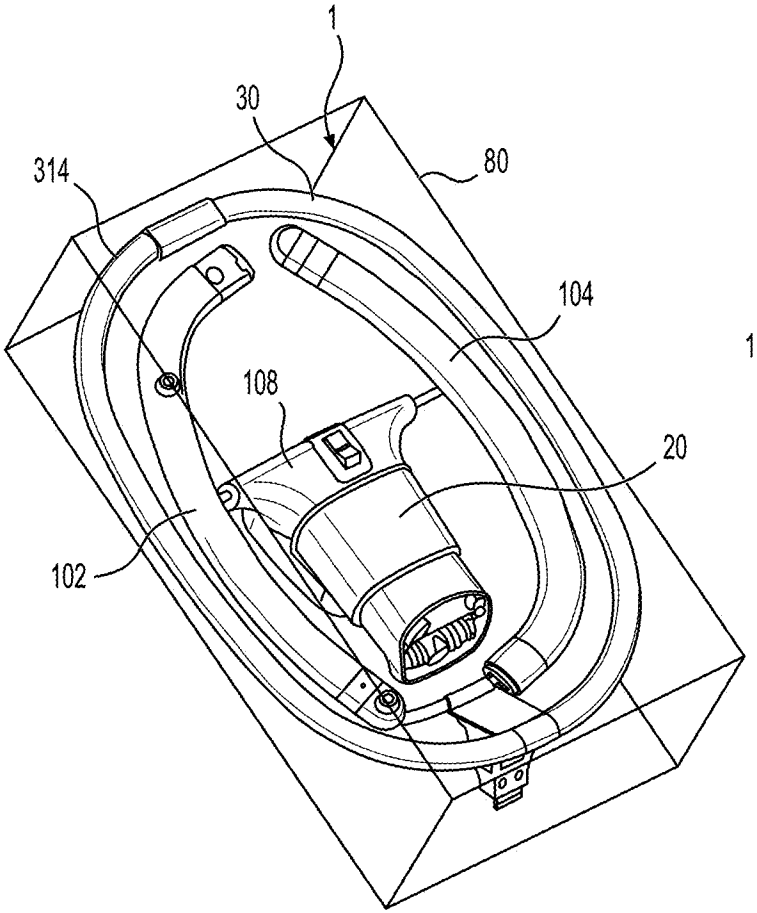
FIG. 38A shows perspective view of the child swing packaged in a package.

Turning to FIGS. 38A to 38C, the child swing 1 can be packaged in a compact manner to limit the amount of packaging needed. In particular, a packaged child swing is shown according to one example. The packaged child swing comprises a package 80, such as a box or other package, and the child swing 1. The child swing 1 comprises a seat 30 configured to support a child, and at least one leg 102, 104 that is configured to removably couple to the child swing 1. The child swing 1 is stowed in the package 80 such that the at least one leg 102, 104 is removed from the child swing 1 and stowed in the seat 30. In some examples, the at least one leg comprises a pair of legs 102 and 104 that are configured to removably couple to the child swing 1, and the child swing 1 is stowed in the package 80 such that the pair of legs 102 and 104 are detached from the child swing 1 and stowed in the seat 30. The child swing 1 can comprise a base 10 having a main body 108 and the at least one leg 102, 104. In such examples, the child swing 1 can be stowed in the package 80 such that the at least one leg 102, 104 is detached from the main body 108 and both the at least one leg 102, 104 and main body 108 are stowed in the seat 30.

The child swing 1 can comprise a column 20 that is configured to support the seat 30 thereon and removably couple to the seat 30. The child swing 1 can be stowed in the package 80 such that both the at least one leg 102, 104 and the column 20 are stowed in the seat 30. The seat 30 can comprise a seat rim 314 and a soft goods seating surface 308 (labeled in FIG. 1), supported by the seat rim 314 within the seat rim 314, and the at least one leg 102, 104 can be stowed in the soft goods seating surface 308 within the seat rim 314. Alternatively, the seat 30 can comprise a rigid seating surface 308 (labeled in FIG. 1) formed from a rigid material, and the at least one leg 102, 104 can be stowed in the rigid seating surface 308.

By stowing the detached at least one leg 102, 104 in the seat 30 within the package 80, the size of the package 80 can be made smaller than if the child swing 1 were stored with the at least one leg 102, 104 still attached to the child swing 1. Similarly, by stowing the main body 108 and/or the column 20 in the seat 30 within the package 80, the size of the package 80 can be made smaller. According to various examples, a method of packaging a child swing 1 comprises a step of stowing the child swing 1 in the package 80 such that at least one leg 102, 104 of the child swing 1 is detached from the child swing 1 and stowed in the seat 30 of the child swing 1. The stowing step can comprise (i) placing the at least one leg 102, 104 in the seat 30, and (ii) placing the seat 30 into the package 80 with the at least one leg 102, 104 disposed in the seat 30. In other examples, the stowing step can comprise placing the seat 30 in the package 80 before placing the at least one leg 102, 104 in the seat 30 within the package. In some examples, the stowing step can comprise placing the child swing 1 in the package 80 such that the pair of legs 102 and 104 are detached from the child swing 1 and stowed in the seat 30. In some examples, the stowing step can comprise stowing the child swing 1 in the package 80 such that the at least one leg 102, 104 is detached from the main body 108 and both the at least one leg 102, 104 and main body 108 are stowed in the seat 30. In some examples, the stowing step can comprise stowing the child swing 1 in the package 80 such that both the at least one leg 102, 104 and the column 20 are stowed in the seat 30. The method can comprise a step of sealing the package 80 with the child swing 1 therein.

Rotation Lock

Figure 39:
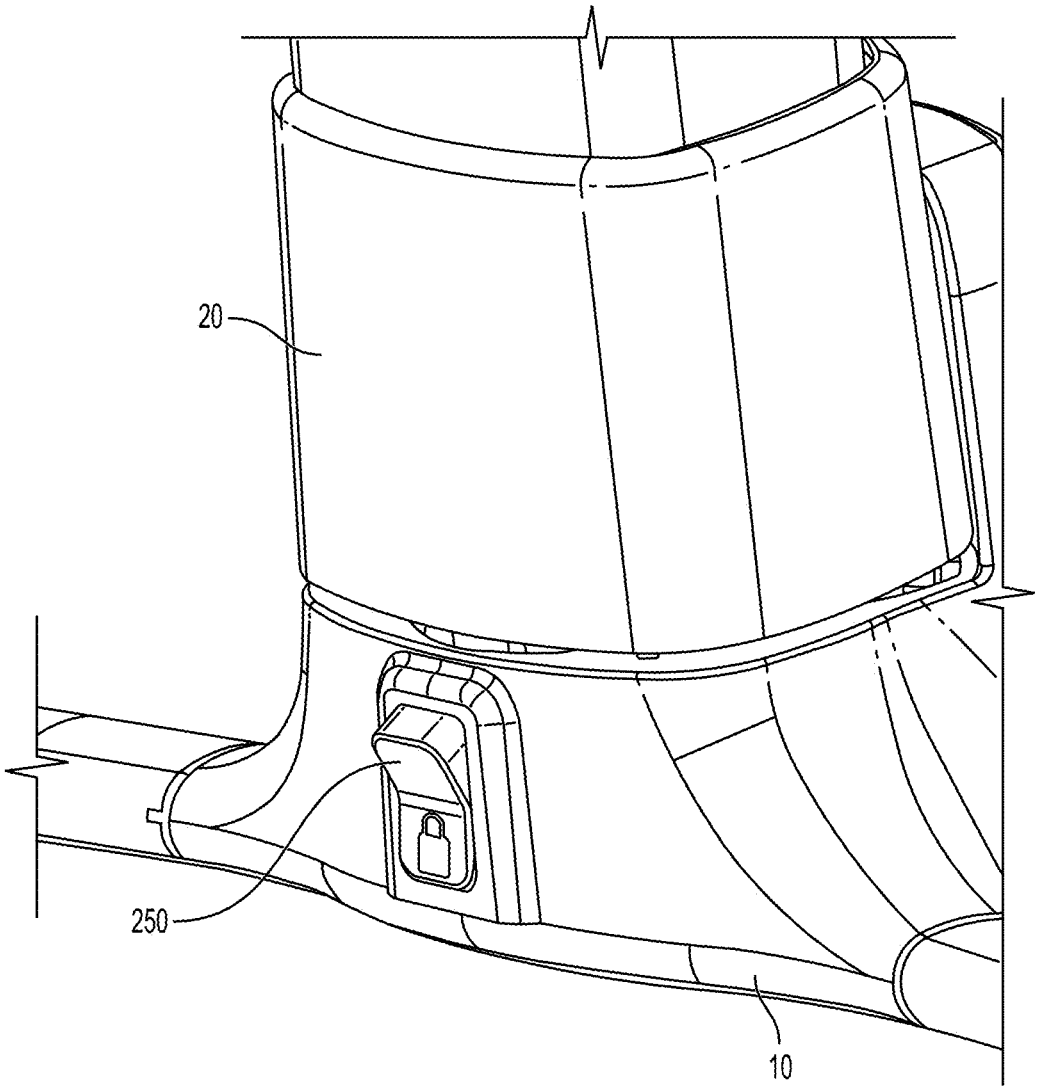
FIG. 39 shows a rear perspective view of a portion of the child swing that includes a rotation lock.
Figures 40A, 40B, 41:
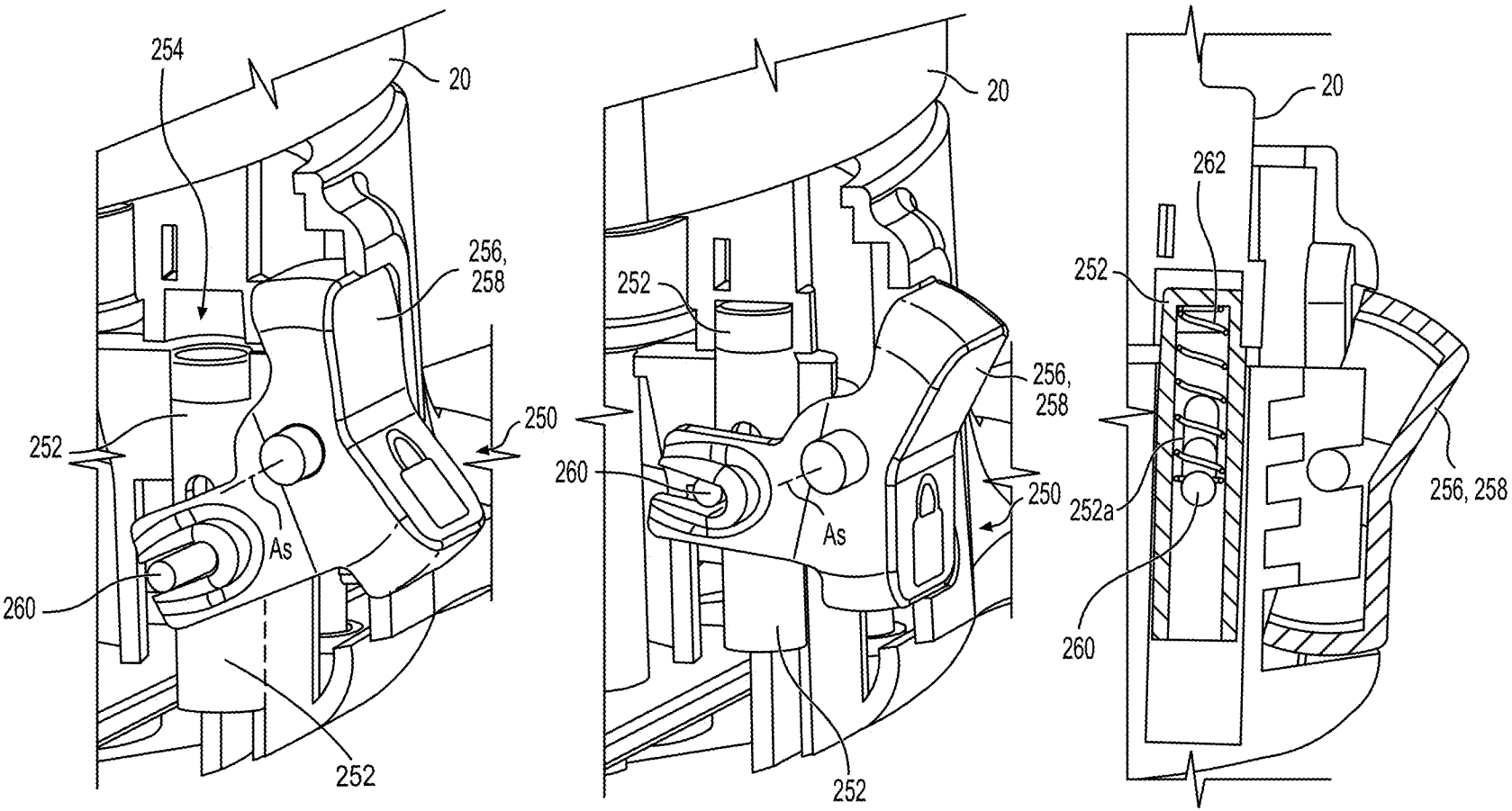
FIG. 40A shows a perspective view of a portion of the child swing 1 with a portion of the outer housing removed to illustrate the rotation lock in an unlocked state.
FIG. 40B shows a perspective view of the portion of the child swing 1 of FIG. 40A with a portion of the outer housing removed to illustrate the rotation lock in a locked state.
FIG. 41 shows a cross-sectional side view of a portion of the child swing that includes the rotation lock in a locked state.
Figure 42:
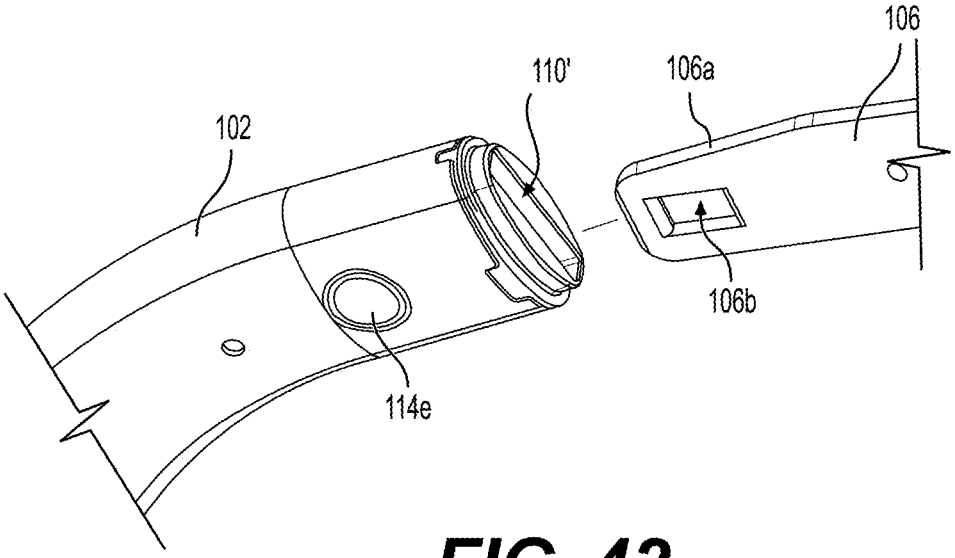
FIG. 42 shows an exploded bottom perspective view of a coupling according to another example for coupling a leg of the child swing to a base of the child swing.

Referring to FIGS. 39 to 41, the child swing 1 can comprise a rotation lock 250 that is configured to be transitioned between a locked state and an unlocked state. In the locked position (e.g., FIG. 40B), the rotation lock 250 can lock a position of the seat 30 relative to the base 10 such that the seat 30 does not rotate. In the unlocked state (e.g., FIG. 40A), the seat 30 can be permitted to rotate. The rotation lock 250 can comprise a lock pin 252 that is configured to be moved between the locked state and the unlocked state. The lock pin 252 can be carried by one of the column 20 and the base 10. The other of the column 20 and the base 10 can define a recess 254 that is configured to receive the lock pin 252. The lock pin 252 and recess 254 can be rotatable relative to one another. Thus, the lock pin 252 can be configured to be received in the recess 254 when the lock pin 252 is moved to the locked state (e.g., FIG. 40B) and when the lock pin 252 is in alignment with the recess 254 with respect to rotation about the axis of rotation $A_R$. The lock pin 252 can be disengaged from the recess 254 when the lock pin 252 is moved to the unlocked state (e.g., FIG. 40A). In the example shown, the lock pin 252 is carried by the base 10 and the recess 254 is defined by the column 20. However, it will be understood that the lock pin 252 could alternatively be carried by the column 20 and the recess 254 could alternatively be defined by the base 10.

The rotation lock 250 can comprise an actuator 256 that is configured to be transitioned between an unactuated state and an actuated state. In the unactuated state, the actuator 256 causes the lock pin 252 to be in the unlocked state. In the actuated state, the actuator 256 biases the lock pin 252 towards the locked state. The actuator 256 can comprise a switch 258 that can be engaged by a caregiver to move the rotation lock 250 between the locked and unlocked states. In one example, the switch 258 can be a rocker switch that is configured to rotate about a pivot axis $A_S$ to transition the lock pin 252 between the locked and unlocked states. The switch 258 can comprise an actuator pin 260 that engages the lock pin 252 to move the lock pin 252 between the locked and unlocked states.

With reference to FIG. 41, the rotation lock 250 can be configured such that, when the actuator 256 is moved to the actuated state, the lock pin 252 is biased towards the locked state by a biasing element 262, such as a spring or resilient material, but does not move to the locked state until the lock pin 252 and recess 254 are aligned. Once the lock pin 252 and recess 254 are aligned, the biasing element 262 moves the lock pin 252 into the recess 254. For instance, the actuator pin 260 can be received in a slot 252*a* defined in the lock pin 252. When the actuator 256 is in the unactuated state, the actuator pin 260 engages and interferes with an end of the slot 252*a* to prevent the lock pin 252 from translating to the locked state. When the actuator 256 is in the actuated state, the interference is removed. The biasing element 262 can bias the lock pin 252 towards the locked state (upwards in FIG. 41). When the lock pin 252 and recess 254 are aligned, the biasing element 262 can move the actuator pin 260 to the locked position shown in FIG. 41.

Vibration Device

Figure 48:
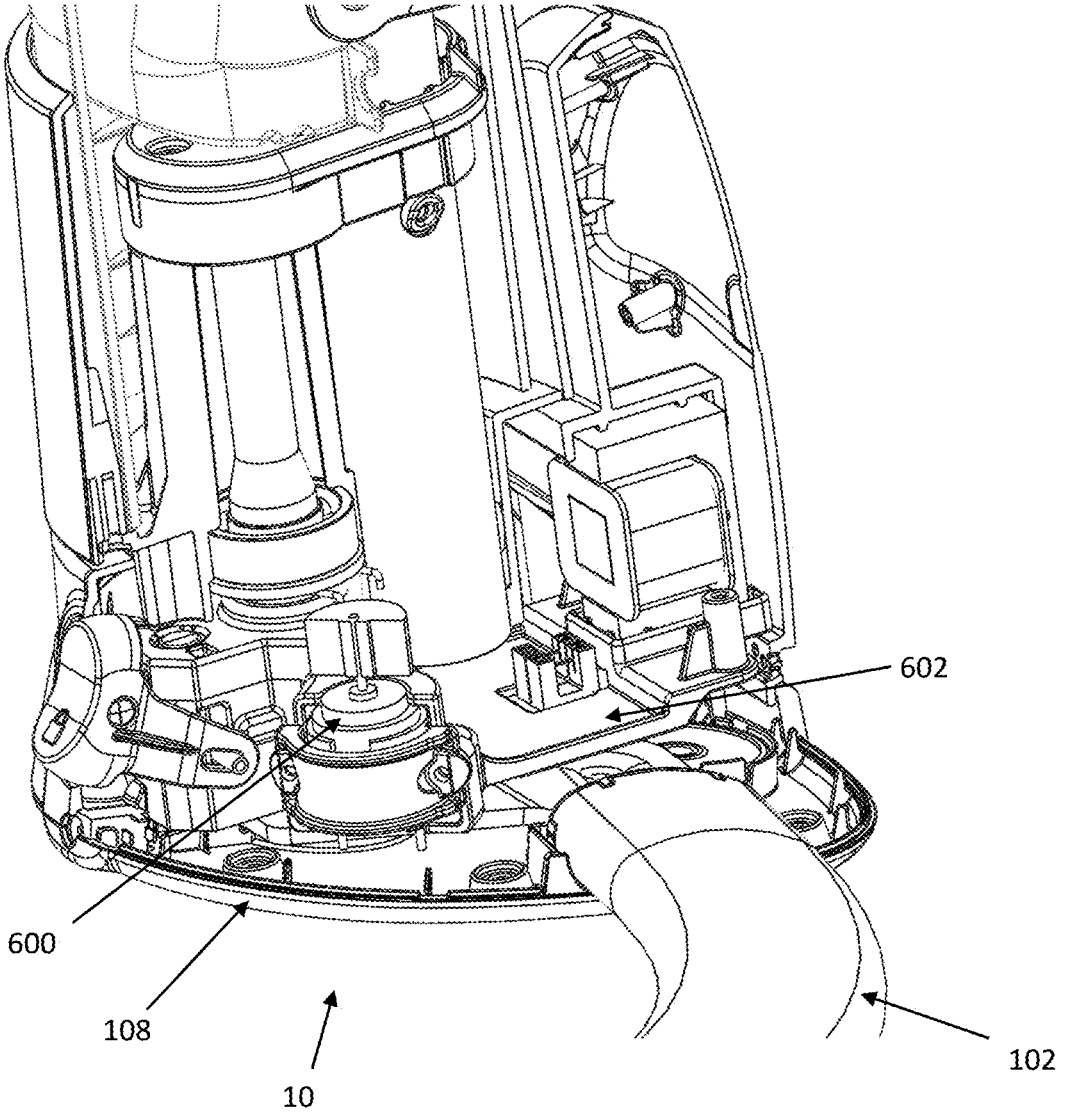
FIGS. 48-50 show perspective views of a vibration device, according to aspects of this disclosure.
Figure 49:
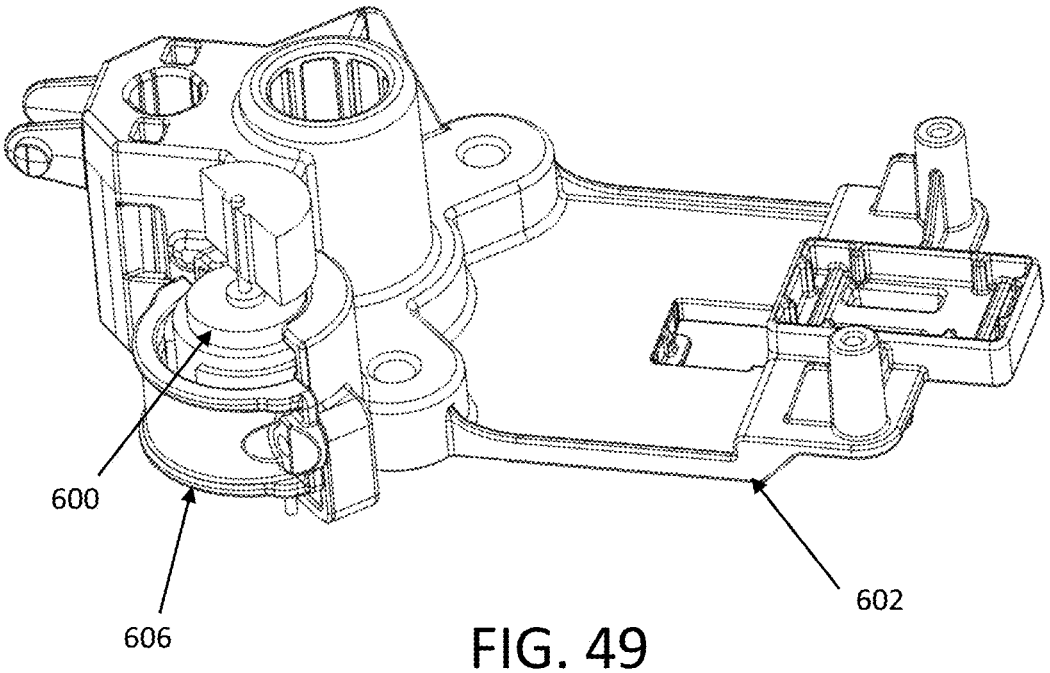
Figure 50:
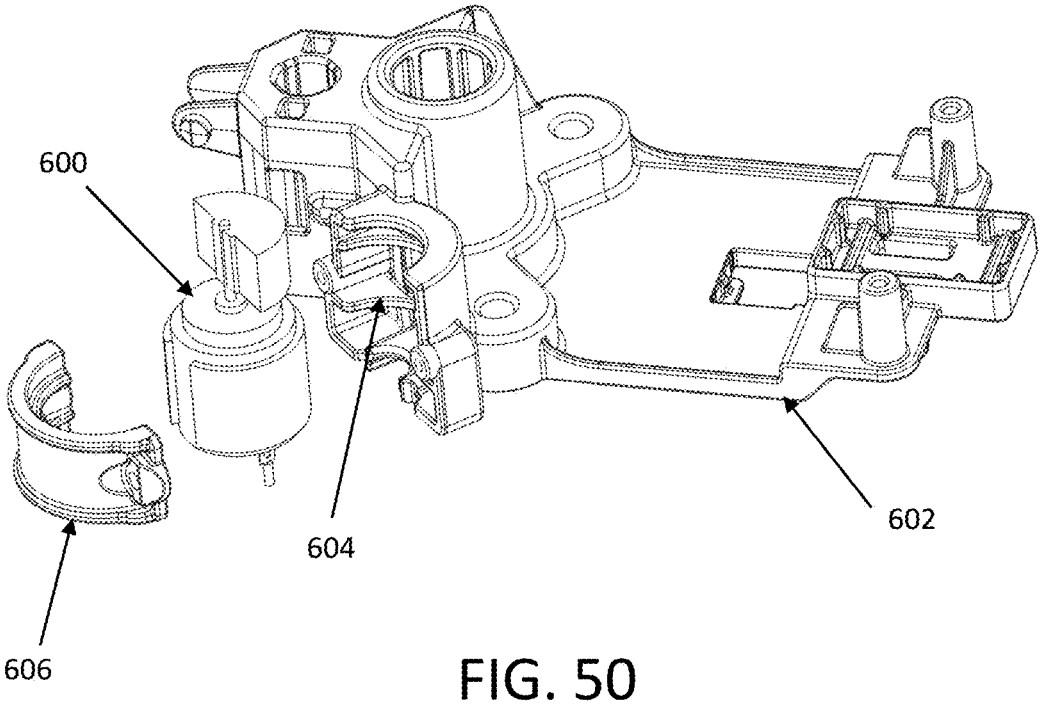
Figure 51:
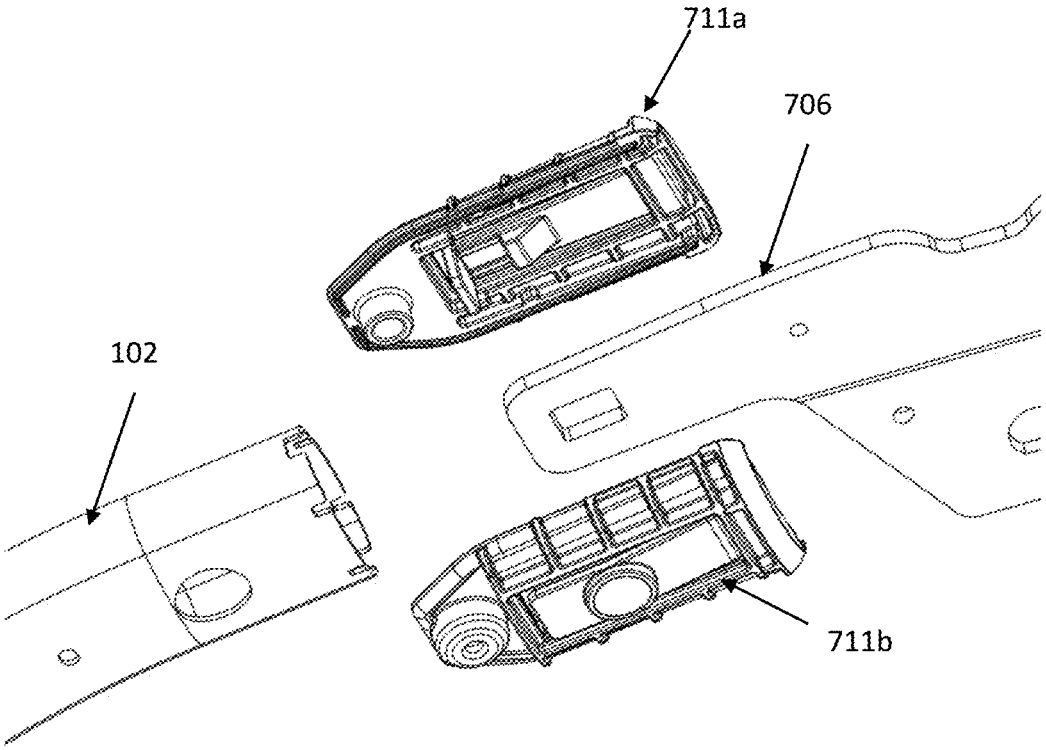
FIG. 51 shows an exploded bottom perspective view of a coupling according to another example for coupling a leg of the child swing to a base of the child swing.
Figure 52:
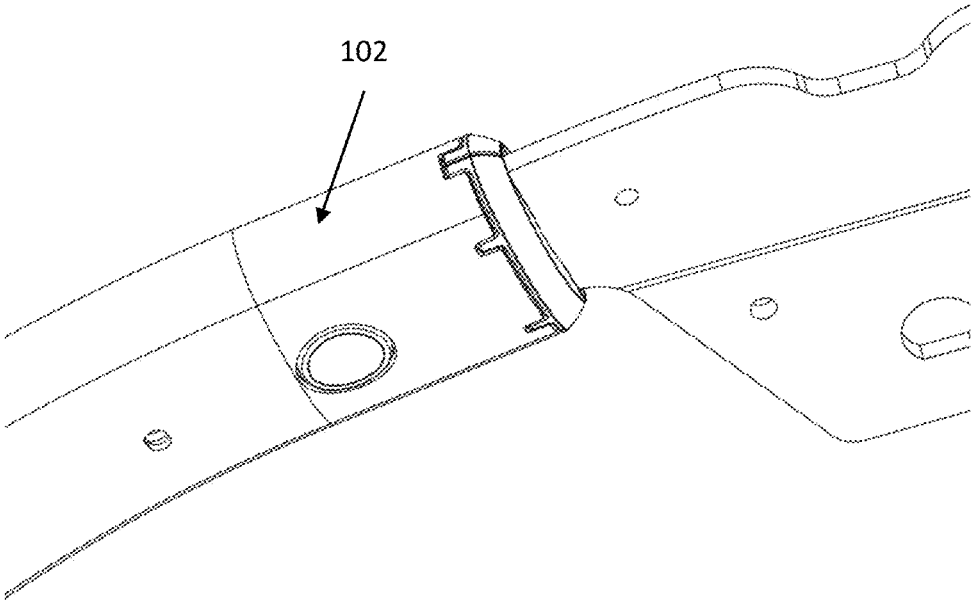
FIG. 52 shows bottom perspective view of the coupling of FIG. 51 with the leg coupled to the base.
Figure 53:
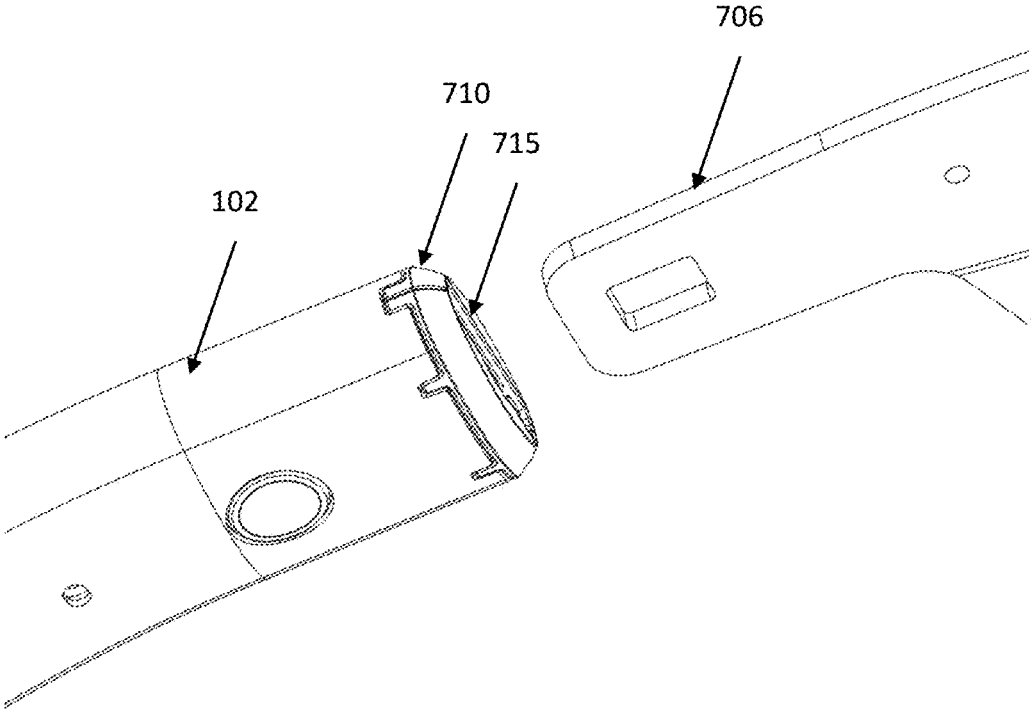
FIG. 53 shows an exploded bottom perspective view of the coupling shown in FIG. 52.

FIGS. 48-50 illustrate a vibration device 600 integrated into portions of the child swing 1, according to aspects of this disclosure. In some examples, the vibration device 600 is configured to cause the seat 30 to vibrate. The vibration device 600 can be any suitable vibration device, including an eccentric rotating mass (ERM) motor (e.g. small unbalanced mass attached to a DC motor axle that creates a displacement force when rotating), a linear resonant actuator (LRA) (e.g. a small internal mass attached to a spring that vibrates in a reciprocating linear motion with an applied AC signal), combinations thereof, or still other vibration devices capable of generating a vibration force. The child swing 1 can include one or more vibration devices 600 connected thereto.

The vibration device 600 can be connected to the base 10 of the child swing 1. In an aspect, the vibration device 600 is connected directly to the main body 108 of the base 10. Alternatively, the base 10 can include a vibration mount member 602. The vibration mount member 602 can be connected to the main body 108. The vibration device 600 can be connected to the vibration mount member 602. The connection between the vibration device 600 and the vibration mount member 602 is such that vibration force generated by the vibration device 600 is transmitted to the base 10 via the vibration mount member 602. The vibration mount member 602 can be positioned within the main body 108.

The vibration mount member 602 can define a cavity 604 sized to receive the vibration device 600 at least partially within. The vibration device 600 can be positioned within the cavity 604 such that an outer surface of the vibration device is in contact with an inner surface defining the cavity 604. The vibration device 600 can be secured within the cavity 604 by a mount plate 606. The mount plate 606 can be connected to the vibration mount member 602 such that the vibration device 600 is substantially rigidly connected to the vibration mount member 602. The vibration device 600 can be removed from the cavity 604 by removing the mount plate 606.

The vibration device 600 can be configured to receive signals from the controller 2102 for control of the vibration device 600. For example, the vibration device 600 can be configured to receive signals from the controller 2102 to transition the vibration device 600 between an on-state and an off-state, to increase an intensity of vibration, to decrease an intensity of vibration, or to control other functions of the vibration device 600.

During operation of the vibration device 600, vibration is transmitted by the vibration device 600 to the seat 30. For example, when the vibration device 600 is in the on-state, the vibration generated from the vibration device 600 can be transmitted to the base 10, from the base 10 to the column 20, and from the column 20 to the seat 30. The vibration can be transmitted from the vibration device 600 to the seat 30 when the seat 30 is in both the lowered position and the raised position.

The location of the vibration device 600 in the base 10 of the child swing 1 allows the vibration device 600 to be powered by the same power source as the controller 2102 (e.g. the power supply 2104). In conventional vibration devices for child swings, the vibration device generally requires a separate power source based on the position of the vibration device on the swing. For example, conventional vibration devices are generally attached directly on the swing itself. Therefore, to power a conventional vibration device would require running wires through the child swing 1, making it more complicated to manufacture and more prone to power issues.

The vibration device 600 can also be positioned on the base 10 adjacent to the column 20. The close proximity to the column 20 can more effectively transmit the vibration from the base 10 to the swing 30.

Described below and shown in FIGS. 56A-62 are further exemplary embodiments according to the present disclosure. The exemplary embodiments describe a toy bar for a child holding device comprising a locking mechanism that allows the toy bar to be rotated between a use position, where the toy bar is positioned over the child, and a stowed position, where the toy bar is positioned away from the child.

Those skilled in the art will understand that, although the embodiments describe the toy bar device as attached to a child swing, the toy bar device may be attached to any device that holds a child such as a crib, bassinet, child seat, playpen, stroller, etc. and that the operation of the toy bar device would be the same in regard to all of these child holding devices. Thus, the description of a child swing as the child holding device is exemplary only.

According to one aspect, the toy bar device includes a base that is removably coupled to the child holding device and a toy bar that extends from the base and is rotatably coupled thereto. The toy bar includes a locking receptacle while the base includes a locking plate configured to snap together with the locking receptacle so that, in a desired alignment, the locking plate and locking receptacle place the toy bar device in a locking configuration in which the toy bar is held in a desired rotational orientation relative to a child holding device to which the base has been attached. For example, when the toy bar device is in a first position (e.g., so that a toy attached to the toy bar is directly over a child received in the child holding device), interaction between one of the recesses and a selected one of the locking protrusions holds the toy bar in the first position. When a user desires to move the toy bar to a second position (e.g., with the toy bar rotated away from the first position so that the child and/or child seat is accessible), the user may rotate the toy bar away from the first position as will be described in more detail below.

As will be described in more detail below, the recesses of the locking receptacle are sized and shaped to receive one or more of the locking protrusions of the locking plate to hold the toy bar in a desired orientation relative to a base and to the child holding device to which the base is attached. In one embodiment, when the toy bar is in the first position (or use position), each of first and second locking protrusions is aligned with and received in a corresponding one of first and second locking recesses to provide a securely locked arrangement in which the toy bar overhangs the swing. To transition the toy bar into a second position (or stowed position), rotational force is applied by a user to the toy bar (relative to the base that is attached to the swing) to rotate the locking recesses out of alignment with the locking protrusions.

As will be described in greater detail below, the base is coupled to the toy bar so that the locking plate and the locking receptacle are held tightly in contact with one another. The locking protrusions are positioned on sides of the locking plate cantilevered outward from a central hub of the locking plate so that, when the toy bar is rotated, the tight contact between the locking plate and the locking receptacle force surfaces of the protrusions into contact with beveled sides of the locking recesses. This causes the cantilevered sides of the locking plate to deflect away from the locking receptacle (i.e., toward an attachment of the base to the child holding device) allowing the locking receptacle, and the toy bar coupled thereto, to continue rotating into the stowed position. As would be understood by those skilled in the art, in the stowed position, one or more of the locking protrusions may be received in a locking recess different from the locking recess within which it was received in the use position. This permits the toy bar device to be locked in the stowed position in a manner similar to that described for the use position. This is optional as the toy bar device may alternatively be held in the stowed position (or any position rotated away from the use position) by friction between the toy bar and the base.

In a similar manner, to transition the toy bar back into the use position, the user rotates the toy bar relative to the base in the reverse direction to bring the protrusions back into contact with the locking receptacle and deflect the cantilevered sides of the locking plate away from the locking receptacle until the protrusions are once again aligned with the locking recesses and the sides of the locking plate return to the relaxed (non-deflected) position. Those skilled in the art will understand that outer edges of the locking plate and the locking receptacle may include similarly matched bevels so that the plate and receptacle may slide over one another easily back to the use position.

In some embodiments, the base may comprise a clip sized and shaped to be removably attached to a frame of the swing. The base includes the locking plate disposed therein or formed therewith so that the locking plate is fixed relative to the clip. When a clip is used, the clip may be sized and shaped to receive a feature of the frame of the swing such as an actuator or an ergonomic feature such as a handgrip, etc. to ensure that the toy bar device is mounted to the swing in a desired position. In this embodiment, the feature of the frame of the swing is a recline actuator of the child swing although those skilled in the art will understand that this is exemplary only.

The toy bar device can be used with any suitable child holding device, one example of which is the swing shown in the Figures below. In other embodiments, the toy bar device can be used on other child support devices, such as on the rail of a stroller, child vehicle seat, playard, bassinet, jumper, or rocker. The toy bar may be used on a device that is supported on the ground, for example a swing attached to a base as shown below, or on a device that is suspended, for example a swing attached to an overhead support.

Figure 56A:
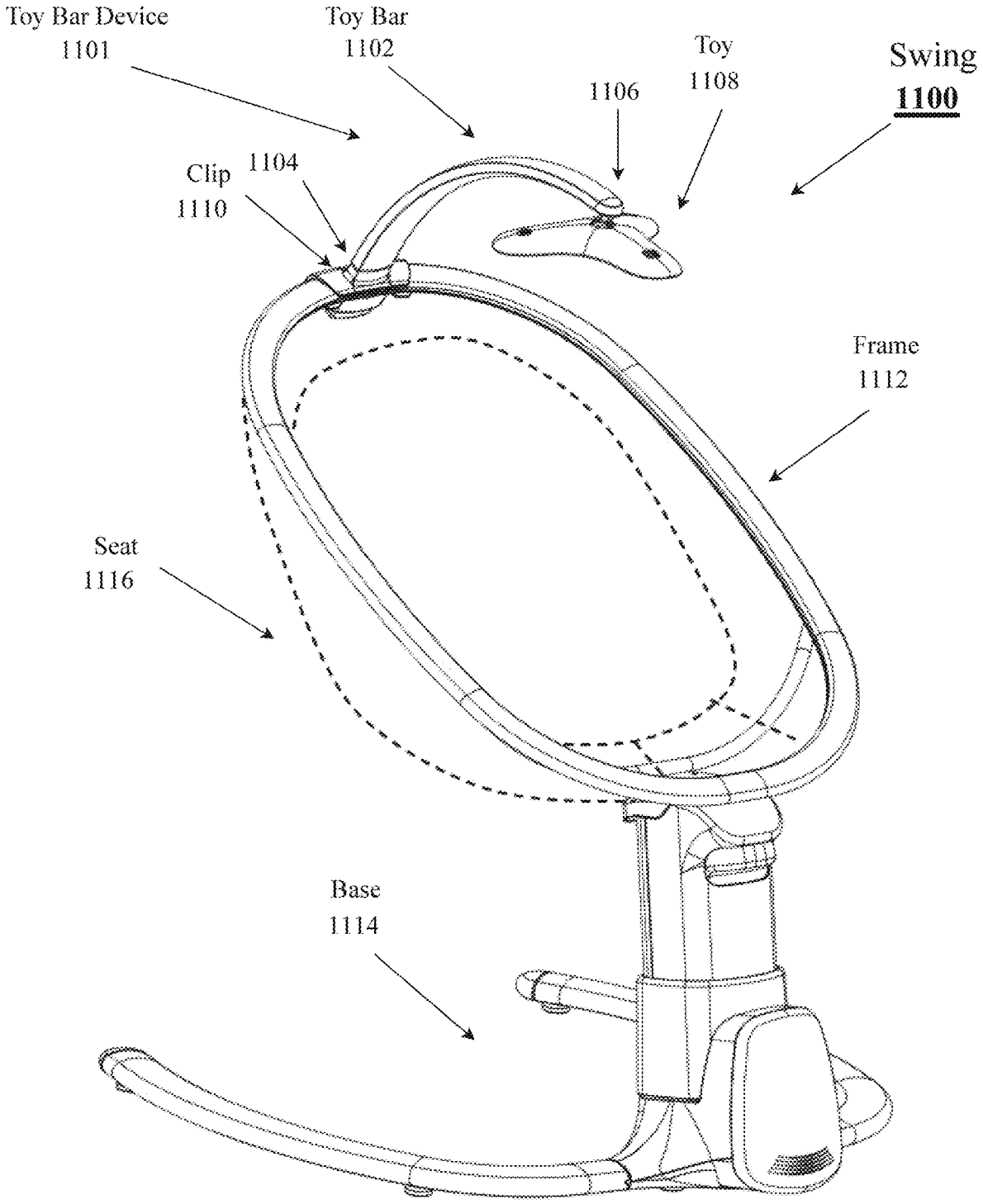
FIGS. 56A and 56B show an exemplary child swing comprising a rotatable toy bar device according to various exemplary embodiments described herein.
Figure 56B:
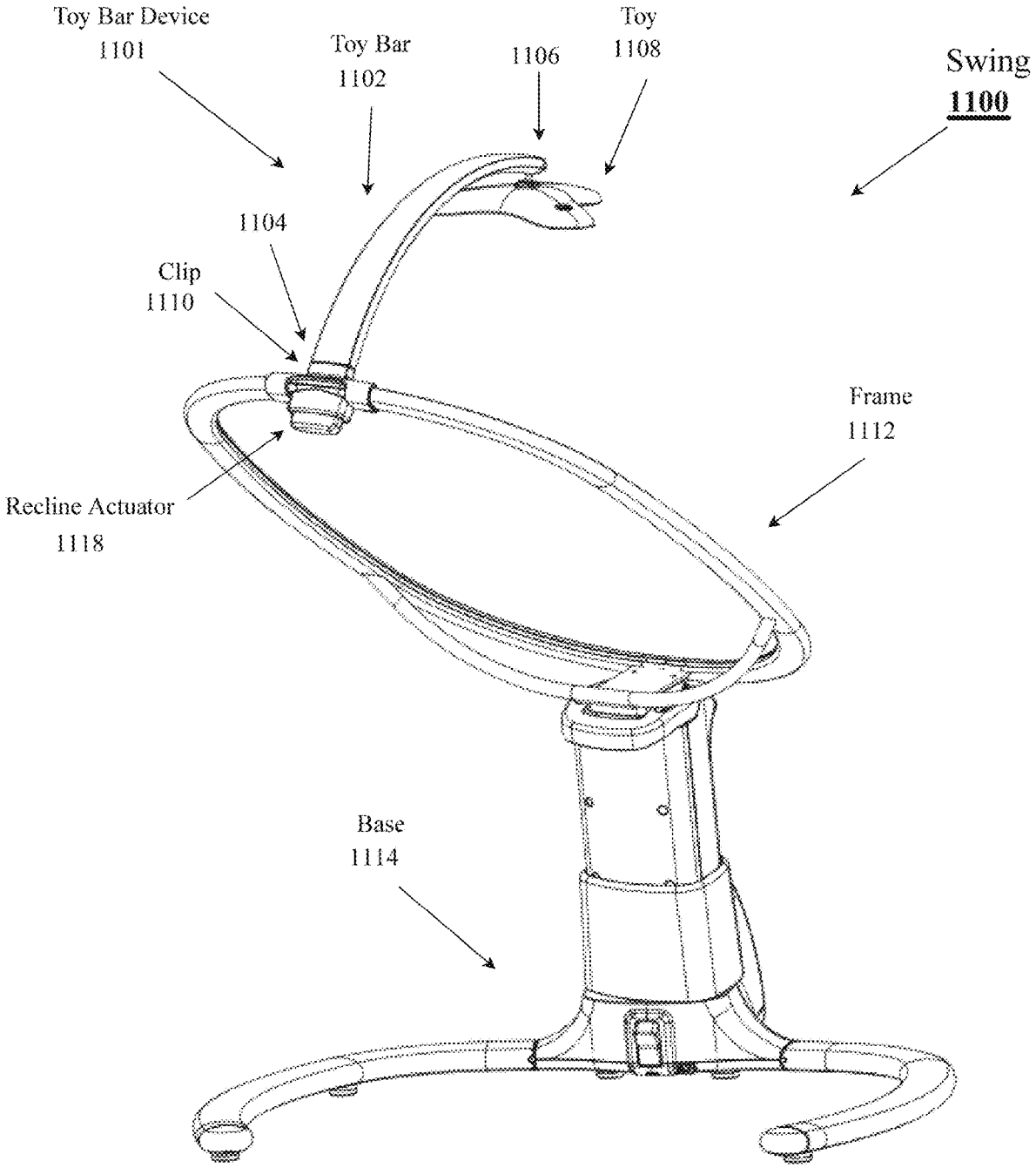

FIGS. 56A-56B show an exemplary child swing 1100 comprising a rotatable toy bar device 1101 according to various exemplary embodiments described herein. The toy bar device 1101 includes a clip 1110 and a toy bar 1102 that extends between a first end 1104 (attached to the clip 1110) and a cantilevered second end 1106 to which a child toy 1108 may be attached, as shown in greater detail in FIGS. 57A-57*b* and 58A-58C. The toy bar 1102 may be shaped in a variety of ways depending on the size and shape of the child holding device which it is to be implemented. For example, as shown in FIGS. 56A-56B, the toy bar 1102 may be curved so that the second end 1106 of the toy bar 1102, and the toy 1108 attached thereto, are located in a position that may be viewed and interacted with as desired by a child seated in the swing 1100. In other embodiments, for example when the toy bar 1102 is attached to a differently sized or shaped swing, or a different type of child support device, the toy bar 1102 may be larger, smaller or shaped differently so that the toy 1108 will be desirably positioned for interaction by a child seated in the child support device.

Figure 59A:
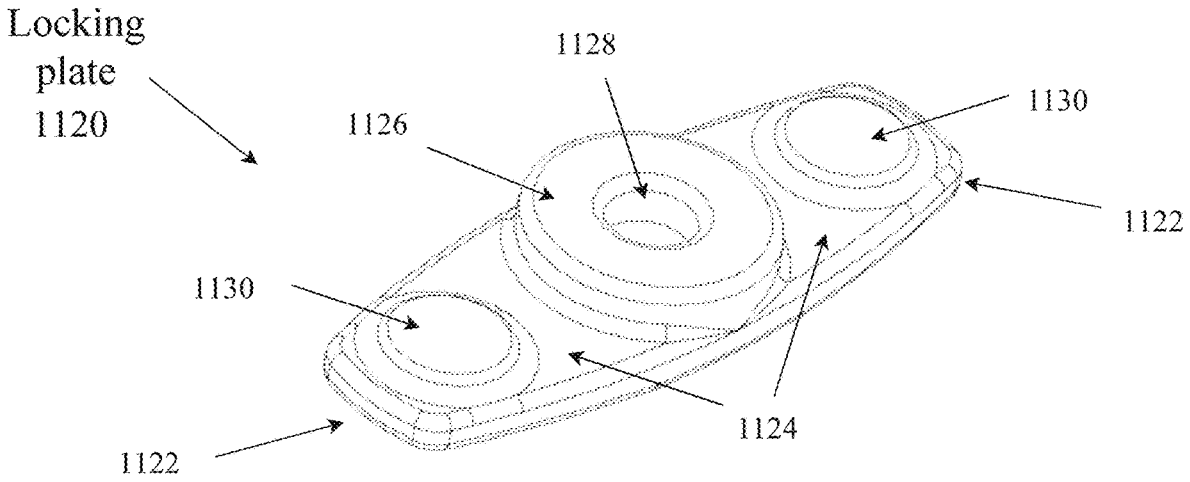
FIGS. 59A-59B show the locking plate for the rotatable toy bar device according to various exemplary embodiments described herein.
Figure 59B:
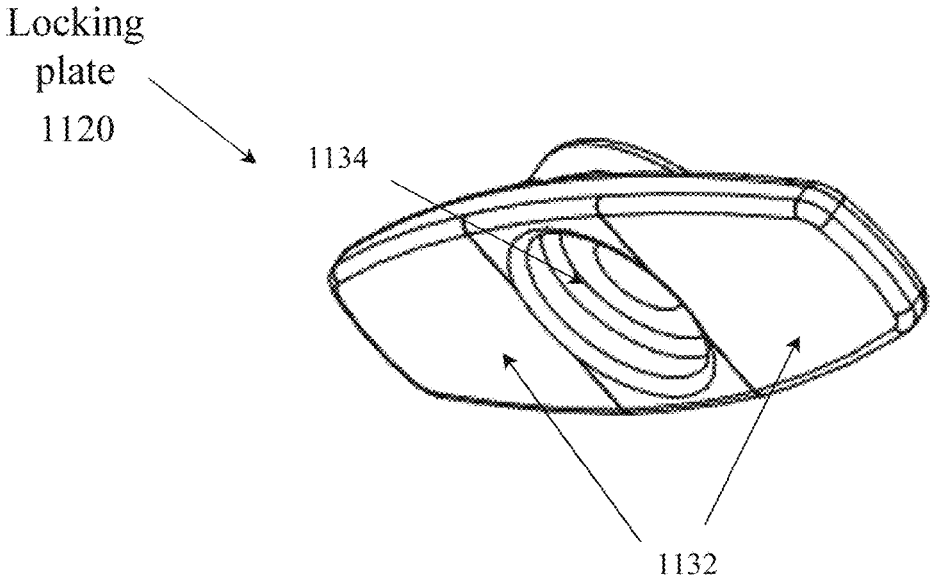
Figure 60A:
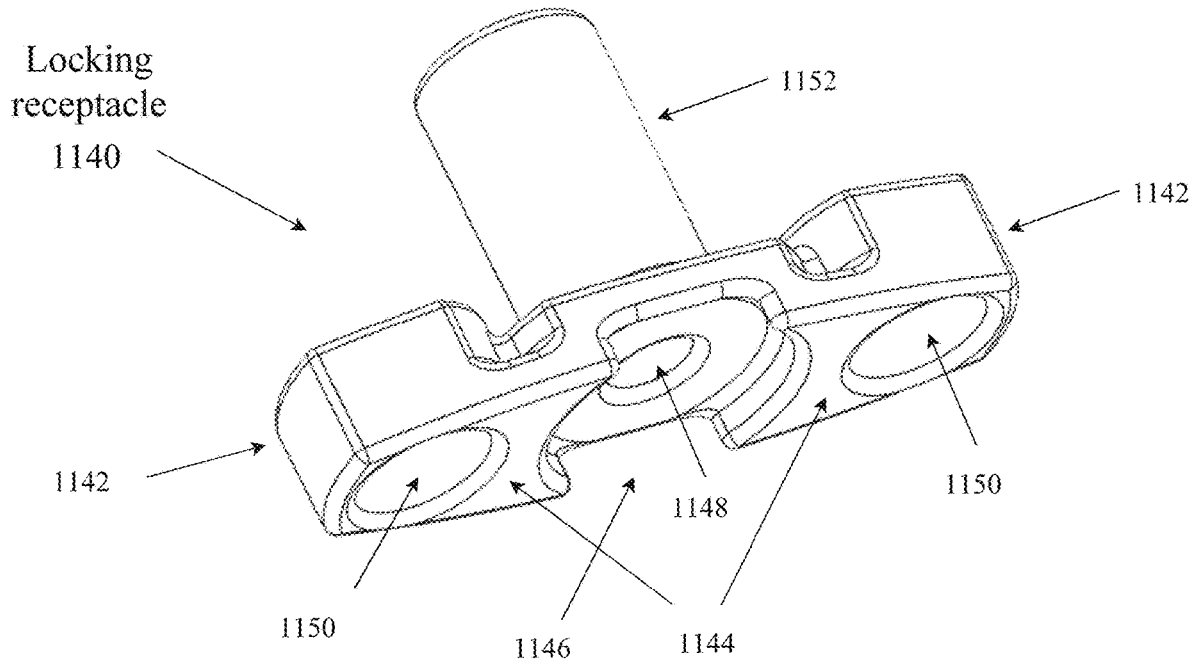
FIGS. 60A-60B show the locking receptacle for the rotatable toy bar device according to various exemplary embodiments described herein.
Figure 60B:
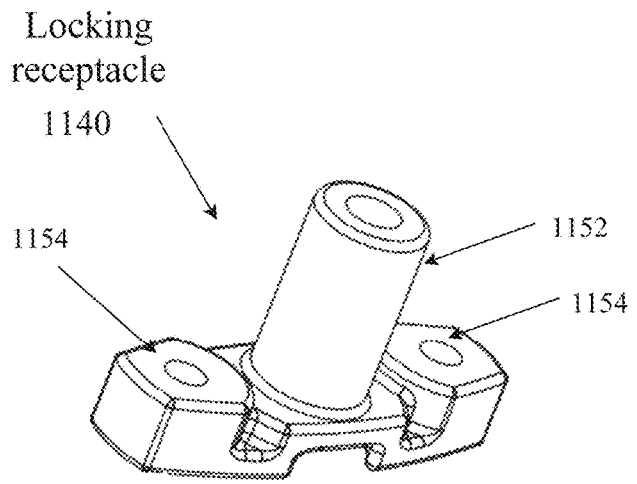

To be described in further detail below, the toy bar device 1101 comprises a locking mechanism that allows the toy bar 1102 to be rotated relative to the clip 1110, which in this embodiment is fixed to a frame 1112 of the swing 1100. The locking mechanism generally includes a locking receptable 1140 disposed within or attached to the toy bar 1102, e.g., a locking receptacle 1140 as shown in FIGS. 60A-60B, that is rotatably coupled to a locking plate 1120 disposed within the clip 1110 that removably couples the toy bar device 1101 to the frame 1112, e.g., a locking plate 1120 as shown in FIGS. 59A-59B. Various manners of configuring the locking mechanism will be described in detail below. However, the person skilled in the art will understand that the locking mechanism may be implemented in various ways for the swing 1100 and/or for other child support devices and is not limited to the configurations shown herein.

In the example of FIGS. 56A-56B, the first end 1104 of the toy bar 1102 is hollow so that the locking receptacle 1140 may be received therein and fixed to the interior of the toy bar 1102. However, in other embodiments, the locking receptacle 1140 may be attached to, or integrally formed with, the exterior of the first end 1104 of the toy bar 1102.

In the example of FIGS. 56A-56B, the toy bar 1102 is rotatably coupled to a clip 1110 that is removably coupled to a frame 1112 of the swing 1100. For example, in this embodiment, a fastener 1180, such as a screw or rivet, extends through the locking plate 1120 into the locking receptacle 1140 so that the locking receptacle 1140 and the toy bar 1102 can rotate relative to the clip 1110 and the locking plate 1120, as shown in greater detail in FIGS. 58A-58C. In addition, the fastener 1180 maintains the locking receptacle 1140 in position so that it is pressed against the locking plate 1120 to generate the force that maintain the protrusions 1130 seated as desired in the recesses 1150. To be described in further detail below, the clip 1110 is formed with or coupled to the locking plate 1120 of the locking mechanism. In this way, the rotation functionality is fully encompassed within the toy bar device 1101, i.e., within the toy bar 1102 and the clip 1110, and the clip 1110 (with the attached toy bar 1102) may be removed from the swing 1100 if desired by a caregiver, for example during transit. However, in other embodiments, a clip 1110 may not be used, and the locking plate may be disposed directly on or formed with the frame 1112.

In the example of FIGS. 56A-56B, the clip 1110 (with the attached toy bar 1102) is disposed on a portion of the frame 1112 opposite a portion of the frame 1112 that couples to a base 1114 of the swing 1100. The frame 1112 supports a seat 1116 for receiving a child, and the base 1114 is designed to support the frame 1112 and seat 1116 of the swing 1100 with a child received therein. The base 1114 may be designed in a variety of manners outside the scope of the present disclosure. In some designs, the frame 1112 may be coupled to the base 1114 so that the position of the frame 1112 may be adjusted relative to the base 1114, for example to recline the swing 1100. FIG. 56B shows a rear view of the swing 1100 that includes a recline actuator 1118 for the swing 1100 that is disposed on the frame 1112. The clip 110 may be designed to couple to the frame 1112 via the recline actuator 118, to be described in further detail below with respect to FIGS. 61-62. However, in other embodiments, the clip may couple to the frame 1112 in a different manner.

Figure 57A:
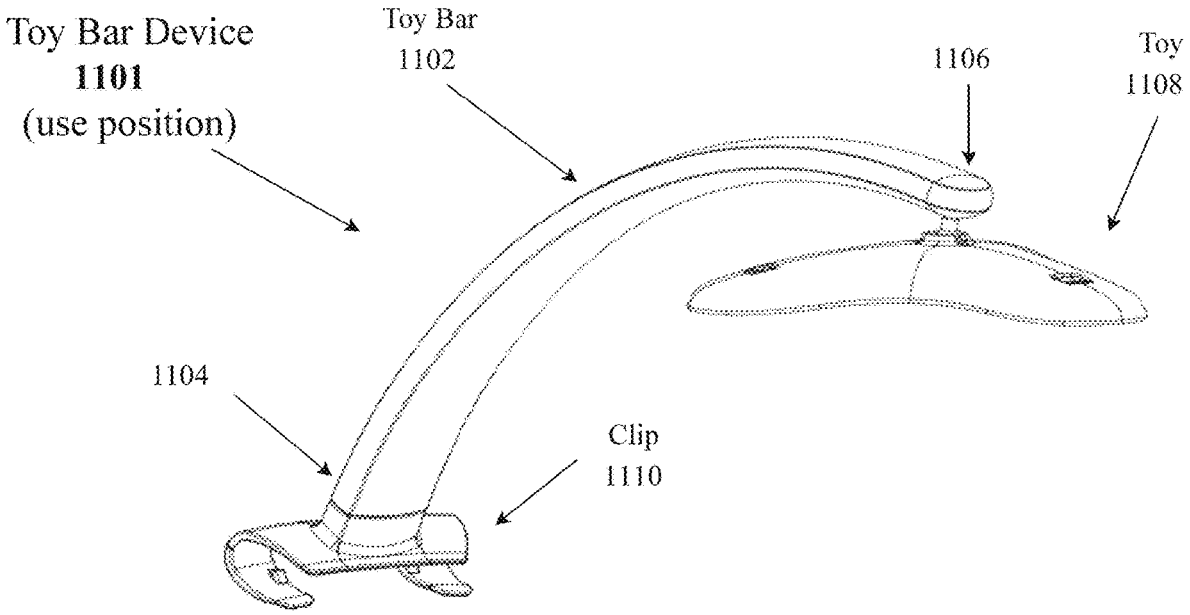
FIG. 57A shows a toy bar of the toy bar device of FIGS. 56A-56B in a first position (use position).
Figure 57B:
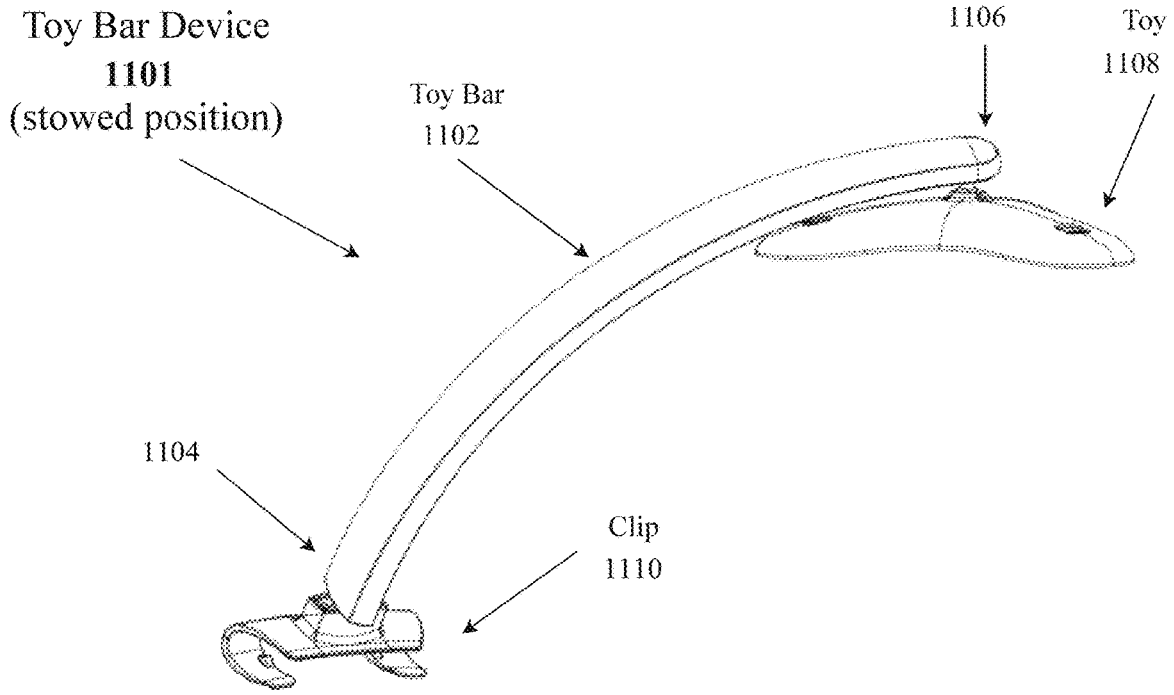
FIG. 57B shows the toy bar of the toy bar device of FIGS. 56A-56B in a second position (stowed position).

FIG. 57A shows a toy bar 1102 of the toy bar device 1101 of FIGS. 56A-56B in a first position (use position). In the use position, the toy bar 1102 of this embodiment and a toy 1108 coupled to the second end 1106 of the toy bar 1102 hang over the seat 116 of the swing 1100. FIG. 57B shows the toy bar 1102 of the toy bar device 1101 of FIGS. 56A-56B in a second position (stowed position). In the stowed position, the toy bar 1102 and the toy 1108 at the second end 1106 of the toy bar 1102 are rotated away from the seat 1116 of the swing 1100.

Figure 58A:
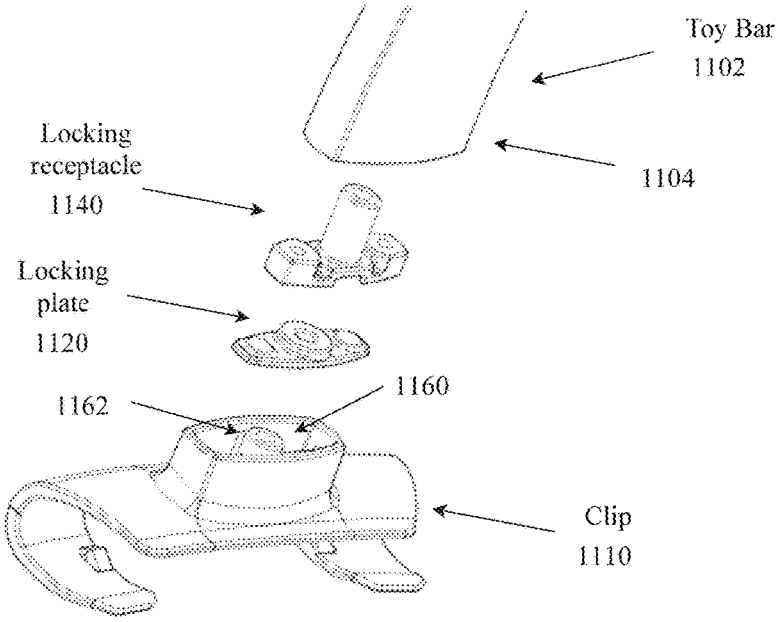
FIGS. 58A-58B show exploded views of the locking mechanism for the rotatable toy bar device according to various exemplary embodiments described herein.
Figure 58C:
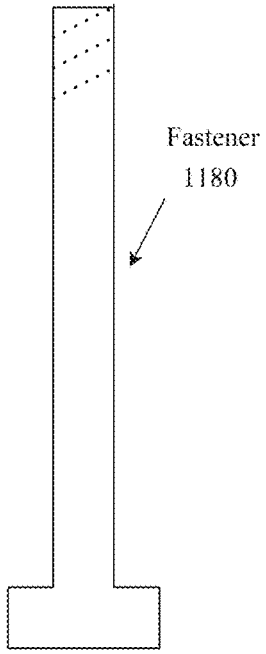
FIG. 58C shows a fastener for rotatably fastening a clip of the toy bar device to the toy bar.
Figure 58B:
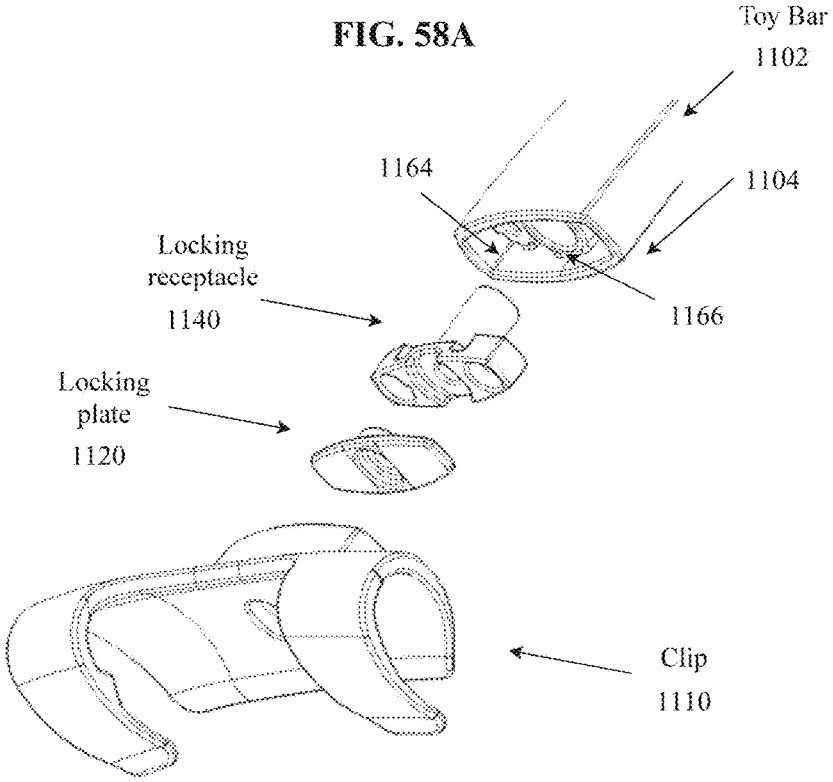

FIGS. 58A-58B show exploded views of the locking mechanism for the toy bar device 1101 according to various exemplary embodiments described herein. As discussed above, the rotation functionality for the toy bar device 1101 is effectuated via the locking mechanism which is implemented via a locking plate 1120 and a locking receptacle 1140. As discussed above, the locking receptacle 1140 may be formed with or attached to an interior of the first end 1104 of the toy bar 1102, while the locking plate 1120 may be formed with or attached to the clip 1110. Those skilled in the art will understand also that in an alternative embodiment, the locking plate 1120 may be mounted in the toy bar 1102 while the locking receptacle 1140 is mounted within the clip 1110 without changing the functioning of the toy bar device 1101.

In the example shown in FIGS. 58A-58B, the locking plate 1120 is non-rotatably received in a cavity 1162 of the clip 1110. A member 1160 extends through the center of the cavity 1162 of the clip 1110 and, when the locking plate 1120 is received in the cavity 1162 of the clip, the locking plate1 1120 sits on the member 1160 so that the cantilevered ends of the locking plate 1120 are suspended within the cavity 1162 free to deflect away from the locking receptacle 1140 as the toy bar 1102 is rotated away from the use position. The member 1160 is received within a corresponding cavity 1134 extending into the bottom surface 1132 of the locking plate 1120, as shown in further detail below with respect to FIGS. 59A-59B. A first end of the member 1160 includes a head sized to prevent the member 1160 from passing through the plate 120 while a second end of the member 1160 is coupled to the clip 110 so that a separation between the bottom surface 1132 and an end of the clip 1110 provides space within which the cantilevered ends of the locking plate 1120 may be deflected.

The locking receptacle 1140 is received in a cavity 1164 extending into the first side 1104 of the toy bar 1102, with one or more members/protrusions extending from the top surface of the locking receptacle 1140, e.g., the central hub 1152 and the protrusions 1154 shown in FIG. 60B, received within corresponding recesses 1166 in the interior of the toy bar 1102 so that the locking receptacle 1140 may not rotate relative to the toy bar 1102. Those skilled in the art will understand that the locking receptacle 1140 may be non-rotatably coupled to the toy bar 1102 in any desired manner (e.g., via welding, adhesive or other mechanical couplings).

The locking plate 1120 and the locking receptacle 1140 are rotatably coupled to one another by receiving a fastening protrusion 1126 extending from a top surface of the locking plate 1120 within a cavity 1146 extending into the bottom surface 1144 of the locking receptacle 1140, to be described in further detail below with respect to FIGS. 59A, 59B, 60A and 60B.

Figure 58D:
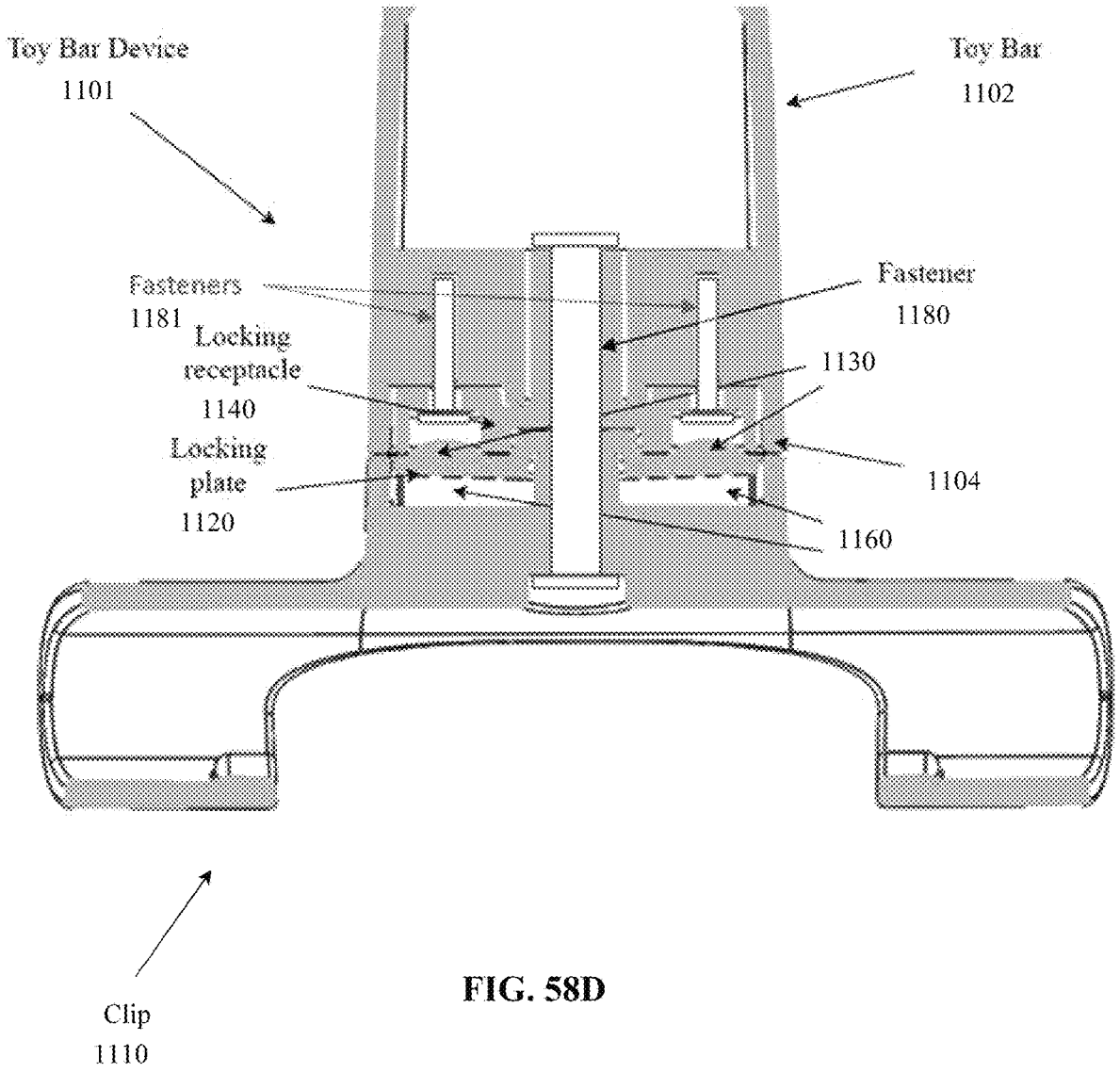
FIG. 58D shows a cross-sectional view of the toy bar device in an assembled state.

FIG. 58C shows the fastener 1180 for rotatably fastening a clip 1110 of the toy bar device 1101 to the toy bar 1102. The fastener 1180, or some other fastener, may rotatably fasten the clip 1110 including the locking plate 1120 to the toy bar 1102 including the locking receptacle 1140 while maintaining a desired level of compression between the locking plate 1120 and the locking receptacle 1140 to permit locking of the toy bar 1102 in desired positions while permitting rotation of the toy bar 1102 away from and back to the use position. FIG. 58D shows a cross-sectional view of the toy bar device 101 in an assembled state. The fastener 1180 extends through the clip 1110, the locking plate 1120, and the locking receptacle 1140 and into the interior of the toy bar 1102 to couple the clip 1110, the locking plate 1120 and the locking receptacle 1140 to one another. The locking plate 1120 may then be coupled to the toy bar 1102 via separate screws 1181 or any other means as would be understood by those skilled in the art.

As described above, the toy bar 1102 and the locking receptacle 1140 are rotatably fixed relative to one another, while the clip 1110 and the locking plate 1120 are similarly rotatably fixed relative to one another. These rotatably fixed pieces (e.g., a first piece comprising the toy bar 1102 and locking receptacle 1140 and a second piece comprising the clip 1110 and the locking plate 1120) are rotatably coupled via the fastener 1180 about a rotation axis extending through a center of these pieces, e.g., about the longitudinal axis of the fastener 1180.

Additionally, the locking receptacle 1140 and the toy bar 1102 are coupled so that the locking receptacle 1140 cannot translate from the first end 104 further into the toy bar 1102 towards the second end 1106. The locking plate 1120 and the clip 1110 are similarly coupled so that the center hub 1126 of the locking plate 1120 cannot translate further into the clip 1110. However, as will be described in detail below, the locking plate 1120 comprises cantilevered sides 1122 that may deflect from a relaxed (non-deflected) position to a deflected position when an orthogonal force is applied to the sides 1122.

FIGS. 59A-59B show the locking plate 1120 for the rotatable toy bar device 1101 according to various exemplary embodiments described herein. In the embodiment shown in FIGS. 59A-59B, the body of the locking plate 1120 has a propeller-like shape with two sides 1122 extending laterally from a central hub 1126. The central hub 1126, in this embodiment, is cylindrical with a beveled edge. However, in other embodiments, the central hub 1126 may be shaped differently, e.g., may include a flat upper surface. The central hub 1126 can protrude orthogonally from a top surface 1124 of the plate 1120, although, it need not protrude from the top surface 1124 in alternative embodiments. As discussed above with respect to FIGS. 58A-58B, the central hub 1126 of the locking plate 1120 is sized and shaped to be received in a cavity 1146 of the locking receptacle 1140. The central hub 1126 has a channel 1128 extending orthogonally therethrough for receiving the fastener 1180 to attach the locking plate 1120 to the clip 1 110 (and to the locking receptacle 1140/toy bar 1102).

Each side 1122 of the plate 1120 has a locking protrusion 130 extending from the top side 1124 of the plate 1120. The locking protrusions 1130, in this embodiment, have convex upper surfaces that may, for example, be formed as part of a sphere and are sized and shaped to be received in corresponding locking recesses 1150 of the locking receptable 1140, to be described in greater detail below. However, other shapes may be used for the locking protrusions 1130. For example, the locking protrusions may be cylindrical with a beveled edge. The person skilled in the art will understand that the locking protrusions 1130 may comprise any shape that can be received within the locking recesses 1150 and, when the locking protrusions 1130 are brought into contact with the interior surface of the locking recesses 1150, provide a surface over which the interior surface of the locking recesses may slide while providing a force at the contact point(s) between the surfaces, to be described in greater detail below.

The plate 1120 may be coupled to the clip 1110, or directly to the frame 1112 itself, in a variety of manners. In the example shown in FIGS. 59A-59B, the locking plate 1120 has a cavity 1134 sized and shaped to receive a member 1162 extending through the interior of the clip 1110. The member 1162 of this embodiment may include a notch extending orthogonally therefrom that is shaped to be received in a corresponding gap in the cavity 1134 so that, when the plate 1120 is received in the clip 1110 and the member 1162 is received in the cavity 1134, the locking plate 1120 cannot rotate relative to the clip 1110. Alternatively, the outer edges of the locking plate 1120 may be formed to interact with a surrounding wall of the clip 1110 so that the locking plate 1120 may not rotate within the clip 1110. As discussed above, in other embodiments, a clip 110 may not be included (e.g., if the toy bar device 1101 is formed as a unitary element with the frame 1112 of the swing 1100). In such embodiments, the member 1162 described for the clip 1110 may extend directly from the frame 1112. In other embodiments, the locking plate 1120 may be formed with the clip1 1110, and thus a member/cavity arrangement as described above may not be necessary to fix the locking plate 120 to the clip 1110. Importantly, a bottom surface 11132 of plate 1120 does not contact the clip 1110 or any other part, e.g., the frame 1112, of the swing 1100. Thus, the sides 1122 of the locking plate 120 may freely deflect into the space below the sides 1122 of the locking plate 1120 when a downward force is applied to the sides 1122, e.g., by the bottom surface 1144 of the locking receptacle 1140.

FIGS. 60A-60B show the locking receptacle 1140 for the rotatable toy bar device 1101 according to various exemplary embodiments described herein. The body of the locking receptacle 1140 is shaped similarly to the locking plate 1120 and includes two sides 1142 extending from a central hub 1152. A bottom surface 1144 of the locking receptacle 1140 has a fastening cavity 1146 in the center thereof and extending thereinto for receiving the central hub 1126 of the locking plate 1120. The central hub 1152 of the locking receptacle 1140 has a channel 1148 extending therethrough for receiving the fastener 1180 (e.g., a screw, rivet, or some other fastener) therewithin to fasten the locking receptacle 1140 to the interior of the toy bar 1102, the locking plate 1120 and the clip 1110. The central hub 1152 of this embodiment is cylindrical (although other shapes may be employed without deviating from the scope of the embodiments) and extends, for example, orthogonally from a top surface of the locking receptacle 1140 to be received in the cavity 1164 in the interior of the first side 11104 of the toy bar 1102. Additionally, two additional protrusions 1154 may extend from the top surface of the sides 1142 of the locking receptacle 1140 to be received in corresponding cavities in the interior of the toy bar 1102 so that the locking receptacle 1140 is rotatably locked with the toy bar 1102.

The bottom surface of the sides 1142 of the locking receptacle 1140 includes respective locking recesses 1150 sized and shaped to receive the locking protrusions 1130 of the locking plate 1120 when the locking mechanism is in the "use position."

The locking mechanism comprises the locking protrusions 1130 of the locking plate 1120 and the locking recesses 1150 of the locking receptacle 1140 along with the structure that holds these elements in contact with one another in a manner that prevents them from disengaging until the user specifically directs a rotational force to the toy bar 1102 relative to the clip 1110. When the locking receptacle 1140 is positioned so that the locking protrusions 130 of the locking plate 1120 are received in the locking recesses 1150 of the locking receptacle 1140, the toy bar 1102 will be rotated relative to the frame 1112 so that the second end 1106 (and the attached toy 1108) are positioned over the seat 1116 of the swing 1100. When the toy bar 1102 (and attached locking receptacle 1140) is rotated, the interior of the beveled surface of the locking recesses 1150 are brought into contact with the surfaces of the locking protrusions 1130. The force of the rotation, applied to the contact point(s) between the locking protrusions 1130 and the locking recesses 1150, provides a downward force on the locking protrusions 11130, and thus the cantilevered sides 11122 of the locking plate 120. The downward forces cause the cantilevered sides 1122 of the locking plate 1120 to deflect downward, allowing the locking receptacle 1140 to continue to rotate so that the locking protrusions 1130 contact the bottom surface 1144 of the locking receptacle 1140 until the locking receptacle 1140 has rotated to a sufficient degree so that the sides 1142 of the locking receptacle 1140 no longer contact the locking protrusions 1130 of the locking plate 1120. After this degree of rotation, the locking receptacle 1140, and thus the toy bar 1102, can be further rotated into the "stowed position" (see FIG. 57B), where the toy bar 1102 no longer overhangs the seat 116.

To return the toy bar 1102 to the "use position," the user rotates the toy bar 1102 in the opposite direction. When the toy bar 1102 has been rotated to a sufficient degree, the beveled edges of the sides 1142 of the locking receptacle 1140 are brought into contact with the surfaces of the locking protrusions 1130 of the locking plate 1120. The force of the rotation, applied to the contact point(s) between the locking protrusions 1130 and the sides 1142 of the locking receptacle 1140, provides a downward force on the locking protrusions 1130, and thus the cantilevered sides 1122 of the locking plate 1120. The downward force causes the cantilevered sides 122 of the locking plate 1120 to deflect downward, allowing the locking receptacle 1140 to continue to rotate, bringing the locking protrusions 1130 into contact with the bottom surface 1144 of the locking receptacle 1140 until the locking receptacle 1140 has rotated sufficiently so that the locking protrusions 1130 are received in the locking recesses 1150 of the locking receptacle 1140 and the sides 1122 of the locking plate return to a relaxed state (with the protrusions 1130 snapping back into the recesses 1150 to their non-deflected state). After this occurs, the locking receptacle 1140, and thus the toy bar 1102, are in the "use position" (see FIG. 57A) where the toy bar 1102 overhangs the seat 1116 of the swing 1100.

In alternative embodiments, a greater or lesser number of locking protrusions and locking recesses may be used to lock the toy bar into the "use position." For example, in one embodiment, a single locking protrusion (extending orthogonally from a single side of the locking plate) may be received in a single locking recess (extending into a single side of the locking receptacle). In another embodiment, the locking plate may comprise four sides extending from the central hub in a fan-like arrangement, each side having a respective locking protrusion extending orthogonally therefrom to be received in a corresponding locking recess extending into a four-sided locking receptacle. In this embodiment, the toy arm can be rotated (and locked) into four different positions at 90 deg to one another.

In still other embodiments, the locking plate may include additional or other sides extending at angles less than 90 deg from one another so that the toy arm may be locked into varying positions around the child swing. In still other embodiments, the locking plate may comprise a circular shape with protrusions disposed close to a perimeter thereof. Those skilled in the art will understand that the stiffness of the body of the locking plate 120 may be controlled by selecting materials of desired mechanical properties, controlling the thickness of such materials, by creating spaces between adjacent protrusions 1130, etc. so that a desired deflecting force is required to move the toy bar 11102 out of a locked position.

Furthermore, those skilled in the art will understand that, alternatively, the locking plate 120 may be made rigid while ends of the locking receptacle 1140 may be cantilevered over a recess in the first end 1104 of the toy bar 1102 so that the ends of the locking receptacle 1140 may be deflected out of engagement with the protrusions 1130 as the toy bar 1102 is rotated away from a previous locked position, while the locking plate 1120 and the protrusions 1130 do not deflect. Of course, as mentioned previously, the positions of the locking plate 1120 and the locking receptacle 1140 may be reversed with the locking receptacle 1140 located in the clip 1110 and the locking plate 1120 located within the toy arm 1102. If the locking receptacle in such an embodiment were made deflectable as described above and the locking plate 1120 made rigid, those skilled in the art would understand that the locking receptacle 1140 would be cantilevered over a recess in the clip 1110.

In still another exemplary embodiment, the clip may be coupled to the frame of the swing via alignment protrusions sized and shaped to be received in alignment recesses in a recline actuator so that the actuator ensures the toy bar device 1101 is clipped to the swing 1100 in a desired position. For example, the clip 1110 may include a recess that is sized and shaped to receive the actuator therein when the clip 1110 is positioned as desired on the frame of the swing 1100.

Figure 61:
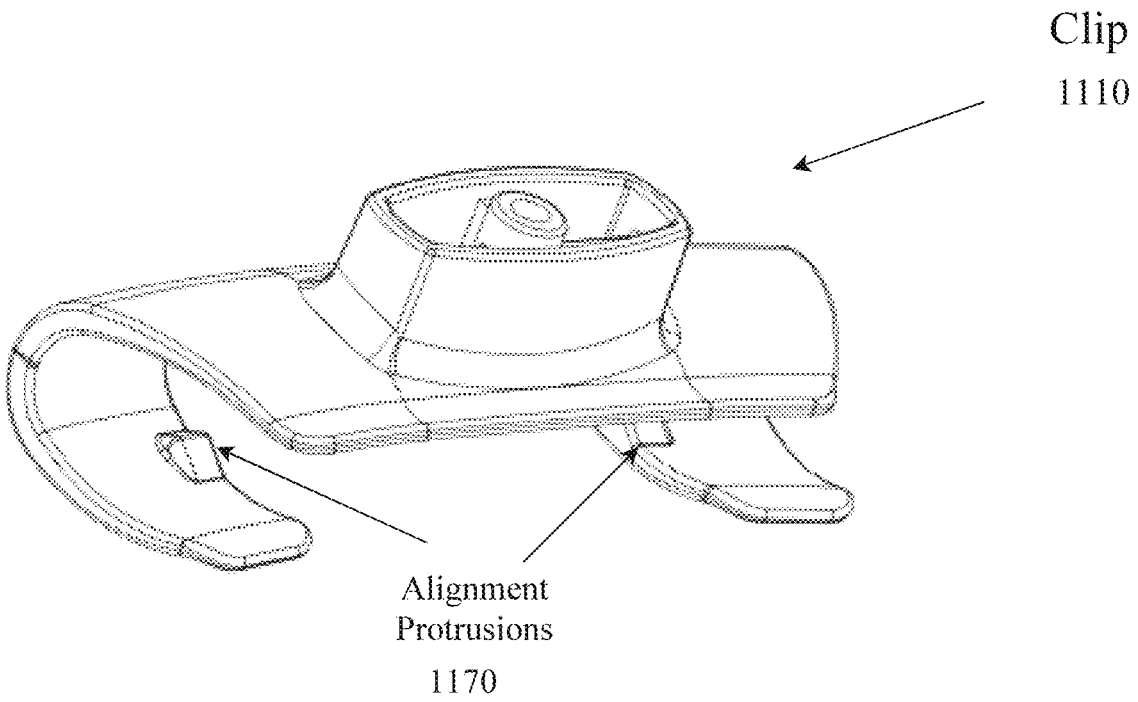
FIG. 61 shows the clip including alignment protrusions extending radially inward from an interior surface of the clip.
Figure 62:
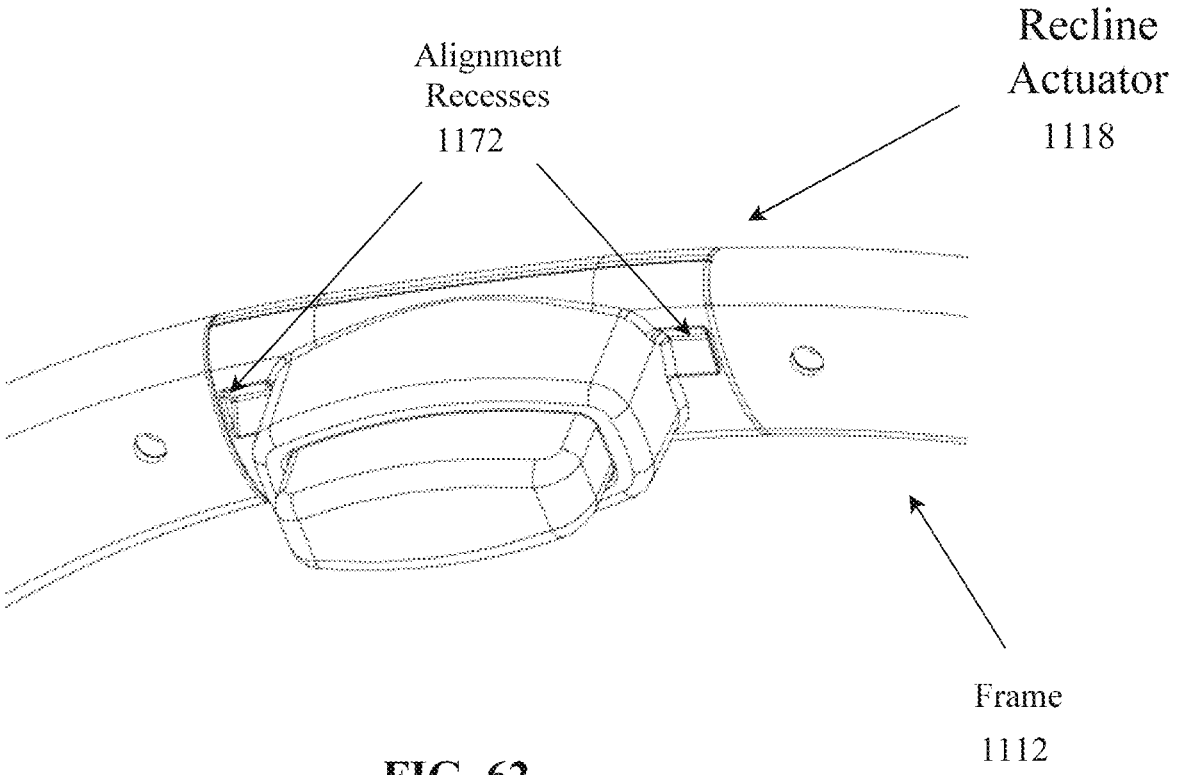
FIG. 62 shows the recline actuator including alignment recesses extending radially inward into an exterior surface of the recline actuator.

FIG. 61 shows the clip 1110 including alignment protrusions 1170 extending radially inward from an interior surface of the clip 1110. FIG. 62 shows the recline actuator 1118 including alignment recesses 1172 extending radially inward into an exterior surface of the recline actuator 1118. The alignment protrusions 1170 are sized and shaped so that, when the clip 1110 is brought into alignment with the alignment recesses 1172, the alignment protrusions 1170 extend into the alignment recesses 1172 and secure the clip 1110 to the recline actuator 1118, and thus the frame 1112.

In still another embodiment, a similar locking mechanism as that described above may be used between the toy 1108 and the second end 1106 of the toy bar 1102, thus allowing the toy 1108 to be rotated from a use position, for example where the toy 1108 is directed down from the second end 1106, to a stowed position, for example where the toy 1108 is directed laterally or upward from the second end 1106.

The present disclosure relates to a child swing which includes a base configured to support the child swing on a floor; a column extending upwards from the base and defines an axis of rotation; a seat supported by the column above the base, the column configured to transition the seat between a lowered position in which the seat is positioned at a first height above the floor, and a raised position in which the seat is positioned at a second height above the floor, greater than the first height; and a vibration device connected to the base such that vibration generated by the vibration device is transmitted to the column and the seat from the base.

In an embodiment, the seat is configured to rotate about the axis of rotation relative to the base in both the lowered position and the raised position.

In an embodiment, the base defines a cavity, and wherein the vibration device is at least partially positioned within the cavity.

In an embodiment, an entirety of the seat is higher in the raised position than the lowered position.

In an embodiment, the child swing further includes a magnetic drive comprising: at least one magnet; and at least one other magnet defining a first end having a first polarity, and a second end having a second polarity different from the first polarity. The first and second ends are spaced from one another along a direction of rotation. The at least one magnet and the at least one other magnet are configured to apply magnetic forces to one another so as to cause relative rotation between the at least one magnet and the at least one other magnet that drives at least a portion of the column to rotate about the axis of rotation relative to the base.

In an embodiment, the swing further includes a controller configured to 1.) send a first control signal to the vibration device to control the vibration generated by the vibration device, and 2.) send a second control signal to the magnetic drive to control the magnetic forces applied by the at least one magnet and the at least one other magnet to each other.

In an embodiment, the child swing further includes a power supply configured to supply power to both the vibration device and the controller.

In an embodiment, the controller is further configured to supply power to the magnetic drive.

Although this application describes various embodiments each having different features in various combinations, those skilled in the art will understand that any of the features of one embodiment may be combined with the features of the other embodiments in any manner not specifically disclaimed or which is not functionally or logically inconsistent with the operation of the device or the stated functions of the disclosed embodiments.

It will be apparent to those skilled in the art that various modifications may be made in the present disclosure, without departing from the spirit or the scope of the disclosure. Thus, it is intended that the present disclosure cover modifications and variations of this disclosure provided they come within the scope of the appended claims and their equivalent.

It should be noted that the illustrations and descriptions of the examples and embodiments shown in the figures are for exemplary purposes only, and should not be construed limiting the disclosure. One skilled in the art will appreciate that the present disclosure contemplates various embodiments. Additionally, it should be understood that the concepts described above with the above-described examples and embodiments may be employed alone or in combination with any of the other examples and embodiments described above. It should further be appreciated that the various alternative examples and embodiments described above with respect to one illustrated embodiment can apply to all examples and embodiments as described herein, unless otherwise indicated.

Unless explicitly stated otherwise, each numerical value and range should be interpreted as being approximate as if the word "about," "approximately," or "substantially" preceded the value or range. The terms "about," "approximately," and "substantially" can be understood as describing a range that is within 15 percent of a specified value unless otherwise stated.

Conditional language used herein, such as, among others, ""can"" ""could"" ""might"" ""may"" "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth.

While certain example embodiments have been described, these embodiments have been presented by way of example only and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein. The accompanying claims and their equivalents are intended to cover such forms or modifications as would fall within the scope and spirit of certain of the inventions disclosed herein.

The indefinite articles "a" and "an," as used herein in the specification and in the claims, unless clearly indicated to the contrary, should be understood to mean "at least one." Thus, it will be understood that reference herein to "a," "and," or "one" to describe a feature such as a component or step does not foreclose additional features or multiples of the feature. For instance, reference to a device having, comprising, including, or defining "one" of a feature does not preclude the device from having, comprising, including, or defining more than one of the feature, as long as the device has, comprises, includes, or defines at least one of the feature. Similarly, reference herein to "one of" a plurality of features does not foreclose the invention from including two or more of the features. For instance, reference to a device having, comprising, including, or defining "one of a protrusion and a recess" does not foreclose the device from having both the protrusion and the recess.

The phrase "and/or," as used herein in the specification and in the claims, should be understood to mean "either or both" of the components so conjoined, i.e., components that are conjunctively present in some cases and disjunctively present in other cases. Multiple components listed with "and/or" should be construed in the same fashion, i.e., "one or more" of the components so conjoined. Other components may optionally be present other than the components specifically identified by the "and/or" clause, whether related or unrelated to those components specifically identified. Thus, as a non-limiting example, a reference to "A and/or B", when used in conjunction with open-ended language such as "comprising" can refer, in one embodiment, to A only (optionally including components other than B); in another embodiment, to B only (optionally including components other than A); in yet another embodiment, to both A and B (optionally including other components); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of components, and, optionally, additional unlisted items. Only terms clearly indicated to the contrary, such as "only one of" or "exactly one of," or, when used in the claims, "consisting of," will refer to the inclusion of exactly one component of a number or list of components. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more components, should be understood to mean at least one component selected from any one or more of the components in the list of components, but not necessarily including at least one of each and every component specifically listed within the list of components and not excluding any combinations of components in the list of components. This definition also allows that components may optionally be present other than the components specifically identified within the list of components to which the phrase "at least one" refers, whether related or unrelated to those components specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including components other than B); in another embodiment, to at least one, optionally including more than one, B, with no A present (and optionally including components other than A); in yet another embodiment, to at least one, optionally including more than one, A, and at least one, optionally including more than one, B (and optionally including other components); etc.

The words "inward," "outward," "upper," and "lower" refer to directions toward or away from, respectively, the geometric center of the component.

What is claimed:

1. A device for permitting rotation of a toy bar relative to a child holding apparatus, comprising:

a base configured to be coupled to a child holding apparatus, the base including a base locking structure, the base including a first end configured to be coupled to the child holding apparatus and a second end; and a toy bar extending between a first end rotatably coupled to the base and a second end, the toy bar including a bar locking structure adjacent to the base locking structure, wherein a first one of the base locking structure and the bar locking structure includes a first extension extending laterally from a hub with a first protrusion extending from the first extension, wherein the first extension is deflectable relative to the hub, and wherein a second one of the base locking structure and the bar locking structure includes a first recess positioned to receive the first protrusion when the toy bar is in a first rotational orientation relative to the base, the first recess being configured to engage the first protrusion when the toy bar is rotated relative to the base so that the first extension is deflected away from the second one of the base locking structure and the bar locking structure as the first protrusion is moved out of the first recess and, when the toy bar is rotated so that the first protrusion is brought out of contact with the second one of the base locking structure and the bar locking structure or so that the first protrusion is again received in the first recess, the first extension reverts back to a relaxed state.

2. The device of claim 1, wherein the base is selectively coupleable and removable from the child holding apparatus.

3. The device of claim 2, wherein the base is configured to engage a feature on the child holding apparatus to ensure that the base is coupled to the child holding apparatus in a desired position.

4. The device of claim 3, wherein the base is configured to be selectively coupled to the child holding apparatus that is one of a child seat and a child swing and wherein the feature is an actuator for manipulating a position of the one of the child seat and the child swing.

5. The device of claim 1, wherein the base locking structure is a locking plate including the first protrusion and wherein the first extension is cantilevered from the hub over a deflection recess within the base on a side of the locking plate opposite a side of the locking plate that faces the bar locking structure.

6. The device of claim 5, wherein the locking plate is non-rotatably coupled to the base.

7. The device of claim 5, wherein the bar locking structure is a locking receptacle including the first recess and wherein the bar locking structure is non-rotatably coupled to the toy bar.

8. The device of claim 1, wherein the bar locking structure is a locking plate including the first protrusion and wherein the first extension is cantilevered from the hub over a deflection recess within the toy bar on a side of the locking plate opposite a side of the locking plate that faces the base locking structure.

9. The device of claim 8, wherein the bar locking structure, the base locking structure and the base are rotatably coupled to one another so that the bar locking structure and the base locking structure are pressed against one another and may rotate relative to one another only when the first extension deflects into the deflection recess.

10. The device of claim 8, wherein the base locking structure is a locking receptacle including the first recess and wherein the base locking structure is non-rotatably coupled to the base.

11. A device for permitting rotation of a toy bar relative to a child holding apparatus, comprising:

a base configured to be coupled to a child holding apparatus, the base including a base locking structure, the base including a first end configured to be coupled to the child holding apparatus and a second end; and a toy bar extending between a first end rotatably coupled to the base and a second end, the toy bar including a bar locking structure adjacent to the base locking structure, wherein a first one of the base locking structure and the bar locking structure includes a first extension extending laterally from a hub with a first recess extending into the first extension, wherein the first extension is deflectable relative to the hub, and wherein a second one of the base locking structure and the bar locking structure includes a first protrusion positioned to be received in the first recess when the toy bar is in a first rotational orientation relative to the base, the first recess being configured to engage the first protrusion when the toy bar is rotated relative to the base so that the first extension is deflected away from the second one of the base locking structure and the bar locking structure as the first protrusion is moved out of the first recess and, when the toy bar is rotated so that the first protrusion is brought out of contact with the second one of the base locking structure and the bar locking structure or so that the first protrusion is again received in the first recess, the first extension reverts back to a relaxed state.

12. The device of claim 11, wherein the base locking structure is a locking receptacle including the first recess and wherein the first extension is cantilevered from the hub over a deflection recess within the base on a side of the locking receptacle opposite a side of the locking receptacle that faces the bar locking structure.

13. The device of claim 12, wherein the bar locking structure is a locking plate including a first projection and wherein the bar locking structure is non-rotatably coupled to the toy bar.

14. The device of claim 12, wherein the bar locking structure, the base locking structure and the base are rotatably coupled to one another so that the bar locking structure and the base locking structure are pressed against one another and may rotate relative to one another only when the first extension deflects into the deflection recess.

* * * * *